US005487859A

United States Patent [19]

Aneja et al.

[11] Patent Number: 5,487,859

[45] **Date of Patent: * Jan. 30, 1996**

[54] PROCESS OF MAKING FINE POLYESTER HOLLOW FILAMENTS

[75] Inventors: Arun P. Aneja, Greenville; David G. Bennie, Rocky Point; Robert J. Collins, Wilmington; Hans Rudolf E. Frankfort, Kinston; Stephen B. Johnson; Benjamin H. Knox, both of Wilmington; Elmer E. Most, Jr., Kinston, all of N.C.

[73] Assignee: E. I. Du Pont de Nemours and Company, Wilmington, Del.

[ * ] Notice: The portion of the term of this patent subsequent to Oct. 18, 2011, has been disclaimed.

[21] Appl. No.: 214,717

[22] Filed: Mar. 16, 1994

Related U.S. Application Data

[63] Continuation-in-part of Ser. No. 925,042, Aug. 5, 1992, abandoned, Ser. No. 925,041, Aug. 5, 1992, abandoned, and Ser. No. 93,156, Jul. 23, 1993, Pat. No. 5,417,902, which is a continuation-in-part of Ser. No. 926,538, Aug. 5, 1992, abandoned, each is a continuation-in-part of Ser. No. 647, 381, Jan. 29, 1991, abandoned, and Ser. No. 860,776, Mar. 27, 1992, abandoned, which is a continuation-in-part of Ser. No. 647,371, Jan. 29, 1991, abandoned, said Ser. No. 93,156is a continuation-in-part of Ser. No. 5,672, Jan. 19, 1993, Pat. No. 5,288,553, and Ser. No. 15,733, Feb. 10, 1993, Pat. No. 5,250,245, which is a continuation-in-part of Ser. No. 860,776, Ser. No. 5,672, and Ser. No. 979,776, Nov. 9, 1992, Pat. No. 5,356,582, said Ser. No. 5,672is a continuation-in-part of Ser. No. 647,381, Ser. No. 860,776, and Ser. No. 979,776, which is a continuation-in-part of Ser. No. 753,529, Sep. 3, 1991, Pat. No. 5,229,060, Ser. No. 753,769, Sep. 3, 1991, Pat. No. 5,261,472, Ser. No. 786,582, Nov. 1, 1991, Pat. No. 5,244,616, Ser. No. 786,583, Nov. 1, 1992, Pat. No. 5,145,623, Ser. No. 786,584, Nov. 1, 1991, Pat. No. 5,223,197, and Ser. No. 786,585, Nov. 1, 1991, Pat. No. 5,223,198, said Ser. No. 786,582, Ser. No. 786,583, Ser. No. 786,584, and Ser. No. 786,585, each is a continuation-in-part of Ser. No. 338,251, Apr. 14, 1989, Pat. No. 5,066,447, which is a continuation-in-part of Ser. No. 53,309, May 22, 1987, abandoned, which is a continuation-in-part of Ser. No. 824,363, Jan. 30, 1986.

[51] Int. Cl.[6] ..... D01D 5/24; D01D 5/253; D02J 1/08; D02J 1/22

[52] U.S. Cl. ..... 264/103; 28/254; 28/271; 57/287; 57/288; 57/310; 57/350; 57/908; 264/130; 264/177.14; 264/209.3; 264/209.5; 264/210.8; 264/235.6; 264/288.8; 264/290.5; 264/346

[58] Field of Search ..... 264/103, 129, 264/130, 168, 177.14, 209.1, 209.3, 209.4, 209.5, 210.8, 211.1, 211.4, 235.6, 288.8, 290.5, 346; 57/284, 287, 288, 310, 350, 908; 28/172.2, 190, 254, 271

[56] References Cited

U.S. PATENT DOCUMENTS

| | | | |
|---|---|---|---|
| 5,223,198 | 6/1993 | Frankfort et al. | 264/103 |
| 5,250,245 | 10/1993 | Collins et al. | 264/103 |
| 5,356,582 | 10/1994 | Aneja et al. | 264/103 |

FOREIGN PATENT DOCUMENTS

| | | | |
|---|---|---|---|
| 3011118 | 10/1981 | Germany | 264/177.14 |

*Primary Examiner*—Leo B. Tentoni

[57] ABSTRACT

A post-coalescence melt-spinning process for preparing fine undrawn hollow polyester filaments having excellent mechanical quality and uniformity at high speeds (2–5 km/min) involving selection of polymer viscosity and spinning conditions, whereby the void content of the resulting new undrawn filaments is essentially maintained or increased on cold-drawing or hot-drawing with or without post heat treatment, and the new fine hollow polyester filaments obtained thereby.

18 Claims, 16 Drawing Sheets

PROCESS OF MAKING FINE POLYESTER HOLLOW FILAMENTS

CROSS-REFERENCE TO RELATED APPLICATION

This application is a continuation-in-part to replace copending but now abandoned application No. 07/925,042 (DP-4555-C) filed by Aneja et al Aug. 5, 1992, and also a continuation-in-part of copending applications filed by Bennie et al Nos. 07/925,041 (DP-4555-D), also U.S. Pat. No. 5,417,902 filed Aug. 5, 1992, and also now abandoned and 08/093,156 (DP-4555-J), now having been filed Jul. 23, 1993, a continuation-in-part of abandoned application No. 07/926,538 (DP-4555-E), also filed Aug. 5, 1992, all themselves continuations-in-part of abandoned applications Nos. 07/647,381 (DP-4555-A), filed by Collins et al., Jan. 29, 1991, and 07/860,776 (DP-4555-B) filed by Collins et al., Mar. 27, 1992, as a continuation-in-part of abandoned application No. 07/647,371 (DP-4555), originally referred to as our "parent application", also filed Jan. 29, 1991, application 08/093,156 (DP-4555-J), now U.S. Pat. No. 5,417,906 being a continuation-in-part also of applications Nos. 08/005,672 (DP-4555-F) filed Jan. 19, 1993 and now U.S. Pat. No. 5,288,553 and 08/015,733 (DP-4555-G) filed Feb. 10, 1993 and now U.S. Pat. No. 5,250,245 each filed by Collins et al as a continuation-in-part, respectively, of the aforesaid U.S. application Ser. Nos. 07/647,381 (DP-4555-A) and 07/860,776 (DP-4555-B) for U.S. Pat. No. 5,288,553, and U.S. patent application Ser. Nos. 07/860,776 (DP-4555-B) and 08/005,672 (DP-4555-F) for U.S. Pat. No. 5,250,245, and also of a copending application 07/979,776 (DP-4040-H), now U.S. Pat. No. 5,356,582 filed by Aneja et al, Nov. 9, 1992, as a continuation-in-part of two application Nos. 07/753,529 (DP-4040-I) and 07/753,769 (DP-4040-C) both filed by Knox et al., Sep. 3, 1991, and now U.S. Pat. Nos. 5,229,060 and 5,261,472, and of the following four applications, that were all filed Nov. 1, 1991, 07/786,582 (DP-4040-D), filed by Hendrix et al., now U.S. Pat. No. 5,244,616, 07/786,583 (DP-4040-E), filed by Hendrix et al., now U.S. Pat. No. 5,145,623,, 07/786,584 (DP-4040-F), filed by Boles et al., now U.S. Pat. No. 5,223,197, and 07/786,585 (DP-4040-G), filed by Frankfort et al., now U.S. Pat. No. 5,223,198, all four filed as continuations-in-part of application 07/338,251 (DP-4040-B), filed Apr. 14, 1989, now (Knox and Noe) U.S. Pat. No. 5,066,447, itself a continuation-in-part of abandoned application 07/053,309 (DP-4040-A), filed May 22, 1987, itself a continuation-in-part of abandoned application 06/824,363 (DP-4040), filed Jan. 30, 1986.

TECHNICAL FIELD

This invention concerns improvements in and relating to polyester (continuous) fine filaments having one or more longitudinal voids and an ability to maintain their filament void content during drawing, and more especially to a capability to provide from the same feed stock such polyester continuous hollow fine filament yarns of differing deniers and shrinkages, as desired, and of other useful properties; such as, including improved processes, and new flat hollow fine filament yarns and bulky hollow fine filament yarns, as well as hollow fine filaments in the form of tows, resulting from such processes, and including mixed filament yarns, and downstream products from such hollow fine filaments, and from such yarns, and from tows, including cut staple, and spun yarns therefrom and fabrics made from the filaments and yarns; including new processes for preparing these new products therefrom.

BACKGROUND OF THE PARENT APPLICATION

Historically, synthetic fibers for use in apparel, including polyester fibers, have generally been supplied to the textile industry for use in fabrics and garments with the object of more or less duplicating and/or improving on natural fibers. For many years, commercial synthetic textile filaments, such as were made and used for apparel, were mostly of deniers per filament (dpf) in a similar range to those of the commoner natural fibers; i.e., cotton and wool. More recently, however, polyester filaments have been available commercially in a range of dpf similar to that of natural silk, i.e. of the order of 1 dpf, and even in subdeniers, i.e., less than about 1 dpf, despite the increased cost. Various reasons have been given for the recent commercial interest in such lower dpfs, such as about 1 dpf, or even subdeniers.

Our so-called "parent application" (originally U.S. Ser. No. 07/647,371 filed Jan. 29, 1991, but now abandoned in favor of continuation-in-parts, and issued as U.S. Pat. No. 5,250,245, the disclosure of which is hereby incorporated herein by reference) is concerned with the preparation of fine filaments by a novel direct spinning/winding process, in contrast with prior processes of first spinning larger filaments of denier greater than 1 which then needed to be further processed, in a coupled or a separate (split) process involving drawing, to obtain the desired filaments of reduced denier with properties suitable for use in textiles. The fine filaments according to the parent application are "spin-oriented" fine filaments; that is, produced without drawing as "undrawn" filaments. The significance of this is discussed in the art and hereinafter. The undrawn filaments and yarn (bundles) are often referred to by the term "as-spun" to distinguish from drawn filaments. Such undrawn fine spin-oriented filaments according to the parent application have the capability to be drawn down to a finer dpf.

The polyester polymer used for preparing spin-oriented filaments of the parent application (and of this invention herein) is selected to have a relative viscosity (LRV) in the range about 13 to about 23, a zero-shear melting point ($T_M°$) in the range about 240 C. to about 265 C.; and a glass-transition temperature ($T_g$) in the range about 40 C. to about 80 C. (wherein $T_M°$ and $T_g$ are measured from the second DSC heating cycle under nitrogen gas at a heating rate of 20 C. per minute). The said polyester polymer is a linear condensation polymer composed of alternating A and B structural units, where the A's are hydrocarbylenedioxy units of the formula [—O—R'—O—] and the B's are hydrocarbylenedicarbonyl units of the formula [—C(O)—R"—C(O)—], wherein R' is primarily [—$C_2H_4$—], as in the ethylenedioxy (glycol) unit [—O—$C_2H_4$—O—], and R" is primarily [—$C_6H_4$—], as in the p-phenylenedicarbonyl unit [—C(O)—$C_6H_4$—C(O)—], such to provide, for example, at least about 85 percent of the recurring structural units as ethylene terephthalate, [—O—$C_2H_4$—O—C(O)—$C_6H_4$—C(O)—].

Suitable poly(ethylene terephthalate), herein denoted as PET or 2GT, base polymer may be formed by a DMT-process, e.g., as described by H. Ludewig in his book "Polyester Fibers, Chemistry and Technology", John Wiley and Sons Limited (1971), or by a TPA-process, e.g., as described in Edging U.S. Pat. No. 4,110,316.

Included are also copolyesters in which, some of the hydrocarbylenedioxy and/or hydrocarbylenedicarbonyl units are replaced with different hydrocarbylenedioxy and hydrocarbylenedicarbonyl units to provide enhanced low temperature disperse dyeability, comfort, and aesthetic properties. Suitable replacement units are disclosed, e.g., in Most U.S. Pat. No. 4,444,710 (Example VI), Pacofsky U.S. Pat. No. 3,748,844 (Col. 4), and Hancock, et al. U.S. Pat. No. 4,639,347 (Col. 3).

The polyester polymer may also be modified with ionic dye sites, such as ethylene-5-M-sulfo-isophthalate residues, where M is an alkali metal cation, such as sodium or lithium; for example, in the range of 1 to about 3 mole percent ethylene-5-sodium-sulfo-isophthalate residues may be added to provide dyeability of the polyester filaments with cationic dyestuffs, as disclosed by Griffing and Remington U.S. Pat. No. 3,018,272, Hagewood et al in U.S. Pat. No. 4,929,698, Duncan and Scrivener U.S. Pat. No. 4,041,689 (Ex. VI), and Piazza and Reese U.S. Pat. No. 3,772,872 (Ex. VII).

To adjust the dyeability or other properties of the spin-oriented filaments and the drawn filaments therefrom, some diethylene glycol (DEG) may be added to the polyester polymer as disclosed by Bosley and Duncan U.S. Pat. No. 4,025,592 and in combination with chain-branching agents as described in Goodley and Taylor U.S. Pat. No. 4,945,151.

Fine filaments of lower shrinkage may be obtained, if desired, by incorporating chain branching agents, on the order of about 0.1 mole percent, as described in part in Knox U.S. Pat. No. 4,156,071, MacLean U.S. Pat. No. 4,092,229, and Reese in U.S. Pat. Nos. 4,883,032, 4,996,740, and 5,034,174; and/or increasing polymer viscosity by about +0.5 to about +1.0 LRV units.

The yarn characteristics and test methods used herein are as in the parent application, and in Frankfort and Knox U.S. Pat. No. 4,134,882, Knox U.S. Pat. No. 4,156,071, and Knox and Noe U.S. Pat. No. 5,066,447, except as otherwise indicated; for instance, the relative disperse dye rate (RDDR) is normalized to 1 dpf, dry heat shrinkage (DHS) is measured at 180° C. (unless otherwise indicated, e.g. in Example 16), and the lab relative viscosity (LRV) is defined according to Broaddus in U.S. Pat. No. 4,712,988 and is equal to about (HRV—1.2), where HRV is given in above-mentioned U.S. Pat. Nos. 4,134,882 and 4,156,071. The term elongation-to-break ($E_B$) has generally been used, but the term "residual elongation" has also been used herein, and is equivalent.

According to the parent application there is provided a process for preparing spin-oriented undrawn polyester filaments that are subdenier, for example, in the range of about 0.2 to about 0.8 denier per filament (dpf). The following is a summary of the process of the parent application for preparation of polyester fine filament yarns:

(a) by melting and heating polyester polymer, described hereinbefore, to a temperature ($T_P$) in the range of about 25 C. to about 55 C. above the apparent melting temperature $(T_M)_a$, wherein, $(T_M)_a$ is defined, herein, by: $(T_M)_a=[T_M°+2\times10^{-4}(L/D_{RND})G_a]$, where L is the length of the capillary and where $D_{RND}$ is the capillary diameter in centimeters (cm) for a round capillary, or, for a non-round capillary, where $D_{RND}$ is the calculated equivalent diameter of a round capillary of equal cross-section area $A_c$ (cm$^2$); and where the apparent capillary shear rate $G_a$ (sec$^{-1}$)= $[(32/60)/3.14)(w/1.2195)/D_{RND}^3]$, w is the capillary mass flow rate (g/min), and the polyester melt density is taken herein as 1.2195 g/cm$^3$);

(b) filtering the resulting polymer melt through inert medium sufficiently rapidly that the residence time ($t_r$) is less than about 4 minutes, wherein, $t_r$ is defined by ratio ($V_F$/Q), $V_F$ (cm$^3$) being the free-volume of the filter cavity (filled with the inert filtration medium) and Q (cm$^3$/min) being the polymer melt volume flow rate through the filter cavity; and then extruding the filtered polymer melt through a spinneret capillary at a mass flow rate (w) in the range of about 0.07 to about 0.7 grams per minute (g/min), the capillary being selected to have a cross-sectional area, $A_c=(3.14/4)D_{RND}^2$, in the range of about $125\times10^{-6}$ cm$^2$ (19.4 mils$^2$) to about $1250\times10^{-6}$ cm$^2$ (194 mils$^2$), and a length (L) and diameter ($D_{RND}$) such that the $L/D_{RND}$-ratio is in the range of about 1.25 to about 6 (preferably 1.25 to about 4);

(c) protecting the freshly extruded polymer melt from direct cooling, as it emerges from the spinneret capillary, over a distance $L_{DQ}$ of at least about 2 cm and less than about 12(dpf)$^{1/2}$ cm, and then carefully cooling the extruded melt to below the polymer glass-transition temperature ($T_g$) by use of laminar cross-flow air or by radially directed air of velocity ($V_a$) in the range of about 10 to about 30 m/min; and attenuating the cooling spinline to an apparent spinline strain, defined as the natural logarithm (ln) of the ratio of the withdrawal speed (V) and the capillary extrusion speed ($V_o$), in the range of about 5.7 to about 7.6, and developing during attenuation an apparent internal spinline stress at the "neck-point" in the range of about 0.025 to about 0.195 g/d;

(d) converging the cooled and fully attenuated filaments into a multifilament bundle by use of a low friction surface, such as by a metered finish tip applicator, at a distance ($L_c$) from the face of the spinneret preferably in the range of about 50 cm to about [50+90(dpf)$^{1/2}$] cm, wherein the finish is usually an aqueous emulsion and percent finish-on-yarn is selected for end-use processing requirements; and then interlacing the filament bundle using an air jet where the degree of interfilament entanglement is selected based on yarn packaging and end-use requirements; and winding up the multifilament bundle at a withdrawal speed ($V_s$), herein defined as the surface speed of the first driven roll, in the range of about 2 to about 6 km/min, wherein the retractive forces from aerodynamic drag are reduced by relaxing the spinline between the first driven roll and the windup roll.

According to the parent application, the following filament yarns are provided:

(a) spin-oriented polyester fine filaments of denier about 0.2 to about 0.8, a shrinkage differential (DHS-S) less than about +2%; a maximum shrinkage tension, ($ST_{max}$) less than about 0.2 g/d; temperature of maximum shrinkage tension, $T(ST_{max})$, between about ($T_g$+5 C.) and about ($T_g$+30 C.); a tenacity-at-7%-elongation ($T_7$) in the range of about 0.5 to about 1.75 g/d and a $[(T_B)_n/T_7])$-ratio at least about ($5/T_7$); and the percent elongation-at-break ($E_B$) between about 40 and 160%.

(b) spin-oriented fine filaments, especially suitable as use as draw feed yarns (DFY), are further characterized by: boil-off shrinkage (S) and dry heat shrinkage (DHS) greater than about 12% and less than about the maximum shrinkage potential $S_m$ and an $E_B$ in the range of about 80% to about 160% with a $T_7$ in the range of about 0.5 to about 1 g/d;

(c) spin-oriented fine filaments, especially suitable for use as direct-use yarns (DUY), are further characterized by: boil-off shrinkage (S) and dry heat shrinkage (DHS) in the range of about 2% to about 12%, such that the filament denier after boil-off, dpf(ABO), is in the range of about 1 to about 0.2 dpf; a $T_7$ about 1 to about 1.75 g/d with an $E_B$ in the range of about 40% to about 90% and a post-yield modulus ($M_{py}$) in the range of about 2 to about 12 g/d.

(d) drawn yarns of the spin-oriented filaments of this invention are characterized by an $E_B$ in the range of about 15% to about 55%, a dpf(ABO) of 1 or less, S between about 3 and about 12%, $T_7$ greater than about 1 g/d, a $[(T_B)_n/T_7]$ )-ratio at least about $(5/T_7)$; and preferably a $M_{py}$ in range of about 5 to about 25 g/d and an RDDR value at least about 0.1.

The low shrinkage filaments of the parent application are further characterized by a fiber structure described in terms of: a dynamic loss modulus peak temperature, T(E"max) less than about 115 C.; an average crystal size (CS), between about 50 and about 90 angstroms (Å) with a fractional volume crystallinity ($X_v$) between about 0.2 and about 0.5 for density values between about 1.355 and about 1.395 grams/cm$^3$; a fractional average orientation function (f) between about 0.25 and about 0.5 with a fractional amorphous orientation function ($f_a$) less than about 0.4 such to provide an amorphous free-volume ($V_{f,am}$) of at least about $0.5\times10^6$ cubic angstroms (Å$^3$).

BACKGROUND OF THE PRESENT INVENTION

Conventional polyester hollow filaments typically do not fully retain the same level of void content (VC, measured by volume, as total filament void content) as their precursor undrawn filaments when such undrawn precursor filaments are drawn. This has been a disadvantage of these drawn hollow filaments and yarns which could have been more suitable for many uses if larger void contents had been practicable, since the presence of significant voids in such filaments could have provided additional advantages over solid filaments. Continuous hollow filament yarns could have provided advantages such as we now recognize, including increased cover (opacity), lighter weight fabrics with comparable tensiles, increased insulation (as measured by a higher CLO-value), a dry/crisp hand which enhances the "body" and drape characteristics of fabrics made using fine filament yarns. Complex drawing processes, such as the hot water super-draw process of Most in U.S. Pat. No. 4,444,710 have been utilized to develop and retain the void content (VC) in the drawing step; and have been used to supply commercial staple fibers of textile filament deniers, despite the economic and other disadvantages of using such an additional processing step, which has had to be relatively slow in practice.

It has long been desirable to provide undrawn hollow filaments for which there is essentially no loss in void content (VC) on drawing. It is desirable that any new polyester filaments should have a capability to be partially or fully drawable with or without heat and with or without post heat-treatment to uniform filaments, as disclosed by Knox and Noe in aforesaid related U.S. Pat. No. 5,066,447, and in various continuation-type applications filed therafter, including aforesaid (DP-4040-H) No. 07/979,776. It has also been desirable to supply hollow filaments in the form of a continuous multi-filament yarn versus being limited to staple fiber yarns, as continuous hollow filament yarns would provide certain advantages over conventional hollow staple yarns (e.g., slightly thicker fabrics at equal weight (i.e., greater bulk, improved insulation value (warmer) yet more permeable (greater comfort), significantly improved pilling resistance, and greater wicking (moisture transport); i.e., more like fabrics made from natural fibers). Continuous filament yarns are more easily processed in weaving and knitting and can be bulked by false-twist and air-jet texturing to offer a variety of visual and tactile fabric aesthetics that cannot be achieved with staple fiber yarns.

Generally, herein, we refer to untextured filament yarns as "flat" filament yarns and to textured filament yarns (including those textured by developing mixed-shrinkage) as "bulked" or "bulky" filament yarns. For textile purposes, a "textile yarn" (i.e., direct-use flat yarn or textured yarn) must have certain properties, such as sufficiently high modulus, tenacity, yield point, and generally low shrinkage, which distinguish these yarns from certain "feed yarns", or "draw feed yarns," certain of which have required further processing to provide properties required for use in textiles; as will be related hereinafter, however, some yarns according to the present invention have properties that make them suitable for "direct-use" as "textile yarns", as well as suitable for use as "feed yarns". It should also be understood that, for the purposes of the present application, hollow filaments may be supplied and/or processed in the form of a true yarn (with coherency supplied by interlace, or twist, for example) or as a bundle of hollow filaments that does not necessarily have the coherency of a true "yarn", but for convenience herein a plurality of filaments may often be referred to as a "yarn" or "bundle", without intending specific limitation by such term. It will be recognized that, where appropriate, the technology may apply also to polyester hollow filaments in other forms, such as tows, which may then be converted into staple fiber, and used as such in accordance with the balance of properties that is desirable and may be achieved as taught hereinafter. It is generally important to maintain uniformity, both along-end and between the various filaments. Lack of uniformity would often show up in the eventual dyed fabrics as dyeing defects, so is generally undesirable. Preferred hollow filaments are comprised of longitudinal voids which desirably meet additional uniformity criteria, such as generally being further characterized by filaments of symmetrical cross-sectional shapes and generally being symmetrically positioned "concentric" longitudinal voids so as to limit the tendency of these hollow filaments to form along-end helical crimp on shrinkage.

SUMMARY OF THE INVENTION

The polyester polymer used for preparing spin-oriented undrawn hollow fine filaments of the invention is the same as that used in the "parent application", now U.S. Pat. No. 5,250,245 described in detail hereinbefore.

The spin-orientation process is used to prepare fine hollow as-spun filaments from such polyester polymer according to the present invention. Such filaments are preferably of sufficiently fine denier such as to provide drawn subdenier filaments (denier about 1 or less) when such as-spun (i.e., undrawn) filaments are drawn to a reference $E_B$ of 30%. Preferably, such undrawn polyester hollow filament yarns are themselves comprised of subdenier filaments of denier up to about 1 and generally down to about 0.2. Such filaments preferably have a total filament void content (VC) by volume of at least about 10%, and are preferably filaments of symmetric cross-sectional shape with concentric longitudinal voids; such as illustrated by (but not limited to), for example, round cross-section filaments with a single concentric longitudinal void forming a tubular hollow cross-section (see FIG. 1B of this application); by symmetric filament cross-sections of concentrically placed three and four longitudinal voids (see FIGS. 1–3 of Champaneria et al U.S. Pat. No. 3,745,061); and by symmetric filaments of elliptical cross-section, having two concentrically-placed longitudinal voids (see FIG. 1 of Stapp, German Patent No.

DE 3,011,118). The above preferred filament cross-section symmetry provides for uniform drawn hollow filaments which are further characterized by exhibiting little or no tendency to develop along-end helical crimp on shrinkage. If desired, asymmetric filament cross-sections and/or non-concentrically placed longitudinal voids may be used where along-end filament crimp is desirable for certain tactile and visual aesthetics not possible with flat or textured filaments. It is also desirable, as described hereinafter, to provide and use mixed-filament yarns (wherein the filaments differ, e.g., by denier, cross-section and/or void content) to provide fabrics of differing tactile aesthetics that cannot be achieved as readily by using conventional filament yarns (wherein all the filaments are essentially the same). Further variations, such as filaments of differing shrinkage, provide another variation for achieving differences in desired fabric aesthetics and functionality, e.g., as light weight fabric with lower rigidity but of higher number of yarns (sometimes referred to as "ends") per unit width than practical without higher levels of shrinkage, and of greater bulk through mixed-shrinkage than through level of void content alone.

The hollow filaments are formed by post-coalescence of polymer melt streams of temperature ($T_P$) about 25 to about 55 C. greater than the zero-shear polymer melting point ($T_M°$); wherein said melt streams are formed by extruding through two or more segmented capillary orifices (such as shown, e.g., in FIGS. 4B, 5B, and 6B discussed hereinafter) arranged so to provide an extrusion void area (EVA) about 0.025 $mm^2$ to about 0.45 $mm^2$, such that the ratio of EVA to the total extrusion area (EA), EVA/EA, is about 0.4 to about 0.8 and the ratio of the extrusion void area EVA to the spun filament denier $(dpf)_s$, $EVA/(dpf)_s$, is about 0.05 to about 0.55; and the freshly extruded melt streams are uniformly quenched to form hollow filaments (preferably using radially directed air of velocity about 10 to about 30 meters per minute) with an initial delay of about 2 to about $12(dpf)^{1/2}$ cm, wherein the delay length is decreased as the spun filament denier is decreased to maintain acceptable along-end denier variation; converged (after attenuation is essentially complete) into a multi-filament bundle (preferably by a metered finish tip applicator guide) at a distance $L_c$ about 50 cm to about $[50+90(dpf)^{1/2}]$ cm; generally interlaced when making continuous filamentary yarns (as is generally preferred, but generally little or no interlace is used for making tow for staple); withdrawn at spin speeds ($V_s$) about 2 to about 5 km/min and generally wound into packages (for yarns, not for staple). The preferred spin-orientation process is further characterized by making a selection of polymer LRV, zero-shear polymer melting point $T_M°$, polymer spin temperature ($T_P$), spin speed ($V_s$, m/min), extrusion void area (EVA, $mm^2$), and spun dpf to provide an "apparent total work of extension $(W_{ext})_a$" (defined hereinafter) of at least about "10" so as to develop a void content (VC) of at least 10%.

The process of the invention provides fine spin-oriented undrawn hollow filament yarns having a dry heat shrinkage peak temperature $T(ST_{max})$ of less than about 100 C.; and further characterized by an elongation-to-break ($E_B$) about 40% to about 160%, a tenacity-at-7% elongation ($T_7$) about 0.5 to about 1.75 g/d, and a $(1-S/S_m)$-ratio greater than about 0.1; preferred yarns for use as draw feed yarns preferably further characterized by an elongation-to-break ($E_B$) about 90% to about 120%, a tenacity-at-7% elongation ($T_7$) about 0.5 to about 1 g/d, with $T_{20}$ (tenacity at 20% elongation) being preferably no less than $T_7$, for improved drawing stability, and a $(1-S/S_m)$-ratio at least about 0.25; and yarns especially suitable for use as direct-use textile yarns are further characterized by an elongation-to-break ($E_B$) about 40% to about 90%, a tenacity-at-7% elongation ($T_7$) about 1 g/d to about 1.75 g/d, and a $(1-S/S_m)$-ratio greater than about 0.85. (The $1-S/S_m$ expression is used herein as a measure of SIC, Stress-Induced Crystallization, and is defined hereinafter).

According to the invention, there are also provided various processing aspects of the resulting as-spun yarns, especially involving drawing, and the resulting fine filament yarns. Such processes may be, for example, generally single-end or multi-end, split or coupled, hot or cold draw processes, and/or heat setting processing, for preparing uniform hollow flat fine filament yarns and air-jet-textured hollow fine filament yarns (of filament denier less than about 1). It is desirable that the void content (VC) be at least about 10% to provide a significant hollow void within the filament, and, preferably at least about 15%, and many desirable filaments will have voids in the range of about 15–20%, but void content of at least about 20% are sometimes desirable, and maybe obtained by use of the process of the invention. It will be understood, however, that the process of the invention may also be applied to making hollow filaments of somewhat smaller void content, e.g., between 5 and 10%. In some respects, the advantages of providing a tubular filament instead of a solid filament does not depend on the size of the void, as much as on the presence of a void in contrast to a solid filament without any void (or continuous void). In false-twist texturing the void is typically collapsed, making the filaments "cotton-like" in shape.

Drawn fine hollow filaments and yarns according to the invention are generally characterized by a residual elongation-to-break ($E_B$) about 15% to 40%, boil-off shrinkage (S) less than about 10%, tenacity-at-7% elongation ($T_7$) at least about 1 g/d, and preferably a post-yield modulus ($M_{py}$) about 5 to about 25 g/d.

Preferred polyester hollow undrawn and drawn "flat" fine filament yarns of the invention are further characterized by an along-end uniformity as measured by an along-end denier spread (DS) of less than about 3% (especially less than about 2%) and a coefficient of variation (%CV) of void content (VC) less than about 15% (especially less than about 10%).

There is is also provided a process for preparing cotton-like multifilament yarns by selecting $T_p$ to be within the range ($T_M°+25$) to ($T_M°+35$) and using an extrusion die characterized by total entrance angle (S+T) less than 40 degrees (preferably less than about 30 degrees) with a [(S/T)(L/W)]-value (referred to hereinafter) less than 1.25 and using delay quench length of less than 4 cm; and selecting capillary flow rate w and withdrawal speed $V_s$ such that the product of $(9000\ w/V_s)$ and of $[1.3/(RDR)_s]$ is between about 1 and 2, where $(RDR)_s$ is the residual draw-ratio of the spun undrawn filaments.

The new fine spin-oriented undrawn hollow filaments have an important characteristic that is new and advantageous, namely a capability that they can be drawn to even finer filament deniers without significant loss in void content (VC); that is, their $(VC)_D/(VC)_{UD}$-ratio (i.e., ratio of void content of drawn filament to that of undrawn filament) is greater than about 0.9, preferably of about 1, and especially greater than about 1 (i.e., there is an increase in void content on drawing). Especially preferred polyester undrawn hollow fine filaments may also be partially (and fully) drawn to uniform filaments by hot drawing or by cold drawing, with or without post heat treatment, or heat-treated without drawing, making such especially preferred polyester hollow filaments of the invention capable of being co-drawn with similarily drawable solid polyester undrawn filaments, for example of the parent application, and/or co-drawn with nylon undrawn filaments to provide uniform mixed-filament yarns, wherein the nylon filaments may be combined with the polyester hollow filaments of the invention during melt spinning (e.g., co-spinning from same or different spin packs) or combined by co-mingling in a separate step prior to drawing.

Further aspects and embodiments of the invention will appear hereinafter. In particular, interesting mixtures of hollow filaments and other cross-sections are discussed, and some of these variations are believed novel and inventive, as will be evident.

BRIEF DESCRIPTION OF THE DRAWINGS

FIGS. 4A, 5A and 6A are all vertical cross-sections through the spinneret, whereas FIGS. 4B, 5B and 6B are, respectively, corresponding views of the spinneret face where the molten filament streams emerge, for the capillary arrangements shown in FIGS. 4A, 5A and 6A. The exit orifices of the spinneret capillaries are arranged as arc-shaped slots (as shown in FIGS. 4B, 5B and 6B) of slot width "W", separated by gaps (tabs) of width "F", to provide an outer diameter (OD) and an inner diameter (ID) and a ratio of (orifice) extrusion void area (EVA) to the total extrusion area (EA) of $[ID/OD]^2$; where the (orifice) EVA is defined by (3.14/4) $[ID]^2$; the arc-shaped slots of FIG. 5B have enlarged ends (called toes) enlarged to a width (G) shown with radius (R). The orifice capillaries are shown with a height or depth (H) in FIGS. 4A, 5A and 6A. Polymer may be fed into the orifice capillaries by tapered counterbores, of depth B, as shown in FIGS. 4B and 5B, where the total counterbore entrance angle (S+T) is comprised of S, the inbound entrance angle, and T, the outbound entrance angle, with regard to centerline ($C_L$). In FIG. 4A, S>T. Further details of such spinnerets are given in U.S. Pat. No. 5,330,348 (DP-6005), filed by Aneja et al Nov. 9, 1992, the disclosure of which is hereby incorporated herein by reference. In FIG. 5A, S=T, which is more conventional. Polymer may, however, be fed by use of straight wall reservoirs (FIG. 6A) having a short angled section (B) at the bottom of the reservoir from which polymer flows from the reservoir into the orifice capillary of height or depth (H). An orifice capillary such as shown in FIG. 6A should desirably have a capillary depth (herein also referred to as a height or as a length, H) typically at least about 2X (preferably 2 to 6X) that of orifice capillaries as shown in FIGS. 4A and 5A (i.e., at least about 8 mils (0.2 mm) and preferably at least about 10 mils (0.25 mm) so as to provide a depth (H) to slot width (W) ratio of about 2 to about 12; whereas conventional depth/width ratios, (H/W), are generally less than about 2. This greater depth/width (H/W)-ratio provides for improved uniform metering of the polymer and increased die-swell for higher void content. To provide sufficient pressure drop, as required for flow uniformity, all of the capillaries used in the Examples herein incorporated a metering capillary (positioned further above and not shown in FIGS. 4–6, but discussed in the art and hereinafter). As the orifice capillary depth (H) is increased, however, the need for an "extra" metering capillary becomes less important as well as the criticality of the values and symmetry (or lack of symmetry) of the entrance angles of the spinnerets using tapered counterbores (FIGS. 4A and 5A).

FIG. 12 also plots fiber (fabric) volume (on the right vertical axis) versus void content ($d_i$/D) where lines a', b', and c' correspond to the families of filaments of FIGS. 11A, 11B, and 11C, respectively. In this case, line c' is horizontal, as the outer diameter of FIG. 11C remains constant.

DETAILED DESCRIPTION OF THE INVENTION

The polyester polymer used for preparing the spin-oriented hollow fine filaments and yarns of the invention is the same as that described in detail hereinbefore for the "parent application".

Figure 3A:
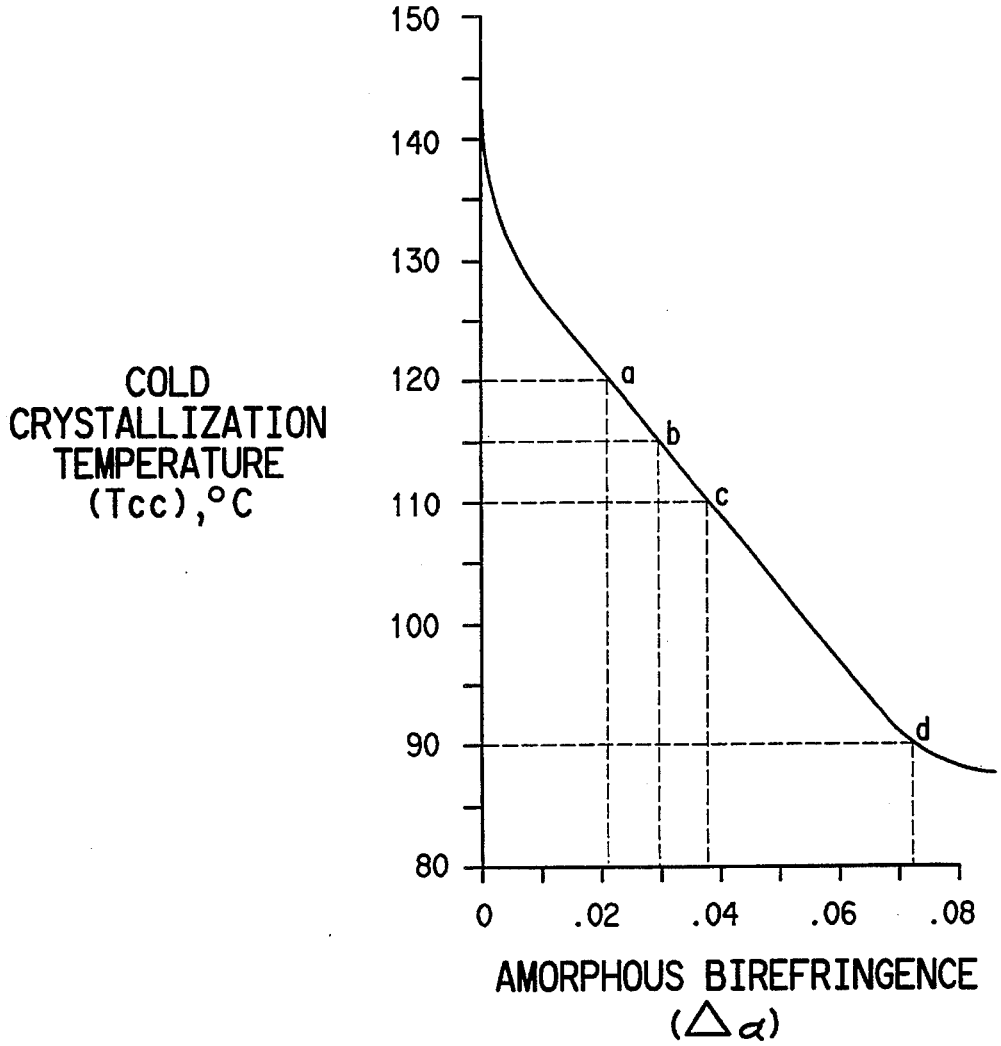
FIG. 3A is a representative plot of $T_{cc}$ (the peak temperature of "cold crystallization", as measured by Differential Scanning Calorimetry (DSC) at a heating rate of 20 C. per minute), versus amorphous birefringence, a measure of amorphous orientation (as expressed by Frankfort and Knox). For filaments for which measurement of birefringence is difficult, the value of $T_{cc}$ is a useful measure of the amorphous orientation. The filaments of the invention typically have $T_{cc}$ values in the range of 90 C. to 110 C.
Figure 3B:
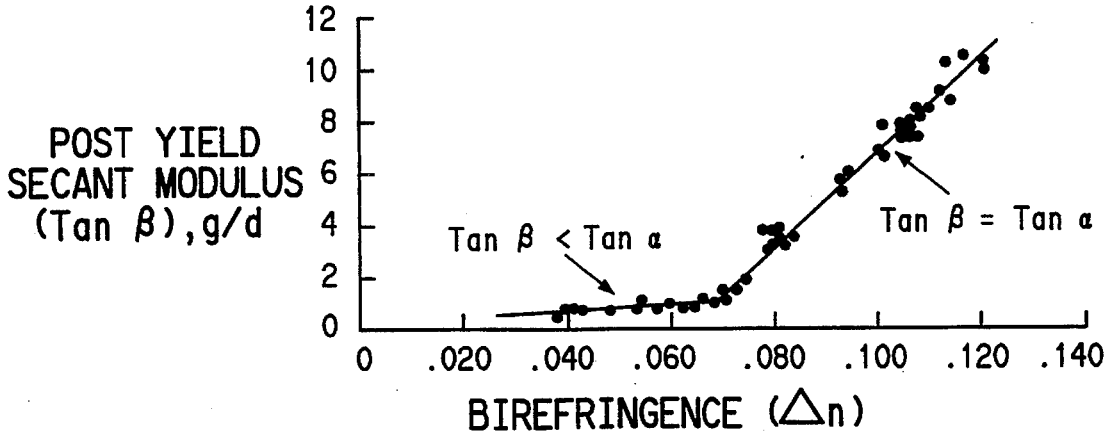
FIG. 3B is a representative plot of the post-yield secant modulus, Tan beta (i.e., "$M_{py}$"), versus birefringence. The $M_{py}$ herein is calculated from the expression $(1.20T_{20}-1.07T_7)/0.13$, where $T_{20}$ is the tenacity at 20% elongation and $T_7$ is the tenacity at 7% elongation. As may be seen, above about 2 g/d, the post-yield modulus ($M_{py}$) provides a useful measure of birefringence of spin-oriented, drawn, and textured filaments.

The undrawn hollow fine filaments of the invention are formed by post-coalescence of polyester polymer melt streams, such as taught by British Patent Nos. 838,141 and 1,106,263, by extruding polyester polymer melt at a temperature ($T_P$) that is about 25 to about 55 C. (preferably about 30 to about 50 C.) greater than the zero-shear melting point ($T_M$°) of the polyester polymer, first through metering capillaries of diameter (D) and length (L), as described, e.g., in Cobb U.S. Pat. No. 3,095,607 (with dimensions D and L being modified, if desired, by use of an insert as described, e.g., by Hawkins U.S. Pat. No. 3,859,031) and which are similar to those used in Example 6 of Knox U.S. Pat. No. 4,156,071; and then through a plurality of segmented arc-shaped orifices, as illustrated, for example, in FIG. 1 of Hodge U.S. Pat. No. 3,924,988, in FIG. 3 of Most U.S. Pat. No. 4,444,710, and in FIG. 1 of Champaneria, et al U.S. Pat. No. 3,745,061, and further illustrated herein in FIGS. 4B, 5B, and 6B.

Figure 5A:
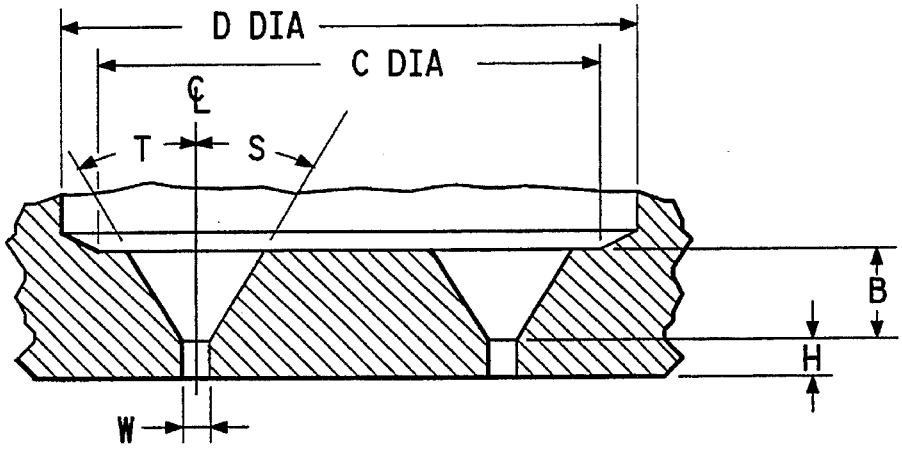
Figure 6A:
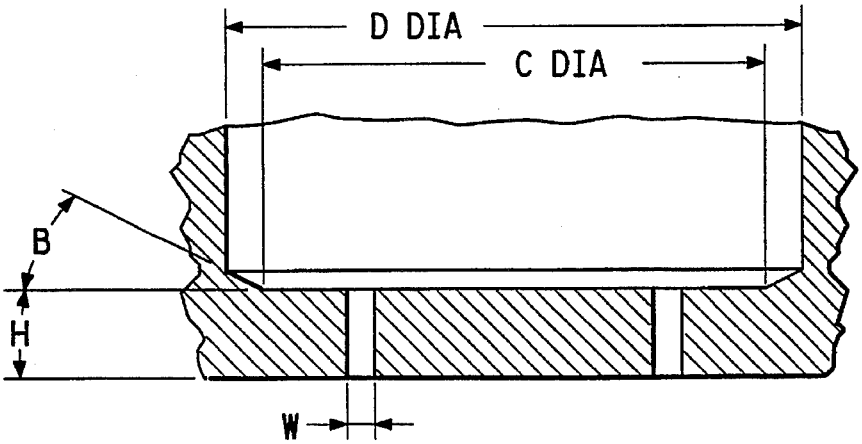

When using short orifice capillaries (as shown, e.g., in FIGS. 4A and 5A), the use and configuration of a tapered entrance counterbore is preferred for obtaining large void content and complete coalescence. Preferred such counterbores, used herein, are generally characterized by a total entrance angle (taken herein as the sum of the inbound entrance angle S and the outbound entrance angle T) about 30 to about 60 degrees (preferably about 40 to about 55 degrees); wherein the inbound entrance angle S is at least about 15 degrees, and preferably at least 20 degrees, and the outbound entrance angle T is at least about 5 degrees, preferably, at least about 10 degrees; such that the (S/T)-ratio is in the range of about 1 to about 5.5 (preferably in the range of about 1.5 to about 3) when extruding at low mass flow rates (i.e., low dpf filaments) from orifice capillaries with slot depth/width ratios (H/W)-ratios less than about 2. It will be understood that these preferences, expressed generally, do not guarantee obtaining optimum filaments, or even complete coalescence, for example, but other considerations will also be important. When using deep orifice capillaries (e.g., as shown in FIG. 6A), then the configuration of the counterbore is less critical and a simpler reservoir type may be used (FIG. 6A). Also for micro denier hollow filaments a segmented capillary composed of 2 arcs is preferred (FIG. 6B).

Figure 4A:
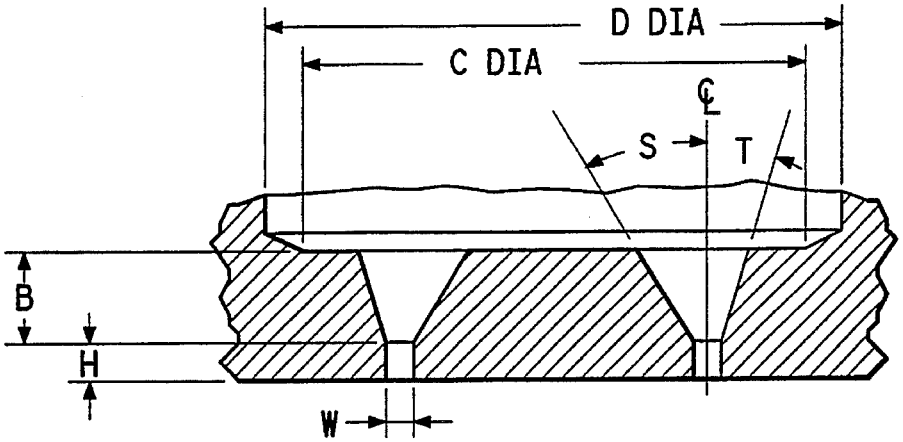
FIGS. 4A and 4B, 5A and 5B, 6A and 6B show schematically representative spinneret capillary arrangements for spinning peripherally round filaments having a single concentric longitudinal void (different capillary spinnerets would be required if more than one longitudinal void or if filaments of non-round cross-sections were desired).
Figure 4B:
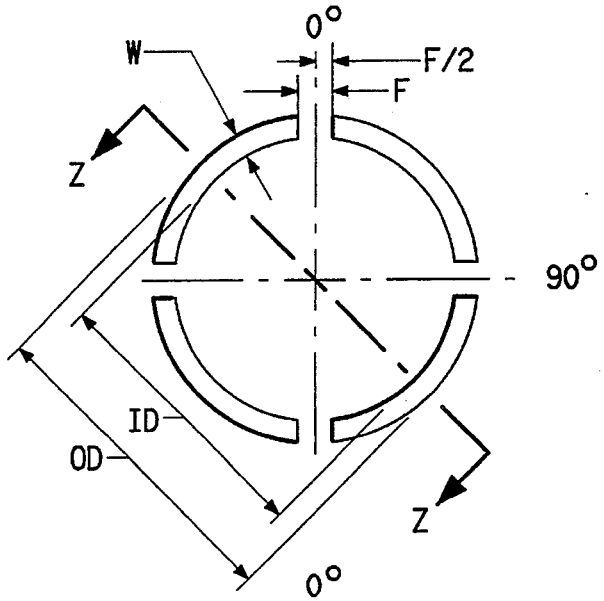
Figure 5B:
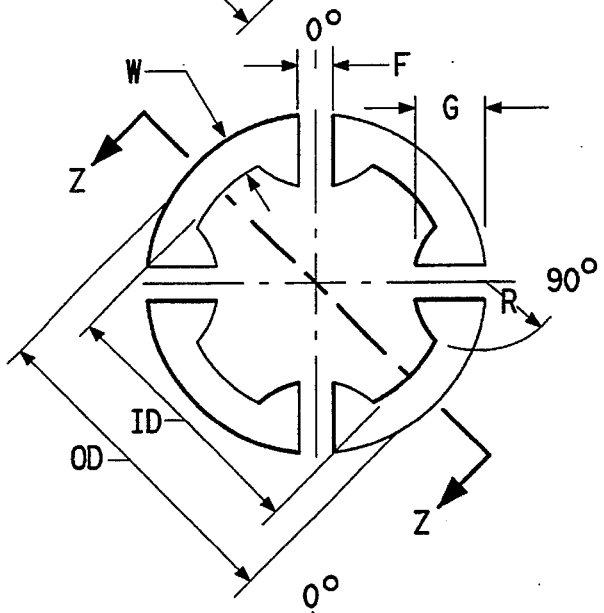
Figure 6B:
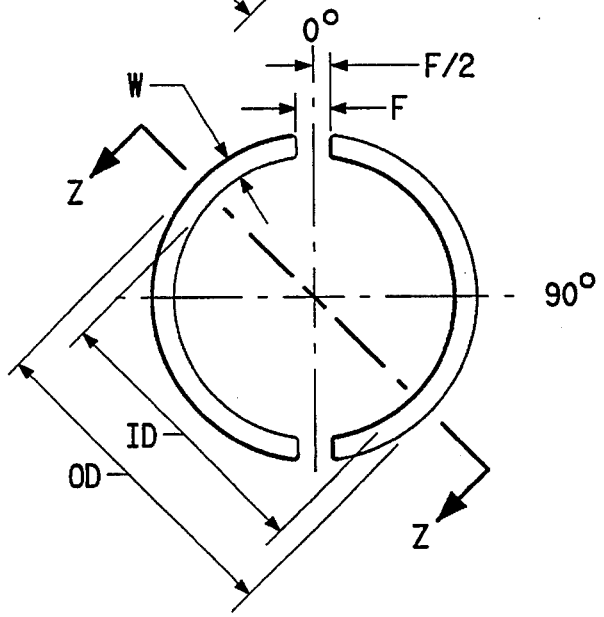

For the present invention, the arc-shaped orifice segments (as depicted in FIGS. 4B, 5B and 6B) are arranged so as to provide a ratio of the extrusion void area EVA to the total extrusion area EA, (EVA/EA), of about 0.4 to about 0.8, and an extrusion void area (EVA), of about 0.025 $mm^2$ to about 0.45 $mm^2$. These calculations, for simplification, ignore the areas contributed by small solid "gaps", called "tabs", between the ends of the capillary arc-orifices. Frequently, the arc-shaped orifices may have enlarged ends (referred to as "toes"), as illustrated in FIG. 4B, to compensate for polymer flow not provided by the tabs between the orifice segments. This is especially important under conditions wherein insufficient extrudate bulge is developed for complete and uniform post-coalescence. It is found that extruding from arc-shaped orifices without "toes", as illustrated in FIG. 4B, and reducing the extrusion void area (EVA) to values in the range of about 0.025 to about 0.25 $mm^2$ with a EVA/EA ratio of about 0.5 to 0.7 is preferred to form uniform fine denier hollow filaments. If there is insufficient extrudate bulge at these low polymer flow rates, then it preferred to enhance and direct the extrudate bulge by using asymmetric orifice counterbores (see FIG. 4A); as discussed hereinabove, alternatively deep orifice capillaries may be used, for example as illustrated in FIG. 6A, to achieve the desired void content and complete self-coalescence without the need for asymmetric counterbores (FIG. 4A).

After formation of the arc-shaped melt streams using sufficiently carefully selected spinnerets, as described hereinabove, the freshly-extruded melt streams post-coalesce to form hollow filaments, wherein the void is essentially continuous, and desirably symmetric, in general, along the length of the filament. It is preferred to protect the extruded melt during and immediately after post-coalescence from stray air currents. This may be accomplished by use of cross-flow quench fitted with a delay tube, for example, as described by Makansi in U.S. Pat. No. 4,529,368, and preferably by use of radial quench fitted with a delay tube, for example, as described by Dauchert in U.S. Pat. No. 3,067,458 wherein the delay tube is of short lengths, typically between about 2 to about 10 cm as used (to spin different filaments) in Examples 1, 2 and 11 of Knox U.S. Pat. No. 4,156,071 and in our parent application, now U.S. Pat. No. 5,250,245. The length of the delay tube is preferably between about 2 to about $12(dpf)^{1/2}$ cm. Radial quench is preferred versus cross-flow quench for it typically provides for greater void retention during attenuation and quenching. It is also observed that increasing the extrudate viscosity by use of lower polymer temperatures ($T_P$) and/or reduced delay quench, provides for increased percent void content; too high an extrudate melt viscosity for a given degree and rate of attenuation, however, can lead to incomplete post-coalescence (called "opens"—see FIG. 1A) and filament breaks; as noted, however, some open filaments are referred to as "C-shapes" and give useful products for some applications.

The freshly coalesced uniform hollow filaments are uniformly quenched to below the polymer glass-transition temperature (Tg) while attenuating to about the final withdrawal spin speed, and then converged into a multi-filament bundle at a distance ($L_c$) typically between about 50 and 150 cm (preferably between about 50 and $[50+90(dpf)^{1/2}]$ cm) from the point of extrusion. The convergence of the fully quenched filament bundles is preferably by metered finish tip applicators as described by Agers in U.S. Pat. No. 4,926,661. The length of the convergence zone ($L_c$), length of quench delay ($L_D$) and air flow velocity ($V_a$) are selected to provide for uniform filaments characterized by along-end denier variation [herein referred to as Denier Spread, DS] of less than about 4% (preferably less than about 3%, and especially less than 2%); and to provide filaments of good mechanical quality as indicated by values of $(T_B)_n$, normalized to 20.8 polymer LRV, at least about 5 g/d and preferably at least about 6 g/d. The length of the convergence zone ($L_c$) may also be varied, within reason to help obtain an acceptable denier spread; but at sufficiently high spin speeds it is known that shortening the convergence zone also moderately increases the spinning stress and thereby decreasing the spun yarn elongation, and shrinkage as disclosed in the German Patent No. 2,814,104 for spinning of solid filaments. This approach may be taken herein as a secondary way to vary slightly the spun filament tensile and shrinkage properties for a given spin speed and dpf and to increase the void content (VC). Also, incorporating filaments of different deniers and/or cross-sections may also be used to reduce filament-to-filament packing and thereby improve tactile aesthetics and comfort. In this regard, a mixture of hollow filaments and C-shapes (i.e. open filaments of cross-section resembling a "C", rather than completely coalesced hollow filaments with a cross-section like an "O") have given particularly interesting results and down-stream aesthetics.

The converged filament bundles are then withdrawn at spin speeds ($V_s$) between about 2 to 5 km/min (preferably between about 2.5 and 4.5 km/min), interlaced, and wound into packages. Finish type and level and extent of filament interlace is selected based on the end-use processing needs. Advantageously, if desired, yarns may be prepared according to the invention from undrawn feed yarns that have been treated with caustic in the spin finish (as taught by Grindstaff and Reese U.S. Pat. Nos. 5,069,844–6) to enhance their hydrophilicity and provide improved moisture-wicking and comfort. Filament interlace in preferably provided by use of air jet, as described in Bunting and Nelson U.S. Pat. No. 2,985,995, and in Gray U.S. Pat. No. 3,563,021, wherein the degree of interfilament entanglement (often referred to as rapid pincount RPC) is as measured according to Hitt in U.S. Pat. No. 3,290,932.

We have observed that void content (VC) increases with spinning speed and as-spun filament denier $(dpf)_s$. To spin finer denier filaments without loss in void content (VC), the spinning speed ($V_S$) may be increased. In addition to spinning speed ($V_S$) and filament denier $(dpf)_s$, the filament void content (VC) is found to increase with polymer melt viscosity [herein for polyester found to be approximately proportional to product of the polymer relative viscosity (LRV) and the ratio of the zero-shear polymer melting point ($T_M°$) and the extrusion polymer temperature ($T_P$) taken to the 6th power; e.g., proportional to $[LRV(T_M°/T_P)^6]$. Further, the percent void content (VC) is also observed to increase approximately linearly with the square root of the extrusion void area EVA; that is, increasing linearly with the inner diameter (ID) for orifices having a EVA/EA-ratio $[=(ID/OD)^2]$ about 0.6 to about 0.9 (preferably about 0.4 to about 0.8).

From the above discussion, the preferred process for providing undrawn hollow filaments having void contents (VC) of at least about 10% may be expressed by a phenomenological process expression: $VC, \%=K_p Log_{10}\{(k [LRV(T_M°/T_P)^6][(dpf)_s (V_S)^2)][(EVA)^{1/2}])^n\}$ where the expression in brackets { } is taken, herein, to be a representative measure of the "apparent work of extension" $(W_{ext})_a$ that the hollow filament undergoes during attenuation; where "$K_p$" is the slope of the semi-log plot of VC(%) versus $(W_{ext})_a$ and the value of $K_p$ is taken herein to be a measure of the inherent "viscoelastic" nature for a given polymer that determines, in part, the extent of die-swell; and the value of the exponent "n" is dependent of the "geometry" of the orifice exit capillary (i.e., on the values of S/T and H/W); and for simplicity the value of "n" is herein given by the expression [(S/T)(H/W)]. In the case of the orifice capillary of large values of (H/W) as depicted in FIG. 6A, it is expected that the value of "n" will not be linear with (H/W); but will level off (i e , $(H/W)^m$, where m is less than 1, as equilibrium flow is established with respect to (H/W) and die-swell becomes independent of (H/W). When using a reservoir as depicted in FIG. 6A, the value of (S/T) is defined as "1". A reference state is defined, herein, for orifice capillaries having symmetric entrance angles (S=T) and slot depth (H) is equal to slot width (W) giving a value of (H/W) of 1 and thereby giving a value of n of 1. The constant "k" is a proportionality constant of value $10^{-7}$ (as defined by the units selected for $V_S$ and EVA) and $(W_{ext})_a$ has a value of 10 for the reference state; and thereby the void content at the reference state is defined by: $VC (\%)=K_p Log\{10^1\}=K_p$; wherein the value of the value of $K_p$ is arbitrarily selected to have a numerical value of "10" for 2GT homopolymer so that at process conditions that provide a $W(_{ext})_a$ value of 10, the filament void content (VC) is 10%. The above phenomenological approach permits the void content (VC) to be directly related to the process parameters, through the values $(W_{ext})a$, to the geometry of the extrusion orifice (through the value of "n") and to the selected polymer (through the value of $K_p$). In the expression for $(W_{ext})_a$, the spin speed $(V_S)$ is expressed in meters per minute and orifice capillary EVA is expressed in $mm^2$.

The above expression suggests that void content (VC) may be increased by increasing the "apparent extensional work" (i.e., by increasing spin speed, $(V_S)$, extrusion void area EVA, polymer LRV, filament denier $(dpf)_s$, and decreasing polymer temperature $T_P$) and provides a process rationale for forming fine filaments of high void content. To counter the reduction in void content with reduced filament denier $(dpf)_s$, the spin speed $(V_S)$, capillary extrusion void area (EVA), and polymer relative viscosity (LRV) may be increased and the polymer temperature $(T_P)$ may be decreased. In practice, it is found that increasing the extrusion void area (EVA) to counter the lower void content from spinning lower $(dpf)_s$ may yield unacceptably high values of melt extension $[(EVA/(dpf)_s]$ and poor spinning continuity. It is preferred to maintain the ratio $[EVA/(dpf)_s]$ between about 0.05 to about 0.55 for good spinning performance and obtain the desired void content by increasing spin speed, for example.

The spin-orientation process of the invention provides a capability to make hollow filament textile yarns of filament denier less than about 1, preferably about 0.8 to about 0.2. Filaments of different deniers and/or cross-sections may also be used to reduce filament-to-filament packing and thereby improve tactile aesthetics and comfort (such as, mixing hollow filaments of different cross-sectional shape and/or denier; and mixing hollow filaments with solid filaments of different denier and/or cross-sectional shape; or spinning and mixing hollow filaments with filaments of other cross-sections, as shown in Examples 15 to 17 herein). Filament percent void content (VC) is desirably at least about 10% for the hollow filaments, preferably at least about 15%. For the undrawn filaments, the maximum shrinkage tension $(ST_{max})$ should be less than about 0.2 g/d occurring at a shrinkage tension peak temperature $T(ST_{max})$ between about (Tg+5 C.) and (Tg+30 C.); e.g., about 75 C. to 100 C. for 2GT homopolymer; the $(1-S/S_m)$ value should be at least about 0.1 and preferably at least about 0.25 to provide age stability for the yarns used as draw feed yarns with an elongation-to-break $(E_B)$ in the range of about 40% to about 160% and a tenacity-at-7% elongation $(T_7)$ between about 0.5 and about 1.75 g/d, preferably an elongation-to-break $(E_B)$ in the range of about 90% to 120% and a tenacity-at-7% elongation $(T_7)$ between about 0.5 and about 1 g/d (i.e., wherein $T_{20}$, tenacity-at 20% elongation, is at least as high as $T_7$ for improved drawing stability); for yarns especially suitable as direct-use textile yarns the elongation-to-break $(E_B)$ should be, in the range of about 40% to about 90%, tenacity-at-7% elongation $(T_7)$ between about 1 and about 1.75 g/d, and a $(1-S/S_m)$-value of at least about 0.85 and more especially characterized by a thermal stability ($S_2$=DHS-S) less than about +2%; and all filaments of the invention are of good mechanical quality, preferably as characterized by values for tenacity at break $(T_B)_n$, normalized to 20.8 polymer LRV, of at least about 5 g/d and more preferably at least about 6 g/d, although Example 16 indicates preparation of filaments having $T_B$ values as low as 3.67, which indicates that, for some end-uses, $T_B$ values of as low as about 3.5 may prove advantageous.

The undrawn hollow filaments of the invention may be drawn in coupled spin/draw processes, such as described by Chantry and Molini in U.S. Pat. No. 3,216,187, or in split spin/draw processes, including single end as well as multi-end processes, e.g., warp-draw processes as described generally by Seaborn in U.S. Pat. No. 4,407,767, and, more specifically for undrawn low shrinkage homopolymer polyester yarns, by Knox and Noe in U.S. Pat. No. 5,066,447, and for copolymer polyester undrawn feed yarns as described by Charles et al in U.S. Pat. Nos. 4,929,698 and 4,933,427. The drawing process may be part of a texturing process, such as draw air-jet texturing, draw false-twist texturing, draw stuffer-box crimping, and draw gear crimping for example. However, the textured hollow filaments of the invention, depending on the type of bulky process selected (e.g., draw false-texturing) may have a unique "corrugated" cross-sectional shape as a result of partially (and fully) collapsed voids and thereby provide an irregular filament cross-section similar to that of cotton. Textured filaments of "collapsed-hollow" cross-section and of denier about 1.5 or less are especially suitable for replacement of cotton staple yarns. Drawn flat and textured yarns of the invention are generally characterized by residual elongation-to-break $(E_B)$ about 15% to about 40%, boil-off shrinkage (S), such that the $(1-S/S_m)$ value is at least about 0.85, tenacity-at-7% elongation $(T_7)$ at least about 1 g/d, and preferably a post-yield modulus $(M_{py})$ about 5 to about 25 g/d. Drawing (including selection of draw temperatures and post draw heat set temperatures) to provide a combination of shrinkage (S) shrinkage tensions $(ST_{max})$, such that shrinkage power, $P_s[=S\times ST_{max}$, (g/d)%] is greater than about 1.5 (g/d)%, are especially preferred to provide sufficient shrinkage power to overcome filament-to-filament restraints within high end-density fabrics, such as medical barrier fabrics.

An important characteristic of the invention is that the undrawn hollow filaments may be drawn to reduce their denier without a significant reduction in the percent void content (VC) during the drawing process; that is, the drawn filaments have essentially the same percent void content (VC) as that of the undrawn hollow feed filaments prior to drawing. Using carefully selected drawing conditions, the percent void content (VC) of the hollow undrawn filaments of the invention may even be increased during the drawing process. Any change in percent void content (VC) observed on drawing undrawn hollow filaments of the invention may be described by the ratio of the percent void content of the drawn filaments $(VC)_D$ to that of the undrawn filaments $(VC)_{UD}$. Drawn hollow filaments of this invention generally have a $(VC)_D/(VC)_{UD}$-ratio of at least about 0.9 and preferred drawn hollow filaments of the invention have a (VC)D/(VC)UD-ratio of at least about 1, which has not heretofore been disclosed in the prior art of drawing of undrawn hollow filaments. Especially preferred undrawn filaments may be drawn without loss in void content over a wide range of drawing conditions, including being capable of being uniformly partially drawn by cold or by hot drawing, with or without post heat treatment, to elongations $(E_B)$ greater than 30% without along-end "thick-thin" denier variations as described in U.S. Pat. No. 5,066,447 for undrawn filaments of low shrinkage; and such especially preferred undrawn filaments are also suitable for use without drawing as flat direct-use textile filaments and may be air-jet textured without drawing or post heat treatment to provide bulky textured yarns of low shrinkage.

It is believed that the unique retention of the void content (VC) of the undrawn hollow filaments of the invention on drawing to finer filament deniers, is related, in part, to the development of stress-induced orientation (SIO) of the amorphous regions during melt spinning and the resultant stress-induced crystallization (SIC) of these oriented amorphous regions. For polyester, the onset temperature of cold crystallization ($T_{cc}$) of the amorphous regions is typically about 135 C. for amorphous unoriented filaments and is decreased to less than 100 C. with increased stress-induced orientation (SIO) of the amorphous polymer chains. This is graphically illustrated in FIG. 3A by a plot of $T_{cc}$ versus the amorphous birefringence. For the preferred undrawn spin-oriented filaments with elongations ($E_B$) in the range of 40% to about 120%, the measured $T_{cc}$-values for polyester are in the range of about 90 C. to about 110 C. which is believed to permit the onset of further crystallization even under mild drawing conditions and is believed, in part, to be important to the retention of void content (VC) of undrawn hollow polyester filaments of the invention on drawing, even when drawn cold (i.e., wherein the exothermic heat of drawing is the only source of heating.

The degree of stress-induced crystallization (SIC) is also believed, herein, to be important in the drawing behavior of the hollow filaments of the invention and is conventionally defined by the density of the polymeric material forming the "walls" of the hollow fiber. Determination of the "wall" density is, however, experimentally difficult; and hence, an indirect measure of stress-induced crystallization (SIC) is used herein based on the extent of boil-off shrinkage (S) for a given yarn elongation-to-break ($E_B$). For a given fiber polymer crystallinity (i.e., "wall" density), the boil-off shrinkage (S) is expected to increase with molecular extension (i.e., with decreasing elongation-to-break, $E_B$); and therefore a relative degree of stress-induced crystallization (SIC) is defined, herein, by the expression: $(1-S/S_m)$, where $S_m$ is the expected maximum shrinkage for filaments of a given degree of molecular extension ($E_B$) in the absence of crystallinity; and $S_m$ is defined herein by the expression:

$$S_m\ (\%)=([(E_B)_{max}-E_B)]/[(E_B)_{max}+100])100\%,$$

wherein $(E_B)_{max}$ is the expected maximum elongation-to-break ($E_B$) of totally amorphous "isotropic" filaments. For polyester filaments spun from polymer of typical textile intrinsic viscosities in the range of about 0.56 to about 0.68 (corresponding LRV about 16 to about 23), the nominal value of $(E_B)_{max}$ is experimentally found to be about 550% providing for a maximum residual draw ratio of 6.5 (Reference: High-Speed Fiber Spinning, ed. A. Ziabicki and H. Kawai, Wiley-Interscience (1985),page 409) and thus, $S_m$ (%) may in turn be defined, herein, by the simplified expression: $S_m,\%=[(550-E_B)/650]\times100\%$ (refer to discussion of FIGS. 3A and B for additional details).

Mixed shrinkage hollow filament yarns may be provided by combining filament bundles of different shrinkages (S). At a given spin speed, shrinkage (S) decreases with decreasing dpf and increasing extrusion void area (e.g., increasing with increasing value of the ratio of the EVA and the spun dpf). Denier per filament is determined by capillary mass flow rates, $w=(V_s\times dpf)/9000$ (where $V_s$ is expressed in terms meters/minute and w in terms of grams/minute), through the spinneret capillary which are proportional to the capillary pressure drops (generally taken, for solid round filaments and orifices, as being approximately proportional to $(L/D)^n/D^3$ and becomes $L/D^4$ for n of value 1 for Newtonian-like fluids, and L is capillary length and D is capillary diameter (note the "n" used herein for $(L/D)^n$ is not the same "n" used in the expression for $(W_{ext})_a$ described hereinbefore). For non round cross-sections, the value of $(L/D)^n/D^3$ is taken from that of the metering capillary that feeds the polymer into the shape determining exit orifice for orifice capillaries of low pressure drop compared to that of the metering plates. If this is not the case, then an apparent value of $(L/D^4)_a$ for the combination of exit orifice plate, exit orifice capillary, counterbore and metering capillary (if used) is experimentally determined by co-extruding the capillaries forming the hollow filaments (h) with conventional round capillaries (r), such that $(L/D^4)_a=\{[(dpf)r/(dpf)h]\times(L/D^4)r\}$. Spinning hollow filaments from complex capillaries (i.e., comprised of a shape forming plate, orifice capillary, counterbore, and metering capillary) of differing $(L/D^4)_a$-values provides a simple route to mixed-denier hollow filament yarns. For example, if the different filaments (denoted as 1 and 2) are co-spun from the same spin pack of a single polymer metering source, then the capillary flow rates (w) will be approximately inversely proportional to $(L/D)^n/D^3$ of the different capillaries; e.g., $(dpf)_1\times[(L/D)^n/D^3]1-(dpf)_2\times[(L/D)^n/D^3]_2$; and therefore the $[(dpf)^2/(dpf)_1]$-ratio$=\{[(L/D)^n/D^3]_1/[(L/D)^n/D^3]_2\}_a=[(L/D^4)_1/(L/D^4)_2]_a$. A spinneret with metering capillaries of 15×72 mils and 8×32 mils, for example will provide filaments of mixed dpf in the ratio of 476.7 $mm^3$/86.5 $mm^2$= 5.5 for a value of 1 for the exponent n (experimentally the value of "n" for 2GT homopolymer is about 1.1 for the polymer LRV and process conditions used herein; but initially a value of 1 is used for "n" and the ratio of the capillaries $(L/D^4)$-values is used initially in making the mixed capillary spinnerets and then based on the experimentally measured dpf-values under the desired selection of process conditions, the value of "n" is calculated and the proper selection of the various L and D values are made to provide the goal dpf-ratio). For spinning filaments of different cross-section, but of the same dpf, it may be required that the metering capillaries be of slightly different dimensions (i.e., of different $[(L/D)^n/D^3]$-values so to overcome any small, but meaningful, differences in the pressure drop of the shape forming exit orifices. If spinning the different filament components from separate spin packs and combining them into a single mixed-filament bundle, for example; then the dpf of the filaments from a given spin pack is simply determined by the relation: dpf= 9000 $w/(V_s\#_F)$, where w is the total spin pack mass flow rate and $\#_F$ is the number (#) of filaments (F) per spin pack.

Mixed-shrinkage yarns having the same dpf may be prepared by metering through segmented orifices of different extrusion void areas (EVA). The dpf of the filaments are nominally the same when spinning with mixed extrusion void area (EVA)-spinnerets wherein the total pressure drop of the metering plate and extrusion orifice plate assembly is essentially determined by the significantly higher pressure drop of the common metering capillaries (L×D). In such cases, the absolute shrinkages may be decreased while maintaining a shrinkage difference of at least 5% by decreasing the filament denier or by increasing spin speed. Hence, by selecting capillary extrusion area and dimensions of the metering capillaries, it is possible to cospin mixed-shrinkage hollow filaments of mixed-denier, or of the same denier for use as textile filament yarns or as draw feed yarns. To vary the filament-to-filament packing density, filaments of different denier and/or cross-sectional shapes may be used. The hollow filaments of the invention may also be combined with filaments without voids of different denier and/or cross-sectional shape as an alternative route to altering filament-to-filament packing density.

Figure 15:
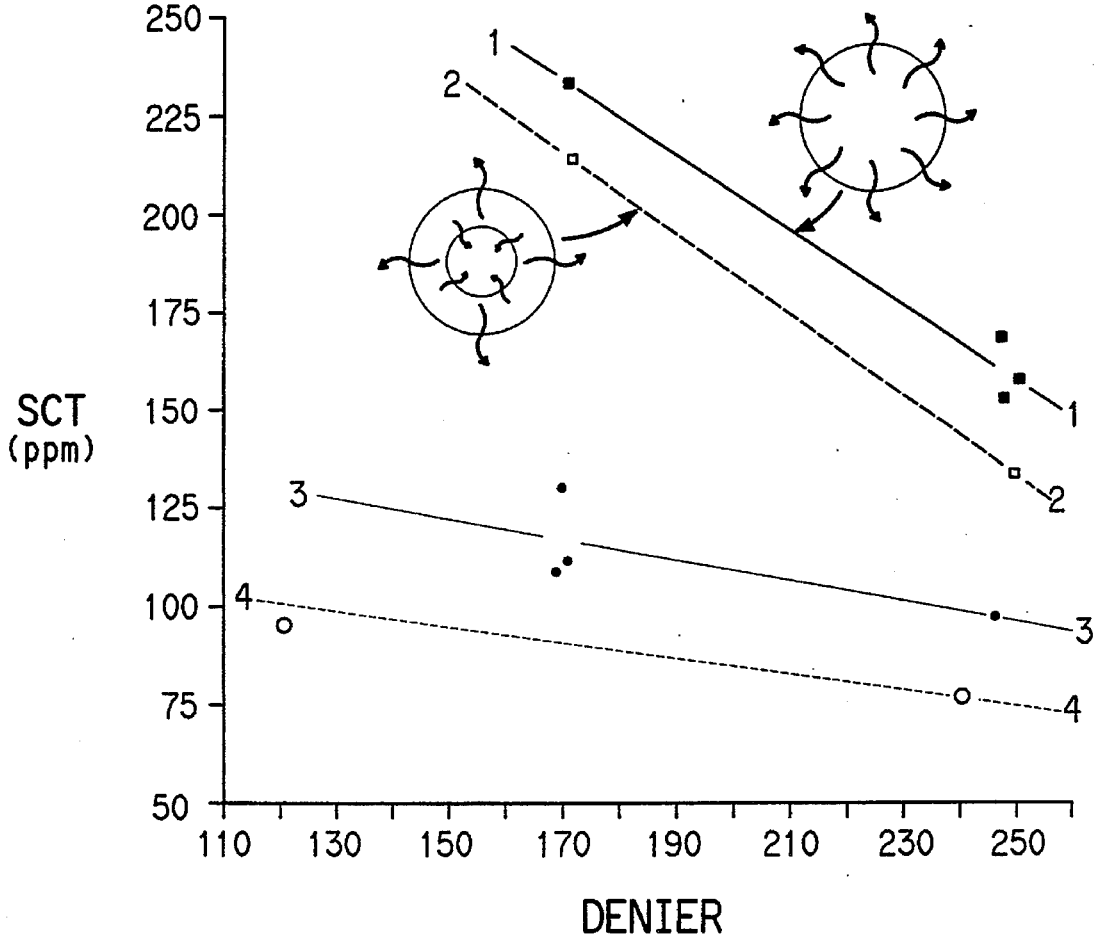
FIG. 15 shows 4 lines plotting amounts of surface cyclic trimer (SCT) measured in parts per million (ppm) versus denier of 50-filament yarns (of higher dpf) spun as follows: Lines 1 and 2 were spun at 2500 ypm (2286 mpm) without voids and with voids, respectively; Lines 3 and 4 were spun at 3500 ypm (3200 mpm) without voids and with voids respectively. The SCT is observed to decrease with increasing denier per filament and to decrease with increasing spin speed (i.e., extent of SIC). The insert schematics illustrate possible diffusion paths for the SCT and thereby the observed lower SCT for the hollow filaments of the invention. Preferred hollow filaments have SCT-levels of less than about 100 ppm.

The invention lends itself to many variations, and advantages which are described briefly:

1. Reduced surface cyclic trimer (SCT) on the fiber, which reduces or even may eliminate oligomer deposits on the fabric during the cool down cycle of dyeing; SCT-values of less than 100 ppm are especially useful (as discussed with reference to FIG. 15).

2. Use in a mixed fine filament yarn (e.g., being comprised of a fine filament component of solid filaments of denier about 0.25 to about 0.75) to provide "stiffness" to the yarn of fine filaments for enhanced fabric "body" and "drape" (as disclosed in co-pending applications DP-4555-I, filed simultaneously herewith, and DP-4555-J, Application No. 08/093,156, filed Jul. 23, 1993).

3. Combining high speed spun low shrinkage cationic dyeable polyester hollow filaments of the invention (e.g., such filaments having shrinkages less than about 10–12%) with acid-dyeable nylon filaments of comparable elongations to provide atmospheric carrier-free dyeable mixed-filament yarns with the polyester and nylon filaments capable of being dyed to different colors; and wherein the mixed-filament polyester/nylon yarns may be uniformly cold drawn for increased tensiles without losing dyeability; and also co-air-jet texturing, with or without drawing the low shrinkage polyester hollow filaments of the invention and the companion nylon filaments, to provide a bulky mixed-dyeable filament yarn.

4. High speed spinning of low LRV cationic-modified 2GT for uses where lower tensiles are preferred (e.g., for shearing, brushing, and napping), for improved pill-resistance vs. homopolymer of standard textile LRV values of about 21.

5. Selection of capillary dimensions, array, and polymer temperature/quench rates to produce filaments having the cross-section as represented by that of the "opens" in FIG. 1A—i.e., similar to that of natural cotton.

6. Filaments characterized by $(1-S/S_m)>0.85$ and $T_7>1$ g/d and $E_B$ between about 40% to 90% may be uniformly co-drawn with nylon filaments (hollow or solid) wherein no loss in void content of either the polyester or nylon hollow filaments is observed.

7. Filaments characterized by high void content (>20%) and of low bending modulus ($M_B$) such as to favor the formation of collapsed filament cross-sections, similar to that of "mercerized" cotton, during processes such as air-jet texturing, stuffer box crimping, and calendaring of the fabric during dyeing/finishing operations.

Figure 12:
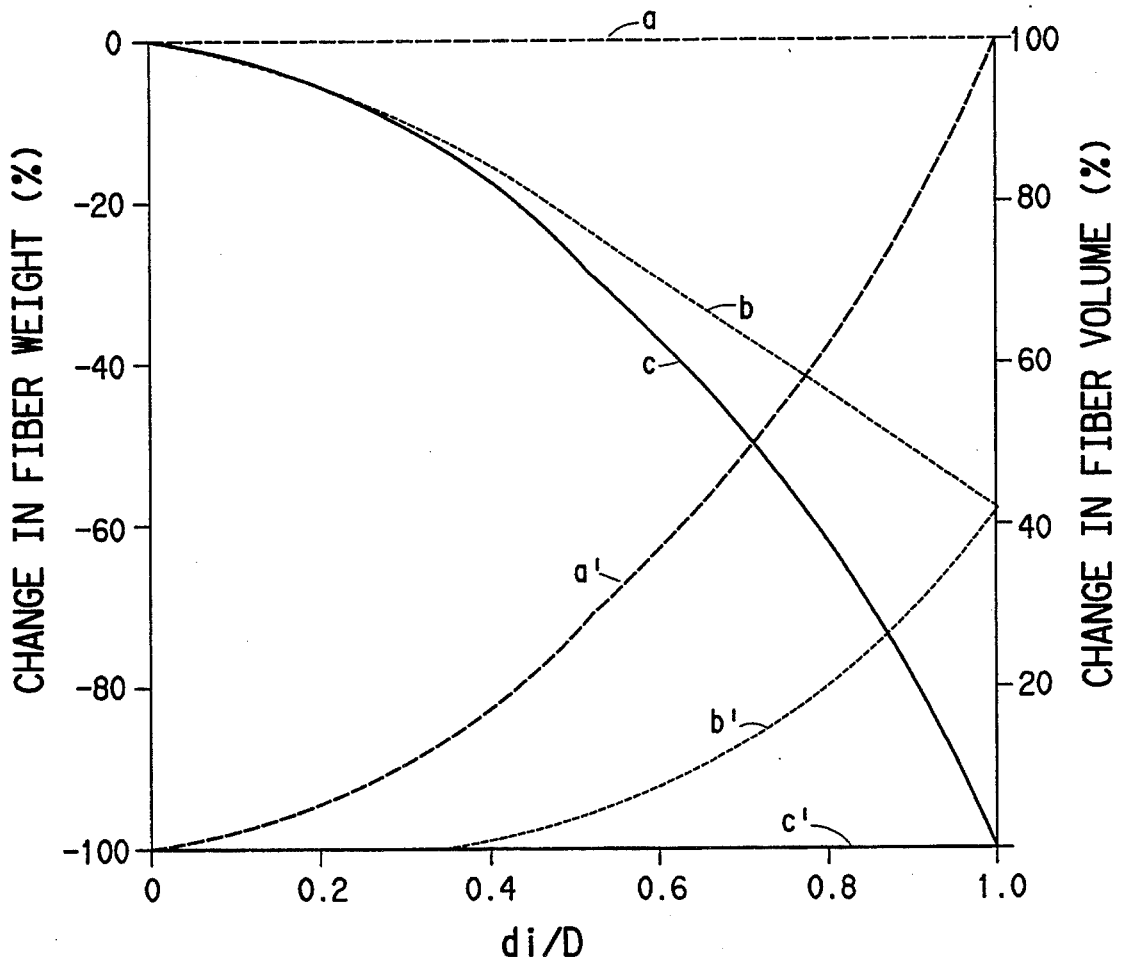
FIG. 12 plots change (decrease) in fiber (fabric) weight (on the left vertical axis) versus increasing void content (VC), i.e., with increasing ($d_i$/D)-ratio, where lines a, b and c, respectively, represent the changes in weight of filaments (and fabric therefrom) of the families represented by FIGS. 11A, 11B, and 11C. For instance, for the family of filaments of FIG. 11A, the denier will remain constant even as the $d_i$ and void content increase, so line a is horizontal indicating no change in filament weight as void content increases.
Figure 13:
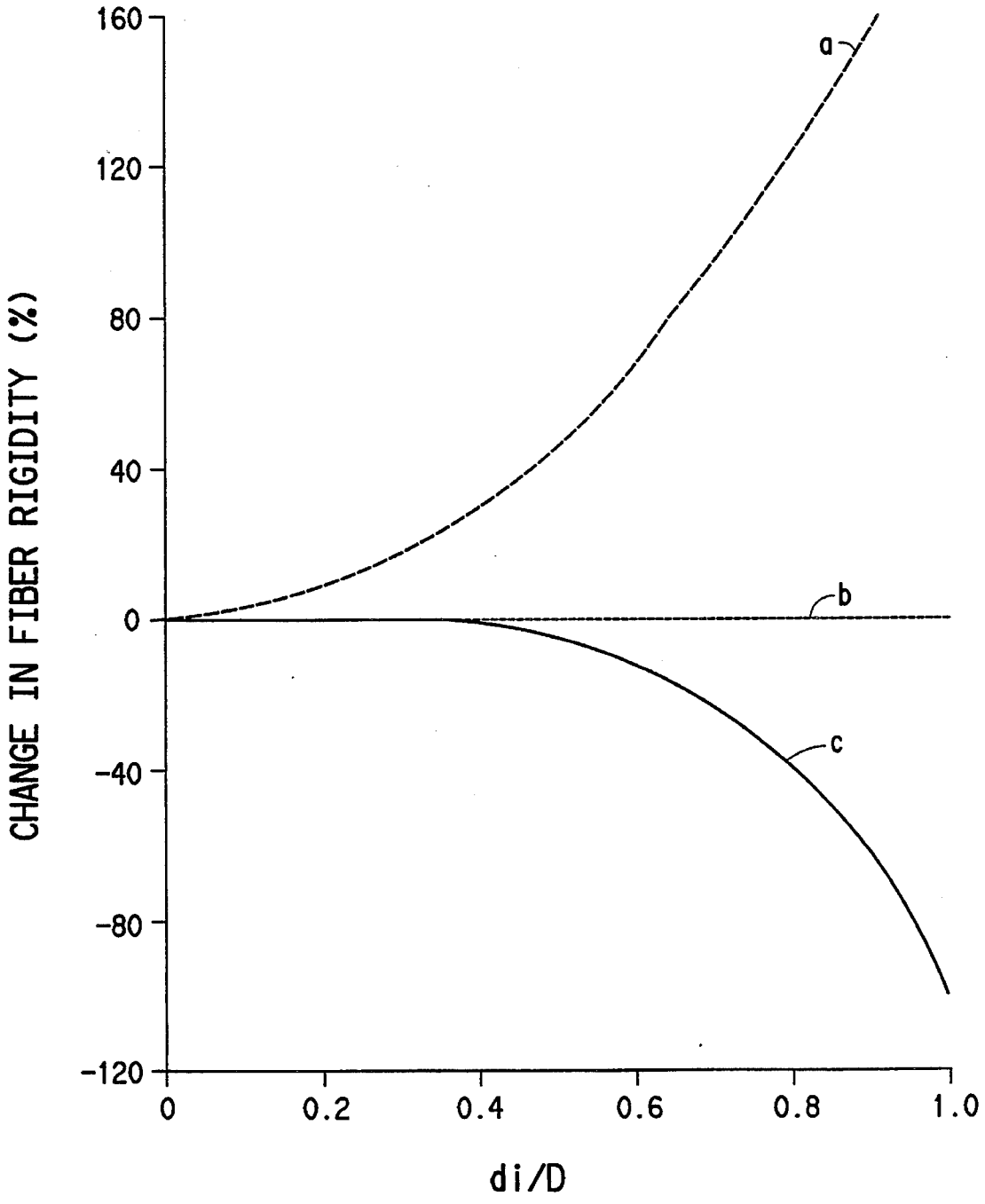
FIG. 13 plots the change in fiber (fabric) "rigidity" (bending modulus) versus void content ($d_i$/D), where lines a, b, and c correspond to filaments of FIGS. 11A, 11B, and 11C, respectively. In this case, line b is horizontal since the "rigidity" of the filaments of FIG. 11B is kept constant even as the void content increases.
Figure 14:
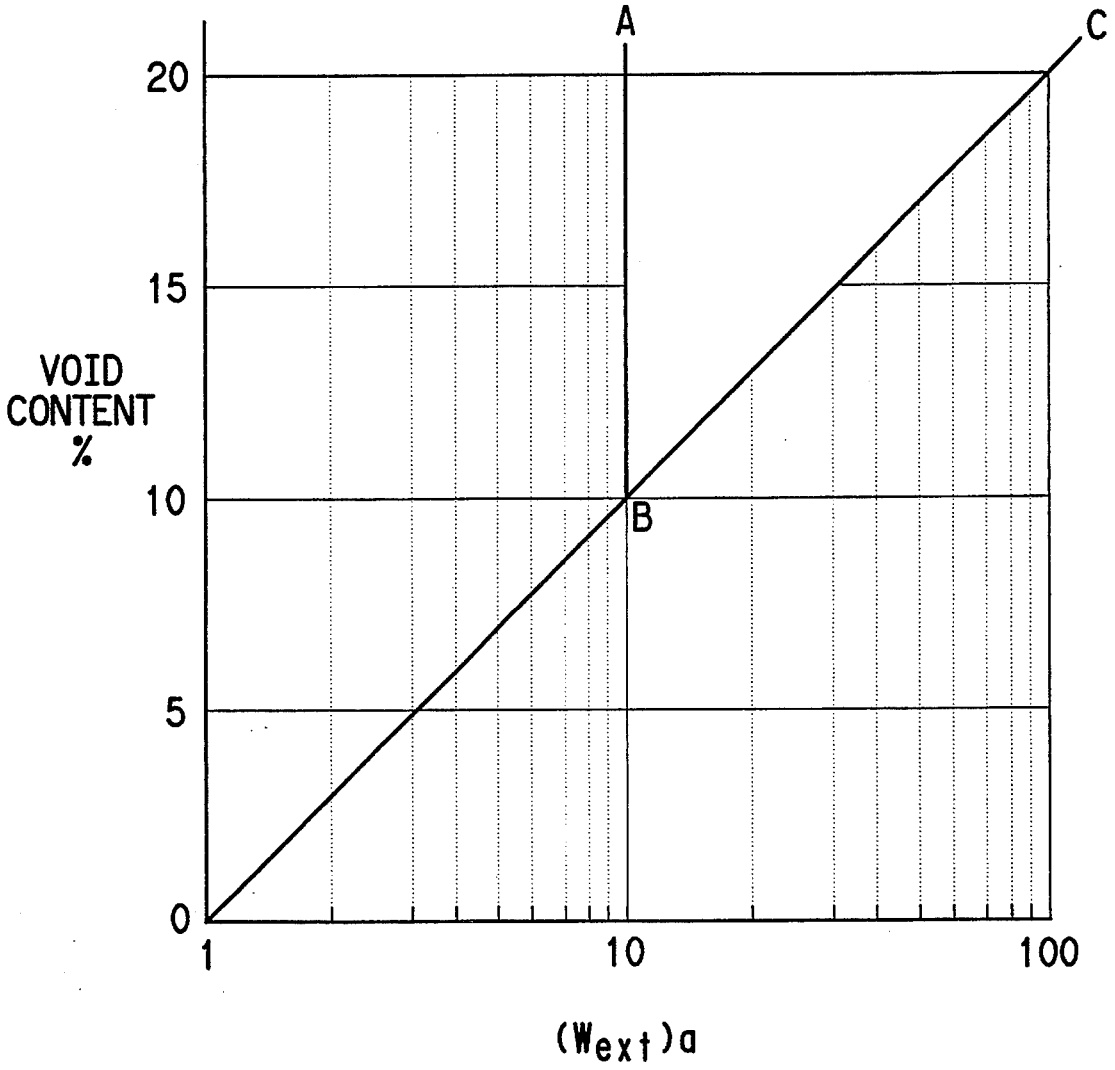
FIG. 14 is a semi-log partial plot of percent void content (VC) versus the apparent total extensional work $(W_{ext})_a$ plotted on a Log10 scale, the latter being calculated as indicated hereinafter, to indicate preferred filaments of the invention having $(W_{ext})_a$>10, as well as VC>10%, as defined by open area ABC, it being understood that the lines BA and BC may both be extended beyond points A and C which are not limits. (For more detailed description of FIG. 10, refer to Example XXV of copending application No. 07/979,776 (DP-4040-H), the disclosure of which is incorporated by reference.)

8. Mixed-filament yarns being comprised of filaments which differ in denier, void content, cross-sectional shape, and/or shrinkage so as to provide fabrics of different combinations of weight, volume, and rigidity (that may not be possible by single-type filament yarns, as discussed with reference to FIGS. 11–13 and as discussed in copending applications DP-4555-I and DP-4555-J, mentioned in preceeding paragraph numbered 2). In this regard, also, reference is again made to mixtures of hollow filaments and "C-shape" filaments, which cross-sectional filaments are believed novel and inventive in their own right.

9. Spinning of high ID hollow filaments of odd cross-sections (such as hexalobal) such that, during air-jet (turbulent) type processes, the hollow filaments will "fibrillate" into micro-denier fibers of varying deniers and shapes. Caustic etching may be used to weaken the high ID filaments prior to such air-jet "thrashing" of the filament yarns.

10. Exposing the hollow filaments immediately after attenuation and while still hot to a caustic finish as described in U.S. Pat. No. 5,069,844 (Grindstaff and Reese) to increase the hydrophilicity of the filaments; e.g., more like cotton. Hydrophilicity can further be increased by selecting copolyesters with high mole percent of ether linkages (—O—) for example.

11. Combine low shrinkage hollow filaments with high shrinkage "solid" filaments, such that, on exposure to heat, the "solid" filaments are "pulled" into the core of the filament bundles and thereby expose the hollow filaments at the surface for enhanced bulk. Reducing the denier of the hollow filaments further enhances the tactile aesthetics by providing softness and high bulk.

12. Combining homopolymer hollow filaments and cationic dyeable hollow filaments so as to provide mixed dyeing capability.

13. Prepare fabrics from air-jet or false-twist textured or self-bulking filaments and then brush and cut the surface filaments to expose their hollow ends which can then be caustic-treated, followed by additional brushing to provide a low cost "suede-like" fabric via the fibrillation of the caustic-treated exposed hollow filament ends.

14. Asymmetrical filament cross-section hollow filaments will provide along-end crimp which may be advantageous in blends of cotton, for example.

Indeed, further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); capillaries may advantageously be made as described, for example, in (Kobsa et al) U.S. Pat. No. 5,168,143 (corresponding to EPA 0 440 397, published Aug. 7, 1991), and/or in (Kobsa) U.S. Pat. No. 5,259,753 (corresponding to EPA 0 369 460, published May 23, 1990); finish application may be applied by convention roll application, metered finish tip applicators being preferred herein and finish may be applied in several steps, for example during spinning prior to drawing and after drawing prior to winding; interlace may be developed by using heated or unheated entanglement air-jets and may be developed in several steps, such as during spinning and during drawing and other devices may be used, such by use of tangle-reeds on a weftless sheet of yarns; interlace will generally not be used if the hollow filaments are intended for processing into tow and staple, in contrast to continuous filament yarns; conventional processing and conversion of tow to staple may be carried out as disclosed in the art.

TEST METHOD

Many of the polyester parameters and measurements mentioned herein are fully discussed and described in the aforesaid Knox, Knox and Noe, and Frankfort and Knox U.S. Pats Nos. 4,156,071, 5,066,447 and 4,134,882, all of which are hereby specifically incorporated herein by reference, so further detailed discussion, herein would, therefore be redundant.

For clarification, herein, S=boil-off shrinkage (the expression "$S_1$" being used in some Tables), $S_2$=DHS-S; and $S_{12}$=net shrinkage after boil-off followed by DHS; residual elongation=$E_B$, as discussed; $T_B$ is the break tenacity expressed grams per "break" denier and is defined by the product of conventional textile tenacity and the residual draw-ratio defined by $(1-E_B/100)$; and $(T_B)_n$ is a $T_B$ normalized to 20.8 polymer LRV as defined by the product of $T_B$ and $[(20.8/LRV)^{0.75}(1\text{-}\%delusterant/100)^{-4}]$. A Mechanical Quality Index (MQI) for the draw feed yarns can be represented by the ratio of their $T_B$-values, $[(T_B)_D/(T_B)_U]$, where MQI-values greater than about 0.9 indicate the DFY and the drawing process of the DFY provided drawn yarns with an acceptable amount of broken filaments (frays) for downstream processing into textile structures.

Shrinkage Power ($P_s$) referred to hereinbefore is defined by the product of the boil-off shrinkage S (%) and the maximum shrinkage tension $ST_{max}$ (g/d), [$ST_{max}$×S%], where values of $P_s$ greater than about 1.5(g/d)% are preferred to overcome fabric restraints, especially for wovens. The ratio of the $ST_{max}$ to shrinkage S is referred to as the Shrinkage Modulus ($M_s$); i.e., $M_s$=[($ST_{max}$(g/d)/S%]×100%, where values less than about 5 g/d are preferred.

The values of the glass-transition temperature (Tg), the temperature at the onset of major crystallization ($T_c$°), and temperature at the maximum rate of crystallization ($T_c$,max) may be determined by conventional DSC analytical procedures, but the values may also be estimated from the polymer's zero-shear melting point ($T_M$°) (expressed in degrees Kelvin) for a given class of chemistry, such as polyesters using the approach taken by R. F. Boyer [Order in the Amorphous State of Polymers, ed. S. E. Keinath, R. L. Miller, and J. K. Riecke, Plenum Press (New York), 1987]; wherein, Tg=0.65 $T_M$°; $T_c$°=0.75$T_M$°; $T_{c,max}$=0.85 $T_M$°; and the initial crystallization occurs at the mid-point between $T_c$° and $T_g$; that is, about 0.7 $T_M$° which correlates with the shrinkage tension peak temperature T($ST_{max}$) of as-spun filaments; and wherein all the above calculated temperatures are expressed in degrees Kelvin (where degrees Kelvin K=degrees centigrade C+273). The onset of major crystallization ($T_c$°) is also associated, herein, with the temperature where the rate of crystallization is 50% of the maximum rate and $T_c$° is also denoted by $T_{c,0.5}$.

New test methods used herein for percent void content (VC), percent surface cyclic trimer (SCT) and heat transfer (Clo-value) are summarized below.

The surface Cyclic Trimer (SCT) is measured by extracting out the SCT, using about 25 ml of spectrograde carbon tetrachloride per 0.5 grams of fiber, and measuring the amount of solubilized SCT from the absorbance of the extracted solution at 286 nm. (calibrate opposite a solution of approximate 2.86 mg of trimer dissolved in 25 ml (0.1144 mg/ml). Using several dilutions of the control solution and measuring the absorbance at 286 nm provide linear calibration plot of ppm trimer vs. absorbance. The calibration curve is now used to determine the ppm of SCT for the desired fiber sample.) The absorbance may be measured using a Cary 17 Spectrophotometer and standard 5 ml silica cells.

Hollow filaments are measured for their void content (VC) using the following procedure. A fiber specimen is mounted in a Hardy microtome (Hardy, U.S. Department of Agriculture circ. 378, 1933) and divided into thin sections according to methods essentially as disclosed in "Fibre Microscopy its Technique and Application" by J. L. Stoves (van Nostrand Co., Inc., New York 1958, pp. 180–182). Thin sections are then mounted on a SUPER FIBERQUANT video microscope system stage (VASHAW SCIENTIFIC CO., 3597 Parkway Lane, Suite 100, Norcross, Ga. 30092) and displayed on the SUPER FIBERQUANT CRT under magnification up to 100X, as needed. The image of an individual thin section of one fiber is selected, and its outside diameter is measured automatically by the FIBERQUANT software. Likewise, an inside diameter of the same filament is also selected and measured. The ratio of the cross-sectional area of the filament void region to that of the cross-sectional area surrounded by the periphery of the filament, multiplied by 100, is the percent void (VC). Using the FIBERQUANT results, percent void is calculated as the square of the inside diameter divided by the square of the outside diameter of the each filament and multiplied by 100. The process is then repeated for each filament in the field of view to generate a statistically significant sample set of filament void measurements that are arranged to provide value for VC. It will be understood that references to void contents herein refers to void contents of hollow filaments, when referring to mixed filament yarns also containing filaments that are not hollow, CLO values are a unit of thermal resistance of fabrics (made, e.g., from yarns of hollow fibers) and are measured according to ASTM Method D 1518–85, reapproved 1990. The units of CLO are derived from the following expression: CLO=[thickness of fabric (inches)×0.00164]×heat conductivity, where: 0.00164 is a combined factor to yield the specific CLO in (deg K.) (sq. meter)/Watt per unit thickness. Typically, the heat conductivity measurement is performed on a samples area of fabric (5 cm by 5 cm) and measured at a temperature difference of 10 degrees C. under 6 grams of force per square cm. The heat conductivity (the denominator of the expression above) becomes: heat conductivity=(W×D)/(A×temperature difference), where: W (watts); D (sample thickness under 150 grams per sq. cm); A (area=25 sq. cm); temperature difference=10 degrees C.

Air permeability is measured in accordance with ASTM Method D 737-75, reapproved 1980. ASTM D 737 defines air permeability as the rate of air flow through a fabric of known area (7.0 cm diameter) under a fixed differential pressure (12.7 mm Hg) between the two fabric surfaces. For this application, air permeability measurements are made on a sampled area approximately equal to one square yard or square meter of fabric which are normalized to one square foot. Before testing, the fabric is preconditioned at 21 ±1 C. and 65 ±2% relative humidity for at least 16 hours prior to testing. Measurements are reported as cubic feet per minute per square foot (cu ft/min/sq ft). Cubic feet per minute per square foot can be converted to cubic centimeters per second per square centimeter by multiplying by 0.508.

Various embodiments of the processes and products of the invention are illustrated by, but not limited to, the following Examples with details summarized in the Tables, all parts and percentages being by weight, unless otherwise indicated.

EXAMPLES

A. First we include herein another summary of key process parameters that we used in the Examples, because we believe them important for spinning fine denier spin-oriented hollow filaments, directly, especially of hollow void content at least about 10%.

Fine denier hollow filament yarns were spun over a spin speed ($V_s$) range of 2172 to 2400 mpm to provide filaments of as-spun denier from 1.4 to 0.55 and drawable to a reference elongation of 30% and drawn deniers ranging from about 0.75 to about 0.35, with void contents of both spun and drawn filaments being greater than 10%. We used 2GT polyester homopolymer of nominal LRV in the range about 20.5–21.5, such as has typically been used for most textile applications, and corresponds to a nominal intrinsic viscosity (IV) of about 0.645–0.655. Polymer having LRV-values in the range of 13 to 23 has been successfully used to spin hollow filaments but, for practical reasons, we used 2GT homopolymer of nominal LRV of 21–21.5, and of zero-shear melting point ($T_m$°) about 254 C. The polyester polymer was spun at a melt temperature ($T_p$) in the range of 288–294 C., providing melt viscosity proportional to the term [LRV($T_m$°/$T_p$)$^6$]. The polymer melt was extruded through a multi-component spinneret (referred to as a "complex spinneret") comprised of metering capillaries of length (L) and diameter (D) to provide a pressure drop proportional to the expression $[(L/D)^n/D^3]$ for a given polymer temperature ($T_p$) and mass flow rate (i.e., product of spun dpf and spin speed $V_s$); the pressure drop was used to provide uniforming metering of the low mass flow rates through a counterbore acting as a polymer reservoir to feed the melt into capillaries that lead to the spinneret orifices (arc-shaped slots of width (W) and height (H)) and having an entrance angle defined by the sum of angles S and T (described in detail hereinbefore); the individual arc-shaped slots form a circle with an outer diameter (OD) and an inner diameter (ID=OD−2W), and with small gaps (tabs) between the slots (as illustrated in FIGS. 4A, 5A, and 6A); the total extrusion area (EA) is given by the expression $[\pi/2)OD^2]$ and the extrusion void area (EVA) is given by the expression $[\pi/2)ID^2]$, so the (EVA/EA) ratio=$[(OD-2W)/OD]^2$. Individual "slot" melt streams post-coalesce to form a hollow filament having a void which decreases during attenuation and quenching to void content (VC) as defined hereinbefore.

Unless otherwise indicated, the process parameters for spinning the hollow filaments of the invention were as described in the parent application, now U.S. Pat. No. 5,250,245, that is, the length ($L_{DQ}$) of delay shroud below the point of extrusion was between about 2 cm and about $12(dpf)^{1/2}$, and convergence length ($L_c$) between about 50 cm and about $[50+90(dpf)^{1/2}]$cm. All the yarns spun in the present Examples were made using these conditions. Further, as we found from the parent application that radial quench was preferred for achieving good along-end filament uniformity as measured by along-end denier spread (DS) and draw tension variation (DTV), radial quench was used to spin the preferred hollow filaments in the Examples.

In general, the lengths of delay ($L_{DQ}$), convergence lengths ($L_c$), and quench air flow rates ($Q_a$) were selected to optimize along-end uniformity and polymer temperatures and quench air flow rates ($Q_a$) were used to maximize filament yarn break tenacity ($T_B$) (normalized to 20.8 LRV and 0% delusterant). We used polymer temperatures typically about 35 to 40 degrees above the polymer melt temperature $T_m°$ (i.e., 289–294 C. for homopolymer 2GT polyester). The polymer temperature was sometimes decreased, as desired, by increasing the filament-to-filament spinneret density (No. Fils/cm$^2$) since, at high spinneret filament densities, the inherent retention of heat provides an opportunity to reduce polymer extrusion temperature ($T_p$). Examples 1–9 provide additional details of process parameters for spinning large filament counts of fine hollow filament yarns.

Spinnerets generally similar in design to those described in the art by Champaneria et al in U.S. Pat. No. 3,745,061, Farley and Baker in Br. Patent No. 1,106,263, Hodge in U.S. Pat. No. 3,924,988 (FIG. 1), Most in U.S. Pat. No. 4,444,710 (FIG. 3), and in Br. Patent Nos. 838,141 and 1,106,263, were used as illustrated in more detail in FIGS. 4A, 4B, 5A, 5B, 6A and 6B, except that the dimensions of the arc-shaped orifice slots (height H and width W), the orifice capillary entrance angles S and T, and the pressure drops (ΔP) of capillary orifice, counterbore, and metering capillary were carefully selected to spin fine hollow filaments of void content greater than 10% (such selection criteria not having been taught in the above art).

We have found that for spinning fine filaments, and especially for obtaining subdenier filaments, the void content strongly depends on the value of [(S/T)(H/W)]. Conventional spinneret orifices have (S/T) ratios of about 1 (i.e., S=T, and the entrance angle is symmetric), and have (H/W) ratios between about 1 and about 1.4, to give a [(S/T)(H/W)] value of less than about 1.5. In Examples 1–9 the (S/T) ratios were varied from 1 to 1.83 and the (H/W) ratios were varied from about 1.3 to 5 to provide [(S/T)(H/W)] values greater than 1.5, preferably greater than 2, and especially greater than 3.

We also found that we could increase the void content (VC) by increasing the (EVA/EA) ratio, ratios from about 0.4 to about 0.8 being selected, based on spinning performance. All the items in Examples 1–9 were spun from spinnerets with (EVA/EA) ratios in this range. We also found that we could increase the void content by increasing the spun dpf; however, the dpf desired is often selected by customers, based on their end-use requirements, so this is not always a process variable. We also found that we could optimize the spinning performance for a given dpf, by selecting spinneret dimensions such that the (EVA/dpf) ratio was within a range of 0.05 and 0.55, which limits selection of spinneret design for any desired filament dpf. Although we could increase void content by increasing EVA, the increase in EVA affects the values of both the (EVA/EA) ratio and the (EVA/dpf) ratio. A balance between these 2 ratios is made based primarily on spinning performance, and secondarily on void content. We also observed that void content increased with spinning speed ($V_s$), and believe this effect to be related to the stress-induced crystallization (SIC) that occurs and increases with high spinning stress. Spinning stress has been considered to increase approximately with the term ($V_s^2$/dpf) when all other process variables are held constant, so there could be inconsistency in attributing increased void content solely to stress-induced crystalization (if described by the term ($V_s^2$/dpf) since void content has been observed to decrease with decreasing dpf. Accordingly, as indicated already, we have attempted to relate the void content to the work (not stress) that the threadline undergoes during attenuation.

B. We found empirically that the void content increased with the logarithm of the apparent work of extension of the attenuating spinline ($W_{ext}$)a and so used this as a rationale for the selection (trade-offs) of the key process parameters that affect void content. The expression should be used in conjunction with the desired ranges of the terms discussed already; i.e., (EVA/EA), (EVA/dpf), [(S/T) (H/W)], $L_D$ (2 to 12 $(dpf)^{1/2}$]cm, $L_c$ [50 to 90$(dpf)^{1/2}$]cm, and the selection of the polymer type, polymer LRV, polymer $T_m°$, and extrusion temperature $T_p$.

We found experimentally the void content (VC) to be related to the "apparent work of extension" $(W_{ext})_a$ during attenuation. The phenomenological expression has already been given hereinbefore for VC(%) as a function of $W(_{ext})_a$ and is also given in Example XXV of above-mentioned application No. 07/979,776, the disclosure of which Application is incorporated herein by reference.

From such expression for $W(_{ext})_a$, the loss in void content to be expected when changing from 2GT hompolymer (HO) of 19.8 LRV, 254 C. $T_m°$, and 290 C. $T_p$, to a copolymer (CO) modified with 2 mole % of ethylene-5-M-sulfo-isophthalate for cationic dyeability,and having 15.3 LRV, 245 C. $T_m°$, and $T_p$ 285 C., can be estimated, for example when all other process parameters are held constant, from a "reduced form" of the expression for $W(_{ext})_a$ as a VC-ratio:

$$VC(HO)/VC(CO)=\mathrm{Log}[LRV(T_m°/T_p)^6]HO/\mathrm{Log}[LRV/(T_m°/T_p)^6]CO$$

which expression provides a ratio of 1.26, which compares well with the range of VC-ratios from 1.1 to 1.4 that we have observed, and which approximate to a nominal average of 1.25. The lower void content of the copolyester may be increased to match that of the homopolymer by increasing spin speed of the copolymer process 1.35X, by increasing the spinneret orifice dimensions, [(H/W)(S/T)], by 1.26 X, or by increasing the EVA by 3.3X, where in each case all other process parameters are "held constant. It may not be feasible to match the VC of the homopolymer filaments by increasing EVA, for example, by 3.3X because of poorer spinning performance; but, a combination of an increase in spin speed Vs, capillary dimensions (H/W)(S/T) and EVA so to obtain a net 1.26X increase in the value of the logarithm of W(ext)a, is generally possible without loss in performance" The expression for $W(_{ext})a$ provides a starting point in the selection of process conditions to provide hollow filaments of a desired void content and dpf.

Figure 1A:
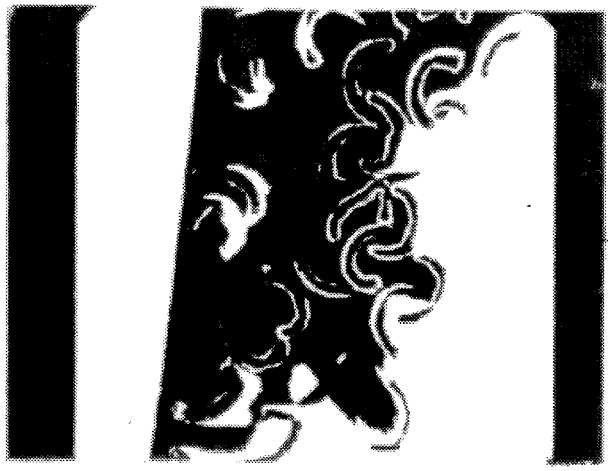
FIG. 1A is a representative enlarged photograph of cross-sections of filaments for which post-coalescence was incomplete (herein called "opens") some such cross-sections are referred to as "C-shape" (cross-sections) and believed novel and useful and inventive.
Figure 1B:
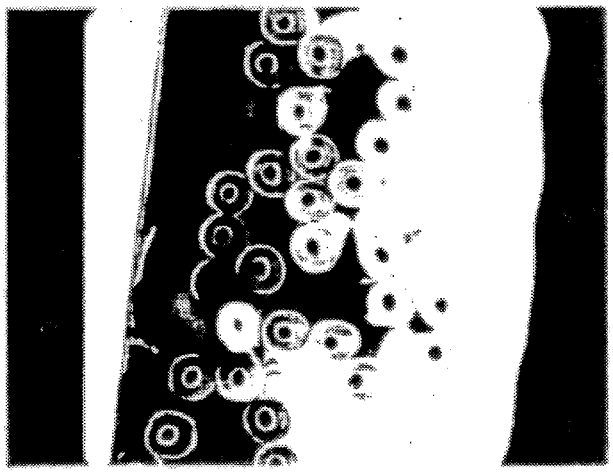
FIG. 1B is a representative enlarged photograph of cross-sections of round filaments according to the invention (claimed herein) with a concentric longitudinal void (hole)
Figure 1C:
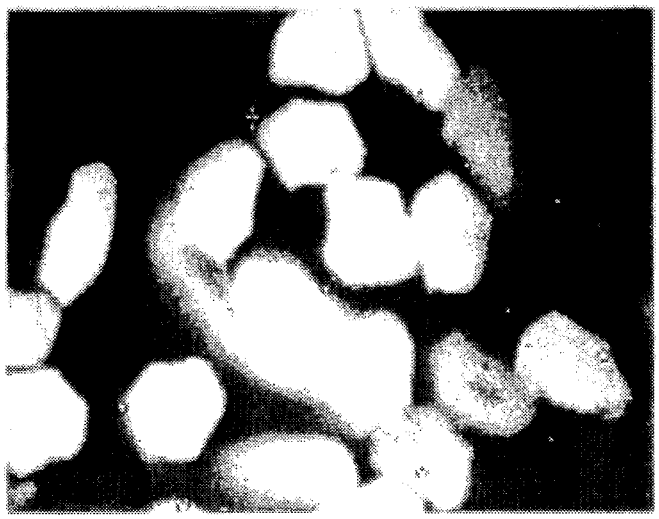
FIG. 1C is a representative enlarged photograph of cross-sections of filaments of a textured hollow filament yarn, also according to the invention, showing that the void is almost completely collapsed on draw false-twist texturing.
Figure 1D:
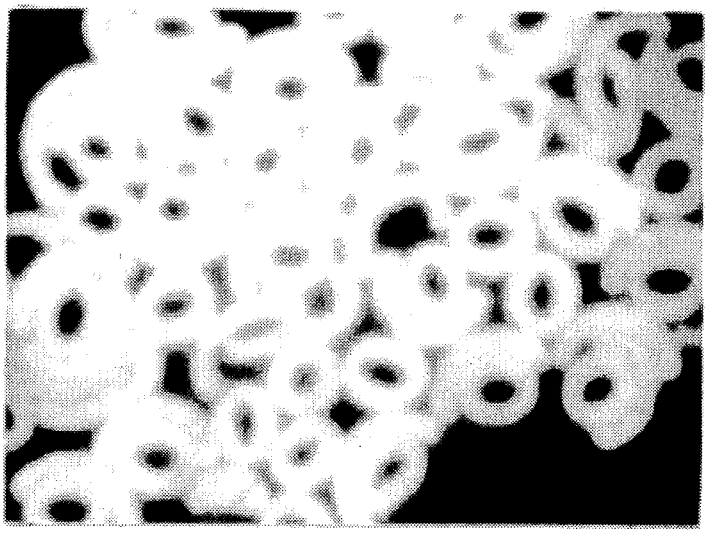
FIG. 1D is a representative enlarged photograph of cross-sections of filaments of a yarn of a mixture of novel filaments according to the invention, namely novel hollow filaments mixed with novel "C-shape" cross-sections.
Figure 1E:
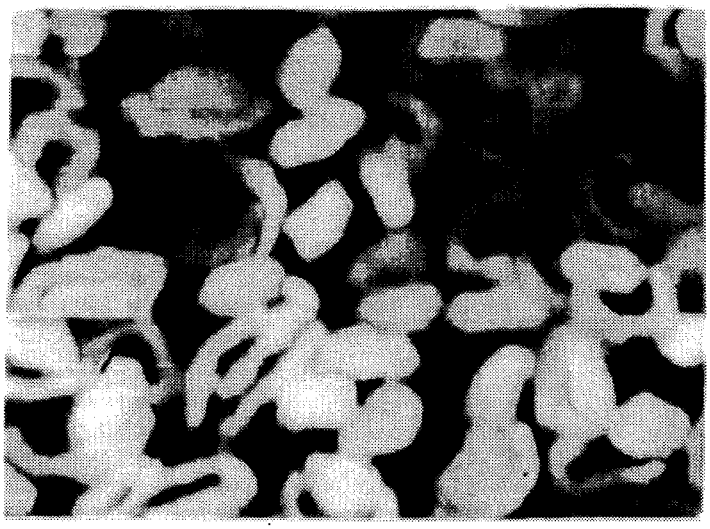
FIG. 1E is a representative enlarged photograph of cross-sections of a novel textured yarn of a mixture of novel filaments (textured from a feed yarn such as shown in FIG. 1D) also according to the invention.
Figure 1F:
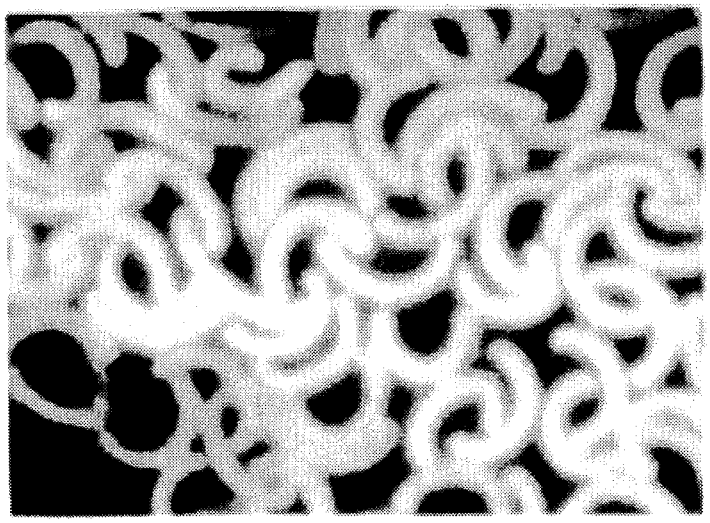
FIG. 1F is a representative enlarged photograph of cross-sections of novel filaments of C-shaped filaments only, according to the invention.
Figure 2A:
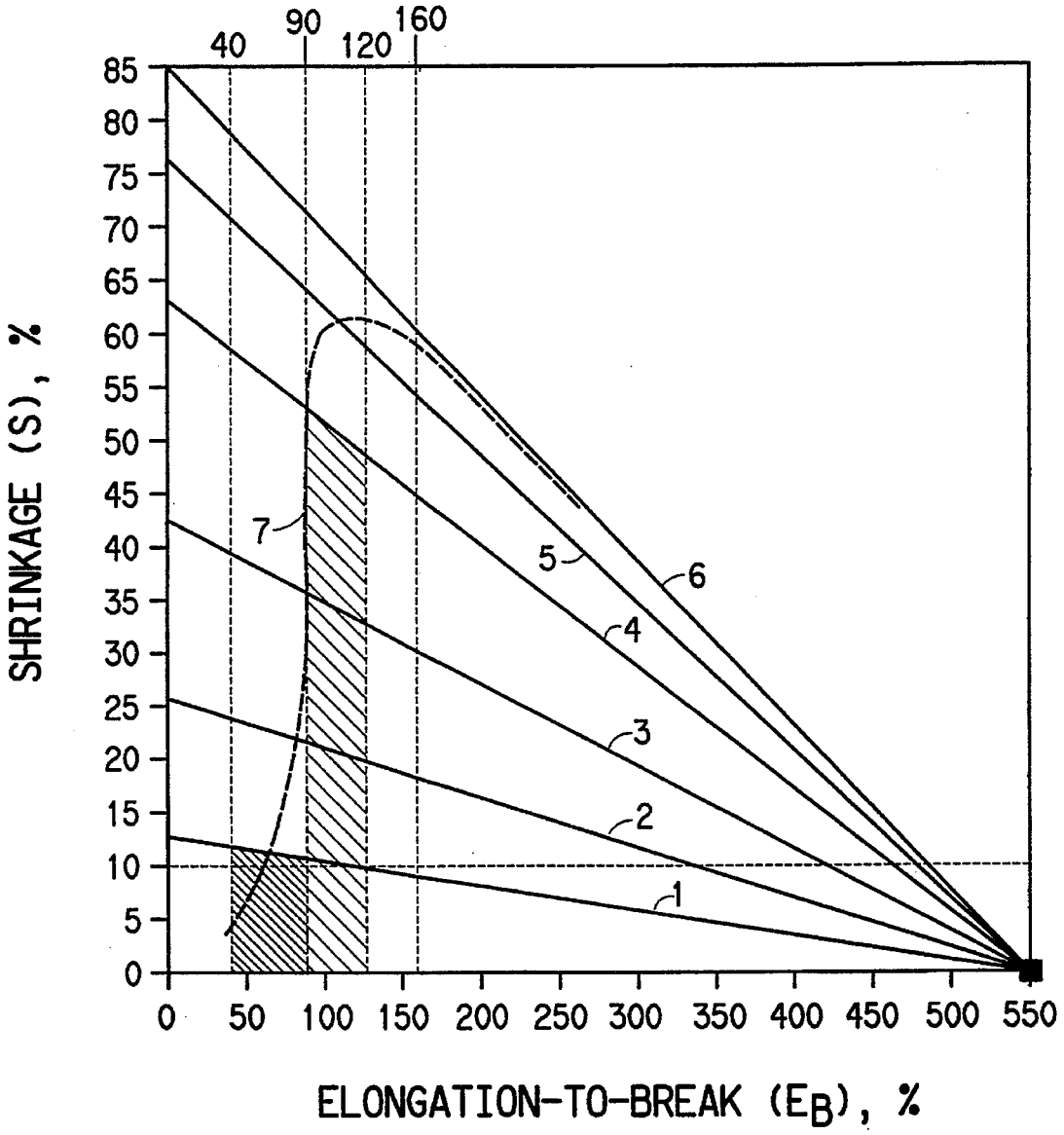
FIG. 2A is a representative plot of boil-off shrinkage (S) versus elongation-to-break ($E_B$) wherein (straight) Lines 1, 2, 3, 4, 5, and 6 represent ($1-S/S_m$)-values of 0.85, 0.7, 0.5, 0.25, 0.1, and 0, respectively and (S-shaped) curved Line 7 represents a typical shrinkage versus elongation-to-break relationship for a series of yarns formed, for example, by increasing spinning speed, but keeping all other process variable unchanged. Changing other process variables (such as dpf, polymer viscosity) produces a "family" of similar S-shaped curved lines, essentially parallel to each other. The vertical dashed lines denote ranges of $E_B$-values for preferred filaments of the invention, i.e., 40% to 90% for a direct-use yarn and 90% to 120% for a draw feed yarn, with 160% as being an upper limit, based on age stability. The preferred hollow filaments of the invention denoted by the "widely-spaced" \\\\\\-area are especially suitable as draw feed yarns, having $E_B$-values of about 90% to 120% and ($1-S/S_m$) ratio of at least about 0.25 (below line 4); and the preferred hollow filaments of the invention denoted by the "densely-spaced" \\\\\\-area, bordered by $E_B$-values of about 40% to about 90% and ($1-S/S_m$) ratio at least about 0.85 (below line 1), are especially suitable as direct use textile filaments.
Figure 2B:
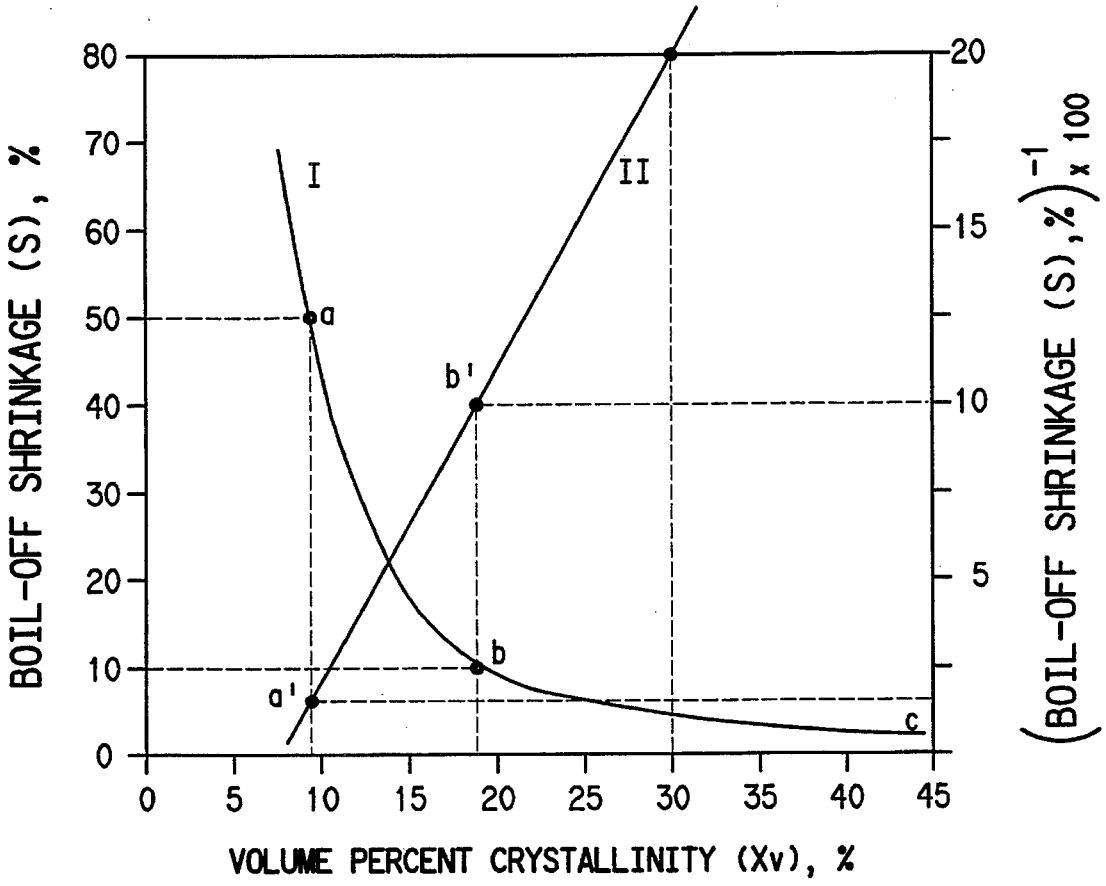
FIG. 2B shows two lines (I and II) plotting the shrinkage (S) versus volume percent crystallinity (Xv), measured by flotation density and corrected for % pigment, being a measure of the extent of stress-induced crystallization (SIC) of the amorphous regions during melt-spinning, where Line I is a representative plot of percent boil-off shrinkage (S) of spin-oriented "solid" filaments (not according to the invention) having a wide range of elongations-to-break ($E_B$) from about 160% to about 40%, spun using a wide range of process conditions (e.g., filament denier and cross-section, spin speed, polymer LRV, quenching, capillary dimensions (L×D), and polymer temperature $T_p$). It will be noted that the shrinkages (S) fall on a single curve (Line I) and that plotting the reciprocals of the shrinkages $(S)^{-1}\times 100$ gives a straight line relationship (Line II) with Xv. This relationship of shrinkage S versus Xv obtained for yarns of such differing $E_B$-values supports the view that the degree of SIC is the primary structural event and that the degree of stress-induced orientation (SIO) is only a secondary structural event in this range of $E_B$-values, with regard to determining the boil-off shrinkage S. A shrinkage S from about 50% (point a) to about 10% (point b), corresponding to a range of Xv of about 10 to 20%, is the preferred level of SIC for draw feed yarns, while less than about 10% shrinkage, corresponding to Xv greater than about 20%, is a preferred level of SIC for direct-use tensile yarns (b–c). Line II (plotting reciprocal values of S%,×100) provides an easier way to estimate Xv for hollow filaments of the invention having ($E_B$)-values in the approximate range of 120 to 40%, thus points a' and b' on line II, corresponding to points a and b on Line I, respectively, indicate a preferred level for draw feed yarns.

C. After achieving by the above means the desired void content for the given filament dpf, polymer LRV and polymer type, we found that novel hollow filaments of desired drawing behavior may be provided by selecting process conditions to provide hollow filaments having shrinkages (S) such that the value of the expression $(1-S/S_m)$ is at least about 0.4, where $S_m=[(550-E_B)/6.5]$. These semi-crystalline partially oriented hollow filaments have the capability of being drawn to elongations $E_B$ between about 15–40% without loss in void content as represented by the area below line 4 in FIG. 2A. We further observed that such filaments that are crystalline and have a $(1-S/S_m)$ value of at least about 0.85 (area below line 1 in FIG. 2A) can be drawn without loss in void content (there may be an actual increase in void content depending on the drawing conditions) and further that such crystalline POY filaments can be uniformly partially drawn cold or hot, as described by Knox and Noe in U.S. Pat. No. 5,066,477, without the characteristic "thick-thin" of neck-drawing of conventional polyester POY.

These low shrinkage undrawn crystalline hollow polyester filaments may be used as companion feed yarns with nylon POY filaments as disclosed in Example XXVI of above-mentioned copending Application No. 07/979,776 (DP-4040-H).

D. Mixed filament yarns comprised of at least 2 components wherein at least 1 component is comprised of hollow filaments having at least 10% void content by volume, other filament components being hollow or solid polyester filaments of the same or of different deniers, are preferably prepared by co-spinning the different filament bundles and co-mingling the bundles prior to the introduction of interlace and winding up a mixed-filament yarn. For providing hollow filaments which differ in denier (Case I), the different denier bundles may be spun from separate metered streams (within the same spin pack or from different packs) wherein the denier varies linearly with the metered mass flow rate.

For providing mixed denier filaments from the same metered stream (Case 2), it is known that the $(\Delta P)_1=(\Delta P)_2$; that is, the pressure drop of polymer stream 1 (low dpf) must equal that of polymer stream 2 (high dpf) at equilibrium extrusion. For the same polymer and polymer $T_p$, this relationship may be re-expressed by $[(dpf)(L/D)^n/D^3]_1=[(dPf)(L/D)^n/D^3]_2$ where L and D are taken as the length and diameter of the metering capillaries, and the value of "n" is about 1.1, but is preferably determined experimentally from the expression:

$$n=\mathrm{Log}\{[(dpf)/D^3)_1/(dpf)/D^3)_2]\}/\mathrm{Log}\{L_2D_1/L_1D_2)\}.$$

An "n" value of about 1 assumes that the couterbore, entrance angles, and capillary orifice does not contribute significantly to the pressure drop. However, for complex spinnerets (i.e., comprised of metering capillaries, counterbores, arc-shaped capillary orifices of height H and width W and entrance angles S and T) the above experimentally-determined value for "n" provides a more realistic starting point for selecting spinneret of different metering capillaries for providing the desired values of high and low filament deniers.

Different dpfs can also be obtained using the same metering capillary and adjusting the H/W ratio of the orifice capillary. This option is a more expensive, and so generally less preferred. If the filaments also differ in cross-section (e.g., hollow filaments and solid filaments), the value of "n" will most likely be different for the complex spinneret forming hollow filaments than from that forming solid filaments where the value of "n" is about 1.1. In this case the value of "n" for the hollow complex spinneret may be determined by using a test spinneret which is comprised of known round capillaries having the same dimensions (L×D) as that of the metering capillaries used in the complex spinnerets for forming hollow filaments and letting the value "n" for the round capillaries to be equal to 1–1.1 and solving the expressions used hereinabove for "n" of the complex capillaries. Knowing the value of "n" for a range of complex capillaries differing in orifice capillary dimensions (H/W), permits the selection of metering capillary dimensions to provide filament bundles of mixed denier filments.

For example, when this process rationale was applied to spinning a mixed-dpf 100-filament yarn of an average yarn filament dpf of 1 (i.e., $\{50(dpf)_1+50(dpf)_2\}/100$] and void content of 15%, spun at 2700 ypm (2468 mpm) using a spinneret of 50 capillaries orifices characterized S/T value of 1.83, a H/W value of 1.4, a metering capillary having a LXD of 15×44 mil (0.381×1.176 mm) and 50 spinneret orifices having a metering capillary LXD of 9×36 mil (0.229×0.9144 mm), the expected dpf ratio, $[(dpf)_2/(dpf)_1]$, based on the dimensions of the metering capillariy dimensions was "9.4"; however the experimental dpf-ratio was "6". which gives a value of 3.8 to the exponent "n". This illustrates that for complex spinneret orifices (e.g., comprised of segmented slots, asymmetric counterbores with metering capillaries) that the simple ratio of the metering capillary ($L/D^4$-values) is not sufficient.

E Depending on the spinning speed, polymer type and polymer LRV, in such mixed-filament yarns wherein at least one component is comprised of hollow filaments of denier less than 1 dpf, the filament components of the mixed-filament yarn may also differ in shrinkage (S). If it is desired to reduce the shrinkage difference, then the shrinkage of the high dpf hollow filament (typically the high shrinkage filament component) may be decreased by increasing the EVA/dpf ratio of its spinneret orifice. As the EVA/dpf ratio is increased, however, there is generally a decrease in spinning performance, if all other process parameters are held constant. Increasing polymer temperature or decreasing spin speed would generally improve the spinning performance at high EVA/dpf values, but such process changes will tend to increase filament shrinkage of both components and decrease the void content of the hollow filaments. Obtaining the desired level of mixed-shrinkage, average yarn void content, average yarn dpf, and spinning performance requires a careful selection of process parameters.

F. Differential shrinkage may also be imparted to a low shrinkage filament yarn comprised of two or more bundles of filaments, by drawing one bundle at a temperature $T_D$ between about the polymer Tg (65–67 C. for 2G-T) and about the onset of major crystallization $T_c°$(120–130 C.) to provide drawn filaments of high shrinkage (S) and drawing another bundle at a temperature greater than $T_c°$ to provide low shrinkage down filaments and then, after said drawing, co-mingling the filament bundles of different shrinkage to provide the desired mixed-shrinkage yarn.

Another route to mixed shrinkage is to co-draw a mixed filament yarn comprised of filaments which differ in their thermal stability (e.g., hollow and solid filaments of the same dpf or hollow filaments of different dpfs) at temperatures $T_D$ between $T_g$ and $T_c$°. Typically, hollow filaments of the same dpf as the solid filaments and lower dpf hollow filaments will be less responsive to this drawing process than will solid filaments and higher dpf hollow filaments. This draw step may be carried out in a split process, such as draw-warping or draw air-jet texturing wherein no post heat treatment is carried out; or the draw step may be coupled with the spinning of these draw feed mixed-filament bundles.

EXAMPLES 1 TO 4

In Examples 1 to 4, yarns of 100 hollow filaments were melt spun from 2G-T homopolymer of (nominal) 21.2 LRV, glass transition temperature (Tg) between 40° and 80° C., 254° C. zero-shear melting point ($T_M$°), and containing 0.035% $TiO_2$ delusterant, at a polymer temperature (Tp) determined by that of the block, through spinnerets as follows, and then quenched radially with a short delay shroud of length ($L_{DQ}$) about 2–3 cm, and converged by use of a metered finish tip applicator guide at a distance (LC) of about 109 cm, interlaced and wound up, being withdrawn at the indicated spin speeds ($V_s$), and then drawn, the remaining process and product data for the as spun yarns of dpf ranging from 0.55 to 1.4 being summarized in Tables 1 through IV, respectively, including spun and drawn dpfs.

Figure 7A:
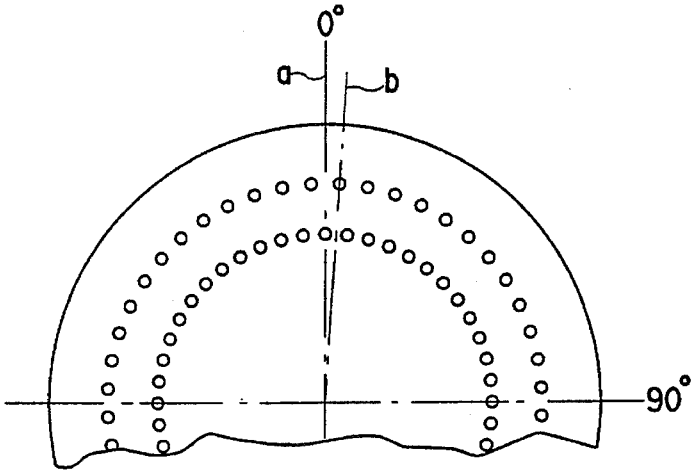
FIGS. 7A, 7B and 7C show schematically partial spinneret arrangements in 2 rings, 3 rings and 5 rings, respectively, that may be used to spin filaments according to the present invention.
Figure 7B:
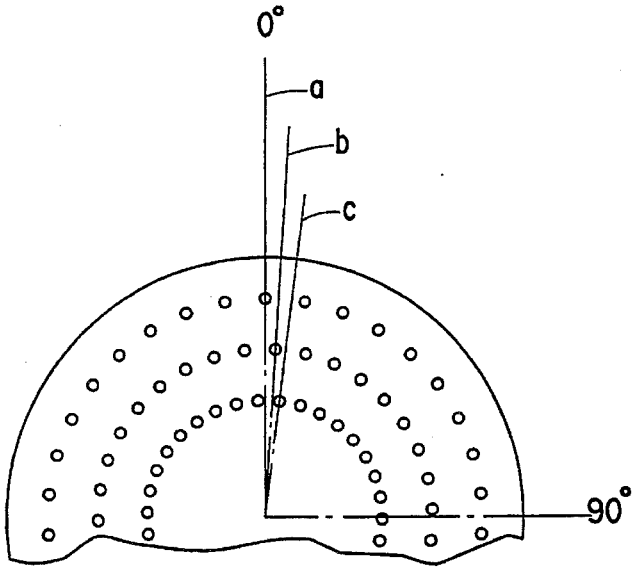
Figure 7C:
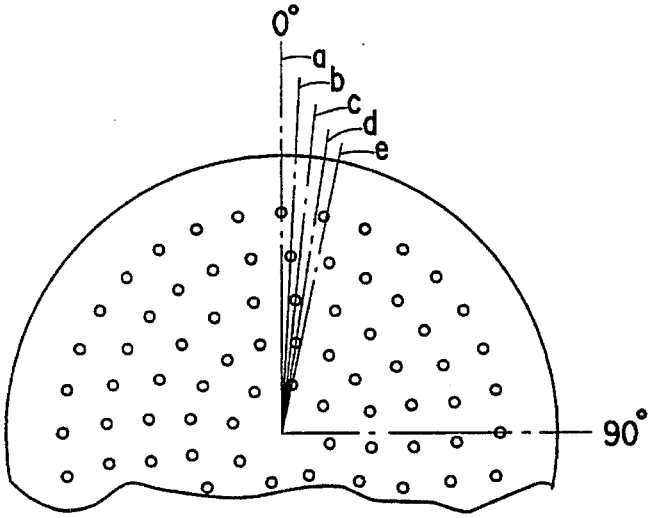
Figure 8A:
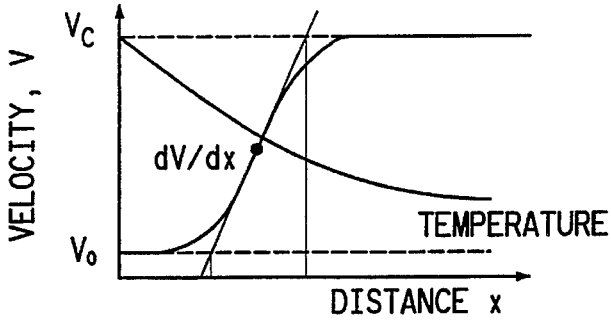
FIG. 8A is a graphical representation of spinline velocity (V) plotted versus distance (x) where the spin speed increases from the velocity at extrusion ($V_o$) to the final (withdrawal) velocity after having completed attenuation (typically measured downstream at the point of convergence, $V_c$); wherein, the apparent internal spinline stress is taken as being proportional to the product of the spinline viscosity at the neck point, (i.e., herein found to be approximately proportional to about the ratio $LRV(T_M°/T_P]^6$, where $T_M°$ and $T_P$ are expressed in degrees C.), and the velocity gradient at the neck point (dV/dx), (herein found to be approximately proportional to about $V^2$/dpf, especially over the spin speed range of about 2 to 4 km/min and proportional to about $V^{3/2}$/dpf at higher spin speeds, e.g., in the range of about 4 to 6 km/min). The spin line temperature is also plotted versus spinline distance (x) and is observed to decrease uniformly with distance as compared to the sharp rise in spinline velocity at the neck point.
Figure 8B:
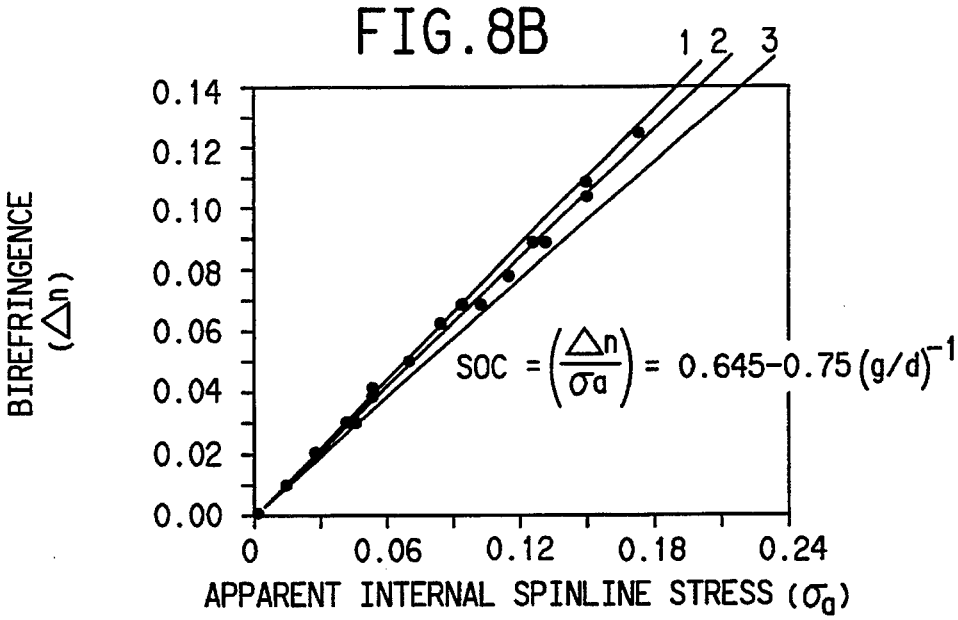
FIG. 8B is a graphical representation of the birefringence of the spin-oriented filaments versus the apparent internal spinline stress; wherein the slope is referred to as the "stress-optical coefficient, SOC" and Lines 1, 2, and 3 have SOC values of 0.75, 0.71, and 0.645 $(g/d)^{-1}$ respectively; with an average SOC of about 0.7; and wherein Lines 1 and 3 are typical relationships found in literature for 2GT polyester.
Figure 8C:
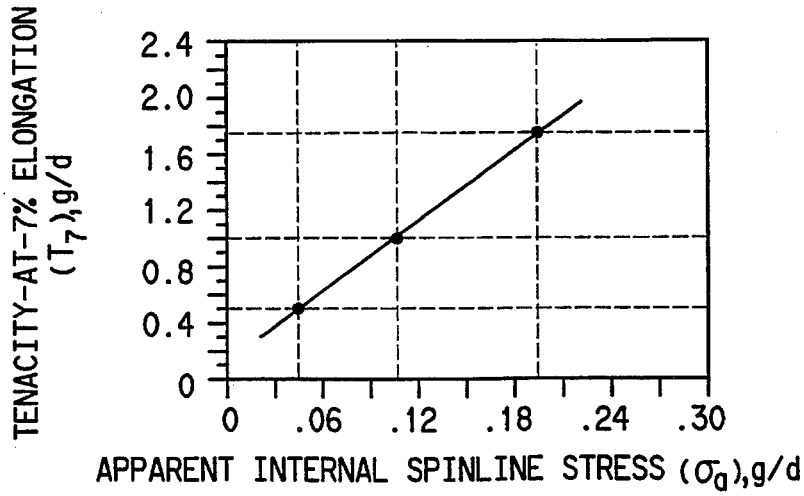
FIG. 8C is a graphical representation of the tenacity-at-7%-elongation ($T_7$) of the spin-oriented filaments versus the apparent internal spinline stress. The near linear relationships of birefringence and $T_7$ (each versus the apparent internal spinline stress) permits the use of $T_7$ as a useful measure of the filament average molecular orientation. Birefringence is a very difficult structural parameter to measure for fine filaments with deniers less than 1 and especially of odd-cross-section (including hollow filaments).
Figure 9:
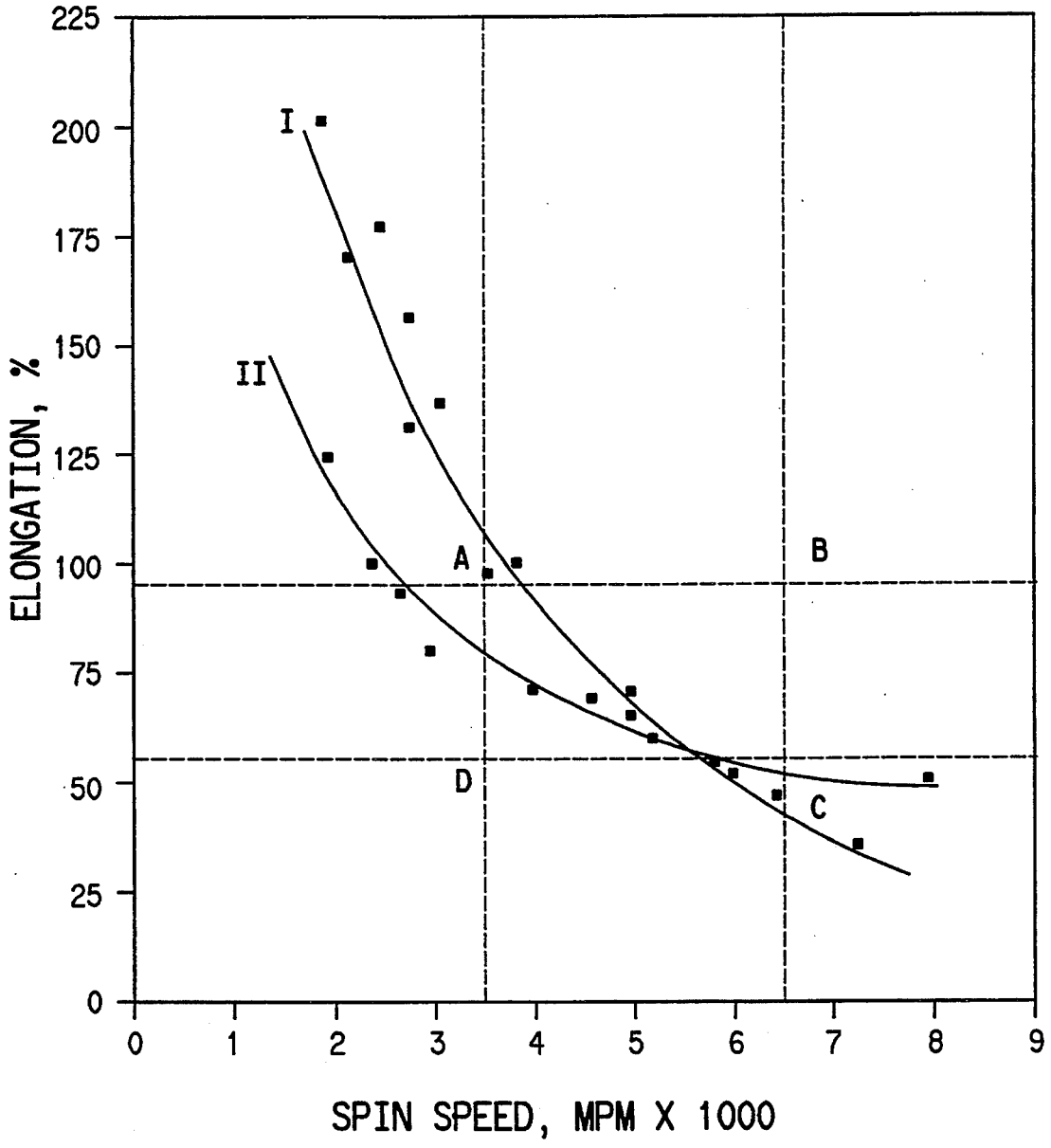
FIG. 9 is a representative plot of the elongations-to-break ($E_B$) of spin-oriented undrawn nylon (II) and polyester (I) versus spinning speed. Between about 3.5 Km/min and 6.5 Km/min (denoted by region ABCD) and especially between about 4 and 6 Km/min, the elongations of undrawn polyester and nylon filaments are of the same order. The elongation of the undrawn nylon filaments may be increased by increasing polymer RV (Chamberlin U.S. Pat. Nos. 4,583,357 and 4,646,514), by use of chain branching agents (Nunning U.S. Pat. No. 4,721,650), or by use of selected copolyamides and higher RV (Knox EP A1 0411774). The elongation of the undrawn polyester may be increased by lower intrinsic viscosity and use of copolyesters (Knox U.S. Pat. No. 4,156,071 and Frankfort and Knox U.S. Pat. Nos. 4,134,882 and 4,195,051), and by incorporating minor amounts of chain branching agents (MacLean U.S. Pat. No. 4,092,229, Knox U.S. Pat. No. 4,156,051 and Reese U.S. Pat. Nos. 4,883,032, 4,996,740, and 5,034,174). The elongation of polyester filaments is especially responsive to changes in filament denier and shape, with elongation decreasing with increasing filament surface-to-volume (i.e., with either or both decreasing filament denier and non-round shapes).
Figure 10:
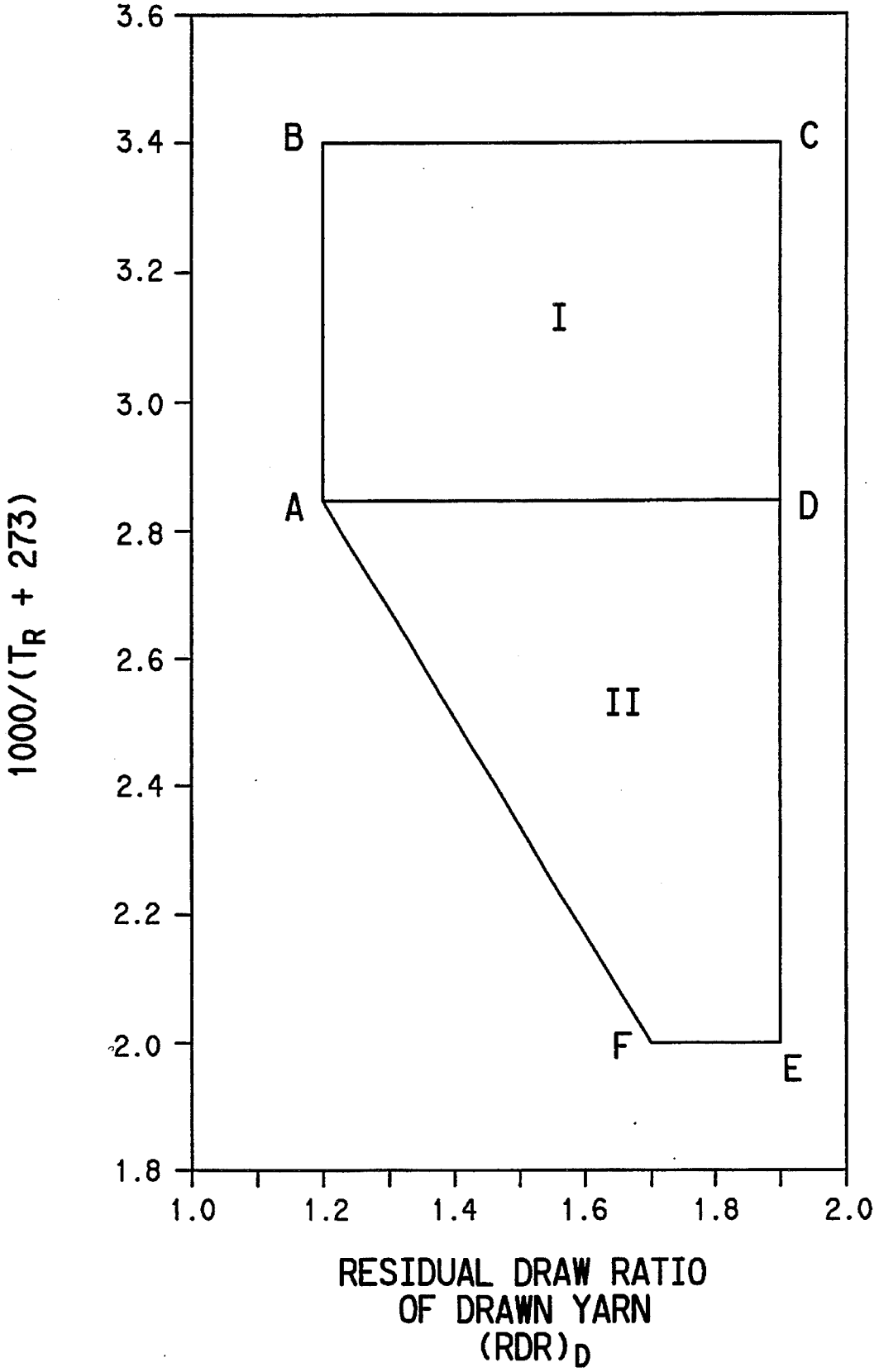
FIG. 10 shows the relationship between the relaxation/heat setting temperature ($T_R$, C) and the residual draw ratio of the drawn yarns $(RDR)_D$ for nylon 66 graphically by a plot of $[1000/(T_R+273)]$ vs. $(RDR)_D$ as described by Boles et al in PCT/US91/04244 (Jun. 21, 1991). Drawn filaments, suitable for critically dyed end-uses are obtained by selecting conditions met by the regions I (ABCD) and II (ADEF). Acceptable along-end dye uniformity is achieved if the extent of drawing and heat setting are balanced as described by the relationship: $1000/(T_R+273)>/=[4.95-1.75(RDR)_D]$. This relaxation temperature vs. $(RDR)_D$ relation is also applied when co-drawing and heat relaxing or heat relaxing previous drawn and co-mingled mixed-filament yarns, such as co-drawn mixed-filament yarns, such as nylon/polyester filament yarns.
Figure 11A:
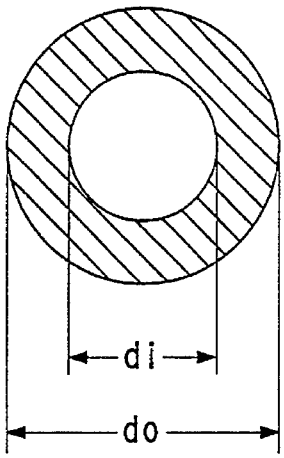
FIGS. 11A through 11D depict cross-sections of round filaments with an outer diameter (D) in FIG. 11D for solid filaments where there is no void, and $d_o$ in FIGS. 11A, 11B, and 11C, for three representative types of comparable hollow filaments according to the invention, where there are voids. The inner diameter is noted as $d_i$ in the latter Figures. Filaments depicted by 11A are hollow but have the same denier (mass per unit length) as the solid filaments of FIG. 11D; that is, their cross-sections contain the same amount of polymer (i.e., total cross-sectional area of 11D equals the annular hatched area of the "tube wall" of 11A). It will be understood that a family of hollow filaments like FIG. 11A could be made with differing void contents, but the same denier. Fabrics made from such Filaments 11A would weigh the same as those from 11D, but would be bulkier and have more "rigidity", i.e. the filaments have more resistance to bending. Filaments depicted by 11B are hollow and designed to have the same "rigidity" (resistance) to bending as those from 11D; this "rigidity" defines, in part, the "drape" or "body" of a fabric, so fabrics made from Filaments 11B and 11D would have the same drape. It will be noted that there is less polymer in the wall of FIG. 11B than for FIG. 11A, and, therefore, for FIG. 11D. So fabrics from these filaments from FIG. 11B would be of lower weight and greater bulk than those for FIG. 11D. Again, a family of hollow filaments like FIG. 11B could be made with differing void contents, but the same "rigidity". Filaments depicted by FIG. 11C have the same outer diameter ($d_o$) as FIG. 11D. Again, a family of such hollow filaments like FIG. 11C could be made with differing void contents, but the same outer diameter. Fabrics made from filaments 11C and 11D would have the same filament and fabric volumes, but such fabrics made from filaments 11C would be lighter and of less "rigidity". Additional discussion of filaments of the types represented by FIGS. 11A, B, C, and D is in Example XXIV of copending application No. 07/979,776 (DP-4040-H), the disclosure of which is incorporated by reference.
Figure 11B:
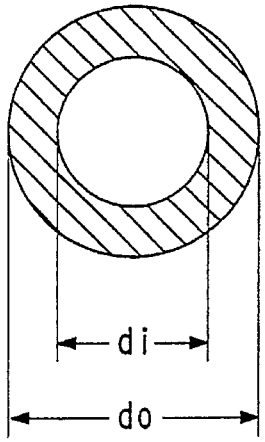
Figure 11C:
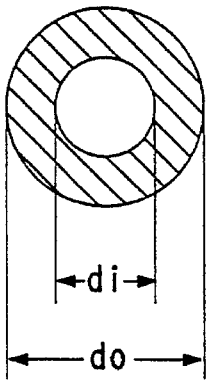
Figure 11D:
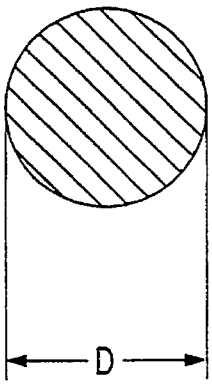

In Example 1, spinnerets were arranged in a 5-ring array (see FIG. 7C), each spinneret being as described and illustrated in FIGS. 4A and 4B, with a capillary depth (H) of about 2.5 mils (64 microns), and an S+T of 42.5 degrees and S/T-ratio of 1.83; and of 24 mils (0.610 mm) OD and 19 mils (0.483 mm) ID to provide an EVA of 0.183 $mm^2$ and a EV of 0.292 $mm^2$.

In Example 2, a 5-ring array and spinnerets with counterbores of a 1.83 S/T ratio were used, as in Example 1; except the OD was increased to 29.5 mils (0.749 mm) and the ID was increased to 24.5 mils (0.622 mm) to provide an EVA (extrusion void area) of 0.304 $mm^2$ and EVA/$(dpf)_s$ ratio of 0.22 to 0.55 with a EVA/EV ratio of 0.71.

In Example 3, the spinnerets were as for Example 1, except the 100 capillaries were arranged in a 2-ring array (see FIG. 7A), in contrast to the 5-ring array, used in Example 1.

Example 4 used similar spinnerets as described for Example 1, except that the counterbore entrance angle S/T ratio was reduced from 1.83 to 1.17 and the total entrance angle (S+T) was increased from 42.5 to 51 degrees.

The results show generally what has already been discussed including effects on void content ($V_C$). For instance, for a given S/T ratio of 1.83, the percent void content was higher from the 2-ring array (Example 3) than the 5 ring array (Example 1), which suggests that the average ambient temperature of the freshly extruded filaments remains hotter longer in the 5-ring array vs. the 2 ring array. Comparison of Examples 2 and 1 indicates that increasing the EVA increases percent void content, but with a slight deterioration of along-end uniformity. Increasing the S/T ratio also tends to increase along-end uniformity somewhat.

The % "Opens" obtained were determined for some of Yarn Nos. 27 to 33 from Examples 1 through 4 and are indicated in Table A:

TABLE A

| YARN NO. | SPUN DPF | EX 1 | EX 2 | EX 3 | EX 4 |
|---|---|---|---|---|---|
| 27 | 1.18 | 3 | 2 | 2 | 0 |
| 28 | 1.00 | 8 | 3 | 2 | 3 |
| 29 | 0.91 | 1 | 2 | 26 | 2 |
| 30 | 0.82 | 7 | 3 | 55 | 1 |
| 31 | 0.73 | 26 | 3 | 73 | 7 |
| 32 | 0.64 | 50 | 3 | — | 26 |
| 33 | 0.55 | 60 | — | — | 36 |

As the denier per filament is reduced the % opens tends generally to increase. The array design has a significant effect on % opens. The array design preferably permits radially directed air to quench all filaments equally by slightly staggering each row (ring of capillaries) slightly with respect to one another so as to enable the inner rows to be uniformly quenched without disturbance like the outer rows, so far as possible.

EXAMPLES 5–9

In Examples 5 to 9 100-hole spinnerets of the 5-ring array (FIG. 7C) were used to spin 0.6 to 1.2 dpf hollow filaments from 2G-T homopolymer of a (nominal) LRV of 21.5, with data being summarized in Tables V through IX, respectively, and otherwise under essentially similar conditions.

In Examples 5 and 6, the spinnerets had capillary depths (H) of about 10 mils (0.25 mm), and 18 mils (0.709 mm) ODs and 14 mils (0.551 mm) ID; with those in Example 5 having a 4-arc orifice (FIG. 4B) with tabs (F) between arcs of 1.5 mils (38 microns), while those in Example 6 had 2 semi-circle arcs (FIG. 6B) with tabs of 2.5 mils (64 microns). For Example 7, 4-arc orifices were used, as for Example 5, but the OD and ID were increased to 24 and 20 mils (0.610 and 0.508 mm), respectively, and tabs (F) of 2.5 mils (64 microns). For Example 8, the spinneret array and OD were as for Example 7 but the ID was decreased from 20 to 19 mils (0.508 to 0.483 mm), which reduces the EVA as well as the ratio of the orifice capillary depth (L) to slot width (W) ratio (as in FIG. 4A).

For Example 9, the spinneret capillary depth (H) was only 4 mils (0.1 mm) in contrast to 10 mils (0.25 mm) used in Examples 5 through 8, and a 4-arc orifice (as in FIG. 4B) was used with an OD of 29.5 mils (0.75 mm), an ID of 24.5 mils (0.62 mm), and tabs of 3.5 mils (89 microns). The data given in Table IX is the average data from 4 ends.

Comparing Tables V and VI indicates that the 2 arc orifice provided higher void content than the 4-arc orifice. Comparing Table VII to Table V confirms that increasing the EVA increases void content and reduces shrinkage. This provides a route to mixed shrinkage hollow filament yarn bundle by using spinnerets of different EVA. Comparing Tables VII and VIII indicates that increasing the H/W ratio increases the void content, possibly by increasing the extrudate bulge.

EXAMPLE 10

In Example 10 yarns spun from spinnerets of Example 6 (2 arcs) and from Example 9 (4 arcs) were draw false-twist textured wherein the void is collapsed providing a random corrugated shaped filament; that is, very much like that of fine cotton fibers. The data is summarized in Table X, where those feed yarns spun according to Example 6 are indicated by "X68-S", and those spun according to Example 9 by "NE-A".

EXAMPLE 11

In Example 11 100-filament yarns of mixed-denier, average denier 1 dpf, and of 15% void content, were prepared by melt spinning at 2700 ypm (2468 mpm) from a spinneret having 100 orifice capillaries of 40 mil (1.016 mm) OD, 34.4 mil (0.874 mm) ID, S+T of 42.5 degrees, a 1.83 S/T-ratio and a 1.4 H/W-ratio, the different dpfs being obtained by providing 50 orifice capillaries with 9×36 mil (0.229×0.914 mm) metering capillaries and the other 50 orifice capillaries with 15×44 mil (0.381×1.176 mm) metering capillaries. These provided a dpf-ratio of about 6:1 which compares with an expected dpf ratio of 9.4:1 (which illustrates the limitations of using just the metering capillary ($L/D^4$)-ratios to project spun dpf-ratios from complex spinneret configurations and at low capillary mass flow rates).

EXAMPLE 12

In Example 12 mixed-denier hollow filaments were prepared by selecting metering capillaries of differing $L/D^4$ values to provide co-spinning of high (H) and low (L) denier filaments. The orifice capillaries were all characterized by a 29.5 mil (0.749 mm) OD, a 24.5 mil (0.622 mm) ID, an orifice capillary H/W-ratio of 1.4, S/T-ratio of 1.83 and S+T of 42.5 degrees. The differential dpf was achieved by using different $L/D^4$-values for the metering capillaries. The metering capillaries for the high (H) dpf filaments were 20×75 mils (0.508×1.905 mm) providing a $L/D^4$-ratio of 28.6 $mm^{-3}$; and the metering capillaries of the low (L) low dpf filaments were 15×72 mils (0.381×1.829 mm) providing a $L/D^4$-ratio of 8.7 $mm^{-3}$ and a ratio of $(L/D^4)H/(L/D^4)_L$ of 3.3, being similar to that of the individual filament deniers, $(dpf)_H/(dpf)_L$.

The mixed-denier yarn was prepared by spinning 50-filaments from nominal 21 LRV polymer at 285 C.; quenching the filaments with a radial quench of a 1.25 inch (3.17 cm) delay; converging the filaments at a distance of about 110 cm using a metered finish tip applicator and withdrawing the spun filaments at a spin speed of 2800 ypm (2560 mpm).

The mixed-denier yarn had an average dpf of 2.36, a $T_7$ of 0.56, an elongation of 142% (corresponding to a Sm value of 74 %), a shrinkage S of 42.7%, a (1−S/Sm)-value of about 0.42, and a tenacity of 2.5 g/d. The measured average void content was 13% for the dpf filaments comprising the 50 filament yarn bundle.

Drawing such mixed-denier filaments as described herein according to provides a simple route to mixed-shrinkage hollow filament yarns.

EXAMPLE 13

In Example 13 hollow filament yarns of 19.8 LRV 2GT homopolymer (HO) and hollow filament yarns of 15.3 LRV 2GT copolymer (CO, modified with 2 mole percent ethylene 5-sodium sulfo isophthalate for cationic dyeability) were spun at a polymer melt temperature ($T_P$) about 290–293 C., using 15×72 mil (0.381×1.829 mm) metering capillaries and orifice capillaries similar to those illustrated in FIG. 5A with total counterbore entrance angle of 60 degrees (S=T), an extrusion void area (EVA) of 1.37 $mm^2$ with a fractional EVA of 0.75, and slot width (W) of 4 mils (0.1016 mm); and the freshly extruded hollow filaments were protected from cooling air by a 2.5 cm delay tube, quenched via radially directed air flow and converged into multi-filament bundles via metered finish tip guide applicators at a distance about 100–115 cm from the spinneret and withdrawn at spin speeds ($V_s$) between 2286 and 4663 m/min (2500 and 5000 ypm), interlaced and wound in the form of spin packages. It is found that the void content (VC) increases with spin speed which approximately corresponds with an increase in the spun filament yarn ($1-S/S_m$). Undrawn filament yarns characterized by elongations ($E_B$) in the range of about 40 to about 120% and by ($1-S/S_m$)-values greater than about 0.4 (e.g., with S-values less than about 50%) can be drawn without significant loss in void content. In contrast, hollow filaments with $E_B$ and ($1-S/S_m$) values outside of the preferred ranges could be drawn without loss in void content, only in some cases, selection of drawing and post heat treatment conditions was found to be significantly more critical than for the filaments of the invention. We also observed that overdrawing the filaments of the invention, e.g., to elongations ($E_B$) less than about 15%, reduced the void content. Preferred drawn hollow filaments have elongations between about 15% and 40%.

In separate tests in which the extrusion void area (EVA) was varied by increasing the orifice capillary OD at a constant rim width, the percent void content is found to increase with EVA; however, as the denier per filament is decreased we prefer to select spinnerets of lower EVA to provide for comparable spinning performance, e.g., comparable [$EVA/(dpf)_s$]. To obtain the same void content for lower filament deniers as for higher denier filaments, at comparable [$EVA/(dpf)_s$] values, we found that it was necessary to increase polymer LRV and/or spin speed. We found that radial quench with a short delay provided higher void content than cross-flow quench, but believe that cross-flow quench could be optimized to obtain similar results as for radial quench.

EXAMPLE 14

In Example 14 nominal 43-denier 50-filament yarns with a concentric void of about 16–17% were spun at 3500 ypm (3.2 km/min) and at 4500 ypm (4.12 km/min). The hollow filaments were formed by post-coalescence of nominal 21.2 LRV polymer at 290° C. using segmented capillary orifices with 15×72 mil (0.381×1.829 mm) metering capillaries essentially as described. The geometry of the entrance capillary (counterbore) to the segmented orifices was adjusted to optimize the extrudate bulge and minimize pre-mature collapse of the hollow melt spinline. The ratio of the inner and outer diameters of the circular cross-section formed by the segmented orifices was adjusted to provide percent void content greater than about 10% and preferably greater than about 15%. The void content was found to increase with extrusion void area EVA, mass flow rate, zero-shear polymer melt viscosity (i.e., proportional to [$LRV(T_M°/T_P)^6$] and with increasing withdrawal speed ($V_s$) and the above process parameters were selected to obtain at least about 10% and preferably at least about 15% void content (VC). For example the fine hollow filaments were quenched using radial quench apparatus fitted with a short delay shroud as described in Example XVI of (parent) application No. 08/015,733, except air flow was reduced to about 16 m/min and converged via a metered finish tip applicator at a distance less than about 140 cm. The yarns spun at 3.2 km/min had a tenacity, an elongation and a modulus of about 3 gpd/90%/45 gpd, respectively and a tenacity-at- 7%-elongation ($T_7$) of about 0.88 g/d. Yarns spun at 4.12 km/min had tenacity/elongation/modulus of about 2.65 gpd/46%/64 gpd, respectively, and a tenacity-at-7%-elongation ($T_7$) of about 1.5 g/d. Yarns spun at 3.2 and 4.12 km/min had boil-off shrinkage (S) values between about 3–5%.

EXAMPLE 15

Figure 16:
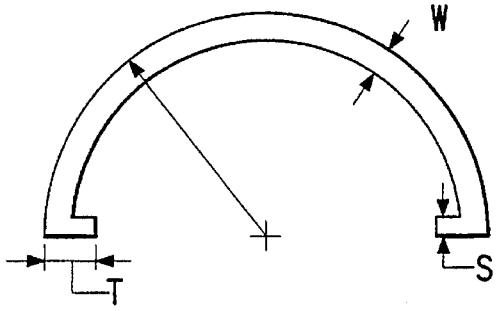
FIG. 16 is a schematic view of the face of a spinneret to show the exit orifice of a capillary for spinning a filament of "C-shape" cross-section. The exit orifice is also shaped like a "C", in other words is a semi-circular slot of width W, and with an outer radius R, so the maximum dimension (outer diameter of the orifice arc) is 2R, with extensions of the slot directed inwardly at each end of the semicircle of length T and width S.

Four nominal 80 denier 100 filament (mixed filament) yarns of homopolymer of LRV 21.3 were spun at 2.2 Km/min (2400 ypm) as for item 33 in each of Tables I to IV, using a block temperature of 292.5 C. (polymer temperature measured as 288 C.) and a low quench air flow (at an air pressure of 0.12 inches (3 mm) of water) with radially-directed air and protected by a nominal 2 inch (5 cm) delay tube, except to make mixed filament yarns with varying proportions of the hollow filaments and of "C-shape" filaments, the latter being spun through capillary orifices of configuration as shown in FIG. 16 and dimensions :– radius R=29.4 mils (0.76 mm), width W=S=2.5 mils (63 microns), T=3.5 mils (88 microns), and capillary depth H=10 mils (0.25 mm). Proportions of the hollow and "C" filaments were as shown in Table B, which also gives tenacity and elongation values.

TABLE B

| ITEM | DEN/FIL | TENACITY G/D | ELONG % | % HOLLOW | % C |
|---|---|---|---|---|---|
| 1 | 81.5/100 | 2.25 | 130.9 | 72 | 28 |
| 2 | 81.3/100 | 2.08 | 122.5 | 46 | 54 |
| 3 | 80.6/100 | 2.02 | 112.8 | 2 | 98 |
| 4 | 81.4/100 | 2.22 | 121.4 | 96 | 4 |

Such yarns have shown superiority over regular (solid) filament yarns of similar dpf in wickability and air-permeation in that the wicking performance was superior, regardless of proportions of hollow and "C", and the wind-resistance was considerably superior, with increasing proportions of "C" giving best results. These advantages provide fabrics with a combination of improved breathability and improved wind-resistance.

These as-spun yarns were textured satisfactorily on a Barmag FK6-L900 machine both single and by ply using the following conditions:

| | |
|---|---|
| Thruput | 400 meters/min |
| Heater temperature | 160 C. |
| Interlace pressure | 20 psi |
| Draw Ratio | 1.46X |
| D/Y ratio | 1.707 |
| Disk type | 2/5/1 |
| Textured yarn properties were:- | |
| Denier/filaments | 159/200 |
| Tenacity | 3.86 g/d |
| Elongation | 30.6% |
| TYT shrink | 3.92 |

As compared with regular (solid) filament yarns of similar dpf, these showed several advantages, primarily in appearance visually, the luster being attractive, & also in dye uniformity even though a shorter dyeing time was required, both of these dyeing advantages being significant and important.

EXAMPLE 16

A series of 70 denier 100 (mixed) filament homopolymer (LRV about 21.2) yarns were spun at speeds from 2.75 Km/min (3400 ypm) to 4 Km/min (4400 ypm) to give 50/50 mixtures of hollow filaments with "C" filaments spun through a capillary orifice of configuration as shown in FIG. 16, dimensions :– radius R=15 mils (0.38 mm); width W=S=2 mils (50 microns); T=4 mils (0.1 mm); and capillary depth H= 10 mils (0.25 mm); the polymer melt being supplied from a reservoir above as shown in FIG. 6A. The results are shown in Table C, it being noted that the voids were measured for hollow filaments only for 2 samples, &, in this instance, Dry Heat Shrinkage being measured at 160 C. :

TABLE C

| SPEED YPM | DRAW TENSION GRAMS | DENIER SPREAD % | TEN. GPD | ELO % | $T_7$ GPD | VOID | DHS @ 160° | BOS |
|---|---|---|---|---|---|---|---|---|
| 3400 | 70.9 | 1.70 | 2.41 | 79.1 | 1.02 | | 3.13 | 3.38 |
| 3600 | 77.9 | 1.41 | 2.31 | 66.4 | 1.12 | | 3.05 | 2.98 |
| 3800 | 82.6 | 1.53 | 2.37 | 66.9 | 1.19 | 24.8 | 3.00 | 2.95 |
| 4000 | 88.0 | 1.58 | 2.35 | 66.2 | 1.29 | | 3.05 | 3.03 |
| 4200 | 93.8 | 1.53 | 2.33 | 57.6 | 1.37 | | 3.03 | 2.93 |
| 4400 | 97.8 | 1.64 | 2.28 | 51.6 | 1.47 | 17.0 | 2.95 | 2.90 |

These mixed filament yarns showed the same advantages mentioned in Example 15. Break Tenacity ($T_B$) values calculated for these yarns were as low as 3.67, indicating that yarns of such low break Tenacity (e.g. 3.5 or higher) could be spun and could be useful in certain end-uses, although higher break Tenacities are generally preferred.

EXAMPLE 17

A nominal 98 denier 100 (mixed) filament yarn was spun similarly for use as feed yarn for draw-texturing down to similar 70/100 drawn denier textured yarn using a spin speed of 2.18 Km/min (2375 ypm), a block temperature of 291 C., and quench air at a pressure of 0.18 inches (4.6 mm) of water to give yarn properties—Tenacity 2.59 g/d, Elongation 130.3%, Denier Spread 1.51%, Void Content 17.3%, Draw Tension 53.1 g with 0.53% cv.

This was textured on a Barmag FK6-900L machine at a speed of 500 meters/min, Draw Ratio 1.44X, D/Y ratio 1.707, heater temperature 180 C., polyurethane disc stack 1/5/1 BB, T2 tension 16 grams and interlace pressure 20 psi, to give a textured yarn of 69.5 denier, Modulus 18.7 g/d, Tenacity 3.6 g/d, Elongation 36.6%, Work to maximum elongation 58.6 g, Toughness 0.84 g/d, T7 1.26 g/d, and fray count of 2.

These mixed filament textured yarns showed similar advantages to those mentioned in Example 15.

In addition, yarns of 100% "C-shape" filaments were spun satisfactorily through spinnerets of similar configuration.

Thus "C-shape" cross-sectional filaments (of various dpfs) are believed novel and inventive in their own right in view of the advantages, especially in regard to luster changes derived thereby, especially downstream in fabrics of textured yarns, and with regard to moisture transport, and wicking properties, especially in mixed filament yarns according to the present invention.

As indicated, the low shrinkage undrawn hollow polyester filaments may be co-mingled with polyamide filaments and the mixed filament bundle may be drawn cold or hot, and may be partially drawn to elongations ($E_B$) greater than 30% to provide uniform drawn low shrinkage polyester filaments, as described by Knox and Noe, and thus provide for a capability of co-drawing polyamide/polyester undrawn hollow filaments. Preferred draw/heat setting conditions for yarns containing nylon filaments are described in Boles et al WO91/19839, published Dec. 26, 1991. Preferred polyamide filaments are described by Knox et al in U.S. Pat. No. 5,137,666.

Undrawn hollow filaments of the invention such as in the foregoing Examples may be drawn in a coupled process by subjecting them, before interlacing and winding, to drawing, as described, for example, in Example XX of aforesaid copending application No. 07/979,776 (DP-4040-H).

Fabrics constructed from the hollow filaments of the invention provide for light weight fabrics of greater insulation capability as measured by having a higher Clo-value per unit fabric density (weight/thickness) and provide improved fabric "body" and "drape" for the same fabric weight using "solid" micro denier filaments, such as those of the parent application. For consideration of features that are generally important when selecting dimensions for hollow filaments for use in fabrics, reference may be made to Example XXIV of above-mentioned copending application No. 07/979,776 (DP-4040-H) and FIGS. 12 and 13 herein and the accompanying description.

Reference may also be made to aforesaid related application Nos. 08/093,156 (DP-455-J), filed Jul. 23, 1993, and DP-4555-I, filed simultaneously herewith, for discussions of polyester mixed yarns with fine filaments, the discussion herein of mixed filament yarns being partially applicable to concepts of mixed yarns disclosed therein.

TABLE I

| Yarn No. | Spun Den. | Spun DPF | EVA/D PF | Spin Spd. MPM | Block (C) | Q.Air MPM | D.S. (%) | V.C. (%) | Ten. (g/d) | Eb (%) | Tb (g/d) | SM (%) | Drawn DPF |
|---|---|---|---|---|---|---|---|---|---|---|---|---|---|
| 36-1 | 140.0 | 1.40 | 0.13 | 2286 | 291 | 12 | 1.81 | 10.7 | 2.31 | 147.3 | 5.71 | 62.0 | 0.74 |
| 37-1 | 140.0 | 1.40 | 0.13 | 2286 | 291 | 12 | 1.61 | 8.0 | 2.04 | 149.4 | 5.09 | 61.6 | 0.73 |
| 35-1 | 140.0 | 1.40 | 0.13 | 2286 | 291 | 19 | 1.12 | 11.6 | 2.13 | 147.4 | 5.27 | 61.9 | 0.74 |
| 18-1 | 118.0 | 1.18 | 0.16 | 2172 | 288 | 12 | 1.91 | 16.3 | 2.93 | 147.5 | 7.25 | 61.9 | 0.62 |
| 17-1 | 118.0 | 1.18 | 0.16 | 2172 | 288 | 19 | 1.00 | 23.7 | 2.89 | 138.7 | 6.90 | 63.3 | 0.64 |
| 16-1 | 118.0 | 1.18 | 0.16 | 2172 | 288 | 26 | 1.19 | 15.5 | 2.80 | 135.0 | 6.58 | 63.8 | 0.65 |
| 6-1 | 118.0 | 1.18 | 0.16 | 2172 | 291 | 12 | 1.51 | 16.2 | 2.52 | 135.1 | 5.93 | 63.8 | 0.65 |
| 5-1 | 118.0 | 1.18 | 0.16 | 2172 | 291 | 19 | 1.45 | 16.6 | 2.76 | 142.5 | 6.69 | 62.7 | 0.63 |
| 4-1 | 118.0 | 1.18 | 0.16 | 2172 | 291 | 26 | 1.27 | 18.1 | 2.71 | 133.9 | 6.34 | 64.0 | 0.66 |
| 19-1 | 118.0 | 1.18 | 0.16 | 2172 | 294 | 12 | 1.37 | 17.4 | 2.81 | 149.4 | 7.01 | 61.6 | 0.62 |
| 20-1 | 118.0 | 1.18 | 0.16 | 2172 | 294 | 19 | 1.39 | 18.7 | 2.83 | 144.7 | 6.92 | 62.4 | 0.63 |
| 21-1 | 118.0 | 1.18 | 0.16 | 2172 | 294 | 26 | 0.94 | 11.1 | 2.76 | 137.8 | 6.56 | 63.4 | 0.65 |
| 13-1 | 118.0 | 1.18 | 0.16 | 2286 | 288 | 12 | 1.67 | 10.5 | 2.91 | 162.7 | 7.64 | 59.6 | 0.58 |
| 14-1 | 118.0 | 1.18 | 0.16 | 2286 | 288 | 19 | 1.17 | 11.0 | 2.91 | 141.1 | 7.02 | 62.9 | 0.64 |
| 15-1 | 118.0 | 1.18 | 0.16 | 2286 | 288 | 26 | 1.21 | 13.4 | 2.69 | 135.1 | 6.33 | 63.8 | 0.65 |
| 1-1 | 118.0 | 1.18 | 0.16 | 2286 | 291 | 10 | 1.71 | 20.0 | 2.23 | 134.9 | 5.24 | 63.9 | 0.65 |
| 2-1 | 118.0 | 1.18 | 0.16 | 2286 | 291 | 19 | 0.98 | 15.5 | 2.90 | 145.6 | 7.12 | 62.2 | 0.62 |
| 3-1 | 118.0 | 1.18 | 0.16 | 2286 | 291 | 26 | 1.10 | 16.8 | 2.90 | 141.3 | 7.00 | 62.9 | 0.64 |
| 24-1 | 118.0 | 1.18 | 0.16 | 2286 | 294 | 12 | 1.37 | | 2.38 | 122.1 | 5.29 | 65.8 | 0.69 |
| 23-1 | 118.0 | 1.18 | 0.16 | 2286 | 294 | 19 | 1.65 | 20.5 | 2.72 | 156.3 | 6.97 | 60.6 | 0.60 |
| 22-1 | 118.0 | 1.18 | 0.16 | 2286 | 294 | 26 | 1.41 | 21.0 | 2.53 | 141.6 | 6.11 | 62.8 | 0.64 |
| 12-1 | 118.0 | 1.18 | 0.16 | 2400 | 288 | 12 | 1.79 | 17.7 | 2.62 | 127.9 | 5.97 | 64.9 | 0.67 |
| 11-1 | 118.0 | 1.18 | 0.16 | 2400 | 288 | 19 | 1.16 | 23.7 | 2.64 | 128.1 | 6.02 | 64.9 | 0.67 |
| 10-1 | 118.0 | 1.18 | 0.16 | 2400 | 288 | 26 | 1.24 | 23.6 | 2.54 | 136.7 | 6.01 | 63.6 | 0.65 |
| 7-1 | 118.0 | 1.18 | 0.16 | 2400 | 291 | 12 | 1.72 | 16.1 | 2.64 | 155.9 | 6.76 | 60.6 | 0.60 |
| 8-1 | 118.0 | 1.18 | 0.16 | 2400 | 291 | 19 | 1.32 | 17.7 | 2.57 | 143.1 | 6.25 | 62.6 | 0.63 |
| 9-1 | 118.0 | 1.18 | 0.16 | 2400 | 291 | 26 | 1.00 | 21.3 | 2.86 | 133.7 | 6.68 | 64.0 | 0.66 |
| 25-1 | 118.0 | 1.18 | 0.16 | 2400 | 294 | 12 | 3.44 | 19.3 | 2.91 | 136.2 | 6.87 | 63.7 | 0.65 |
| 26-1 | 118.0 | 1.18 | 0.16 | 2400 | 294 | 19 | 1.17 | 18.4 | 2.10 | 113.0 | 4.47 | 67.2 | 0.72 |
| 27-1 | 118.0 | 1.18 | 0.16 | 2400 | 294 | 26 | 1.17 | 15.4 | 2.81 | 135.3 | 6.61 | 63.8 | 0.65 |
| 28-1 | 99.5 | 1.00 | 0.18 | 2400 | 291 | 19 | 1.58 | 18.9 | 2.44 | 123.0 | 5.44 | 65.7 | 0.58 |
| 29-1 | 90.5 | 0.91 | 0.20 | 2400 | 291 | 19 | 1.01 | 20.2 | 2.51 | 119.1 | 5.50 | 66.3 | 0.54 |
| 30-1 | 81.5 | 0.82 | 0.22 | 2400 | 291 | 19 | 0.85 | 14.7 | 2.87 | 121.1 | 6.35 | 66.0 | 0.48 |
| 31-1 | 72.5 | 0.73 | 0.25 | 2400 | 291 | 19 | 1.57 | 14.0 | 2.71 | 108.9 | 5.66 | 67.9 | 0.45 |
| 32-1 | 63.5 | 0.64 | 0.29 | 2400 | 291 | 19 | 1.31 | 15.5 | 2.55 | 97.2 | 5.03 | 69.7 | 0.42 |
| 33-1 | 54.5 | 0.55 | 0.34 | 2400 | 291 | 19 | 1.73 | 15.9 | 2.60 | 94.7 | 5.06 | 70.0 | 0.36 |

TABLE II

| Yarn No. | Spun Den. | Spun DPF | EVA/ DPF | Spin Spd mpm | Block (C) | Q.Air mpm | D.S. (%) | V.C. (%) | Ten. (g/d) | Eb (%) | Tb (g/d) | Sm (%) | Drawn DPF |
|---|---|---|---|---|---|---|---|---|---|---|---|---|---|
| 36-7 | 140.0 | 1.40 | 0.22 | 2286 | 291 | 12 | 1.17 | 13.8 | 2.32 | 150.9 | 5.82 | 61.4 | 0.76 |
| 37-7 | 140.0 | 1.40 | 0.22 | 2286 | 291 | 12 | 2.44 | 12.2 | 1.88 | 128.5 | 4.30 | 64.8 | 0.80 |
| 18-7 | 118.0 | 1.18 | 0.26 | 2172 | 288 | 12 | 2.10 | 19.3 | 3.01 | 149.4 | 7.51 | 61.6 | 0.62 |
| 17-7 | 118.0 | 1.18 | 0.26 | 2172 | 288 | 19 | 1.14 | 27.6 | 2.91 | 140.4 | 6.99 | 63.0 | 0.64 |
| 16-7 | 118.0 | 1.18 | 0.26 | 2172 | 288 | 26 | 1.22 | 18.4 | 2.84 | 131.5 | 6.57 | 64.4 | 0.66 |
| 6-7 | 118.0 | 1.18 | 0.26 | 2172 | 291 | 12 | 1.50 | 16.5 | 2.73 | 141.3 | 6.59 | 62.9 | 0.64 |
| 5-7 | 118.0 | 1.18 | 0.26 | 2172 | 291 | 19 | 1.44 | 21.8 | 2.44 | 124.5 | 5.48 | 65.5 | 0.68 |
| 4-7 | 118.0 | 1.18 | 0.26 | 2172 | 291 | 26 | 1.23 | 21.1 | 2.83 | 141.8 | 6.84 | 62.8 | 0.63 |
| 19-7 | 118.0 | 1.18 | 0.26 | 2172 | 294 | 12 | 1.65 | 17.6 | 2.71 | 139.5 | 6.49 | 63.2 | 0.64 |
| 20-7 | 118.0 | 1.18 | 0.26 | 2172 | 294 | 19 | 1.61 | 22.6 | 2.69 | 133.0 | 6.27 | 64.1 | 0.66 |
| 21-7 | 118.0 | 1.18 | 0.26 | 2172 | 294 | 26 | 1.55 | 18.5 | 2.70 | 131.5 | 6.25 | 64.4 | 0.66 |
| 13-7 | 118.0 | 1.18 | 0.26 | 2286 | 288 | 12 | 1.96 | 15.0 | 2.89 | 144.7 | 7.07 | 62.4 | 0.63 |
| 14-7 | 118.0 | 1.18 | 0.26 | 2286 | 288 | 19 | 1.54 | | 2.84 | 136.5 | 6.72 | 63.6 | 0.65 |
| 15-7 | 118.0 | 1.18 | 0.26 | 2286 | 288 | 26 | 1.39 | 21.8 | 2.12 | 105.7 | 4.36 | 68.4 | 0.75 |
| 1-7 | 118.0 | 1.18 | 0.26 | 2286 | 291 | 10 | 1.94 | 11.8 | 2.49 | 130.2 | 5.73 | 64.6 | 0.67 |
| 2-7 | 118.0 | 1.18 | 0.26 | 2286 | 291 | 19 | 1.14 | 21.8 | 2.83 | 139.4 | 6.78 | 63.2 | 0.64 |
| 3-7 | 118.0 | 1.18 | 0.26 | 2286 | 291 | 26 | 1.66 | 23.6 | 2.61 | 130.4 | 6.01 | 64.6 | 0.67 |
| 24-7 | 118.0 | 1.18 | .026 | 2286 | 294 | 12 | 1.74 | | 2.89 | 144.0 | 7.05 | 62.5 | 0.63 |
| 23-7 | 118.0 | 1.18 | 0.26 | 2286 | 294 | 19 | 1.35 | 22.4 | 2.62 | 147.4 | 6.48 | 61.9 | 0.62 |
| 22-7 | 118.0 | 1.18 | 0.26 | 2286 | 294 | 26 | 1.74 | 21.6 | 2.96 | 139.6 | 7.09 | 63.1 | 0.64 |
| 12-7 | 118.0 | 1.18 | 0.26 | 2400 | 288 | 12 | 1.54 | 22.3 | 2.74 | 129.5 | 6.29 | 64.7 | 0.67 |
| 11-7 | 118.0 | 1.18 | 0.26 | 2400 | 288 | 19 | 1.45 | 26.0 | 2.48 | 132.9 | 5.78 | 64.2 | 0.66 |
| 10-7 | 118.0 | 1.18 | 0.26 | 2400 | 288 | 26 | 1.48 | 31.1 | 2.10 | 77.3 | 3.72 | 72.7 | 0.87 |
| 7-7 | 118.0 | 1.18 | 0.26 | 2400 | 291 | 12 | 1.68 | 19.0 | 2.64 | 148.8 | 6.57 | 61.7 | 0.62 |
| 8-7 | 118.0 | 1.18 | 0.26 | 2400 | 291 | 19 | 1.56 | 24.8 | 2.80 | 135.1 | 6.58 | 63.8 | 0.65 |
| 9-7 | 118.0 | 1.18 | 0.26 | 2400 | 291 | 26 | 1.66 | 23.2 | 2.79 | 126.0 | 6.31 | 65.2 | 0.68 |
| 25-7 | 118.0 | 1.18 | 0.26 | 2400 | 294 | 12 | 1.82 | 16.9 | 2.78 | 151.1 | 6.98 | 61.4 | 0.61 |
| 26-7 | 118.0 | 1.18 | 0.26 | 2400 | 294 | 19 | 1.08 | 18.3 | 2.53 | 128.7 | 5.79 | 64.8 | 0.67 |
| 27-7 | 118.0 | 1.18 | 0.26 | 2400 | 294 | 26 | 1.82 | 20.9 | 2.28 | 112.2 | 4.84 | 67.4 | 0.72 |
| 28-7 | 99.5 | 1.00 | 0.30 | 2400 | 291 | 19 | 1.62 | 20.0 | 2.97 | 130.3 | 6.84 | 64.6 | 0.56 |
| 29-7 | 90.5 | 0.91 | 0.33 | 2400 | 291 | 19 | 1.40 | 25.6 | 2.45 | 110.1 | 5.15 | 67.7 | 0.56 |
| 30-7 | 81.5 | 0.82 | 0.37 | 2400 | 291 | 19 | 1.43 | 21.7 | 2.89 | 116.6 | 6.26 | 66.7 | 0.49 |
| 31-7 | 72.5 | 0.73 | 0.42 | 2400 | 291 | 19 | 1.62 | 20.0 | 2.60 | 106.5 | 5.37 | 68.2 | 0.46 |
| 32-7 | 63.5 | 0.64 | 0.48 | 2400 | 291 | 19 | 1.22 | 20.2 | 2.65 | 101.2 | 5.33 | 69.0 | 0.41 |
| 33-7 | 54.5 | 0.55 | 0.55 | 2400 | 291 | 19 | 1.93 | 16.0 | 2.82 | 103.6 | 5.74 | 68.7 | 0.35 |

TABLE III

| Yarn No. | Spun Den. | Spun DPF | EVA/ DPF | Spin Spd mpm | Block (C) | Q.Air mpm | D.S. (%) | V.C. (%) | Ten. (g/d) | Eb (%) | Tb (g/d) | Sm (%) | Drawn DPF |
|---|---|---|---|---|---|---|---|---|---|---|---|---|---|
| 36-4 | 140.0 | 1.40 | 0.13 | 2286 | 291 | 12 | 3.91 | 11.9 | 2.44 | 157.0 | 6.27 | 60.5 | 0.71 |
| 37-4 | 140.0 | 1.40 | 0.13 | 2286 | 291 | 12 | 3.67 | 10.8 | 2.55 | 152.3 | 6.43 | 61.2 | 0.72 |
| 35-4 | 140.0 | 1.40 | 0.13 | 2286 | 291 | 19 | 4.63 | 15.2 | 2.54 | 151.2 | 6.38 | 61.4 | 0.72 |
| 18-4 | 118.0 | 1.18 | 0.16 | 2172 | 288 | 12 | 4.07 | 23.2 | 3.01 | 148.2 | 7.47 | 61.8 | 0.62 |
| 17-4 | 118.0 | 1.18 | 0.16 | 2172 | 288 | 19 | 1.37 | 24.9 | 2.86 | 131.3 | 6.61 | 64.4 | 0.66 |
| 16-4 | 118.0 | 1.18 | 0.16 | 2172 | 288 | 26 | 1.13 | 20.1 | 2.86 | 132.5 | 6.65 | 64.2 | 0.66 |
| 6-4 | 118.0 | 1.18 | 0.16 | 2172 | 291 | 12 | 3.30 | 17.2 | 2.17 | 118.6 | 4.74 | 66.4 | 0.70 |
| 5-4 | 118.0 | 1.18 | 0.16 | 2172 | 291 | 19 | 1.56 | 18.5 | 2.78 | 141.6 | 6.72 | 62.8 | 0.64 |
| 4-4 | 118.0 | 1.18 | 0.16 | 2172 | 291 | 26 | 1.18 | 21.0 | 2.81 | 132.8 | 6.54 | 64.2 | 0.66 |
| 19-4 | 118.0 | 1.18 | 0.16 | 2172 | 294 | 12 | 1.92 | 18.0 | 2.71 | 133.2 | 6.32 | 64.1 | 0.66 |
| 20-4 | 118.0 | 1.18 | 0.16 | 2172 | 294 | 19 | 1.10 | 22.1 | 2.66 | 130.7 | 6.14 | 64.5 | 0.67 |
| 21-4 | 118.0 | 1.18 | 0.16 | 2172 | 294 | 26 | 1.16 | 16.6 | 2.83 | 136.1 | 6.68 | 63.7 | 0.65 |
| 13-4 | 118.0 | 1.18 | 0.16 | 2286 | 288 | 12 | 3.90 | 17.0 | 2.57 | 133.5 | 6.00 | 64.1 | 0.66 |
| 14-4 | 118.0 | 1.18 | 0.16 | 2286 | 288 | 19 | 1.79 | 19.9 | 2.93 | 136.1 | 6.92 | 63.7 | 0.65 |
| 15-4 | 118.0 | 1.18 | 0.16 | 2286 | 288 | 26 | 1.22 | 20.0 | 2.90 | 131.9 | 6.73 | 64.3 | 0.66 |
| 1-4 | 118.0 | 1.18 | 0.16 | 2286 | 291 | 10 | 2.49 | 12.7 | 2.88 | 139.6 | 6.90 | 63.1 | 0.64 |
| 2-4 | 118.0 | 1.18 | 0.16 | 2286 | 291 | 19 | 1.54 | 19.7 | 2.98 | 141.6 | 7.20 | 62.8 | 0.63 |
| 3-4 | 118.0 | 1.18 | 0.16 | 2286 | 291 | 26 | 1.23 | 19.9 | 2.90 | 134.2 | 6.79 | 64.0 | 0.66 |
| 24-4 | 118.0 | 1.18 | 0.16 | 2286 | 294 | 12 | 3.98 | | 2.91 | 142.0 | 7.04 | 62.8 | 0.63 |
| 23-4 | 118.0 | 1.18 | 0.16 | 2286 | 294 | 19 | 1.33 | 20.3 | 2.66 | 146.1 | 6.55 | 62.1 | 0.62 |
| 22-4 | 118.0 | 1.18 | 0.16 | 2286 | 294 | 26 | 1.67 | 22.1 | 2.64 | 130.6 | 6.09 | 64.5 | 0.67 |
| 12-4 | 118.0 | 1.18 | 0.16 | 2400 | 288 | 12 | 3.02 | 23.5 | 2.60 | 114.8 | 5.58 | 67.0 | 0.71 |
| 11-4 | 118.0 | 1.18 | 0.16 | 2400 | 288 | 19 | 1.56 | 27.5 | 2.51 | 119.2 | 5.50 | 66.3 | 0.70 |
| 10-4 | 118.0 | 1.18 | 0.16 | 2400 | 288 | 26 | 1.38 | 26.4 | 2.72 | 135.2 | 6.40 | 63.8 | 0.65 |
| 7-4 | 118.0 | 1.18 | 0.16 | 2400 | 291 | 12 | 3.05 | 21.1 | 2.43 | 118.7 | 5.31 | 66.4 | 0.70 |
| 8-4 | 118.0 | 1.18 | 0.16 | 2400 | 291 | 19 | 1.26 | 21.9 | 2.92 | 135.9 | 6.89 | 63.7 | 0.65 |

TABLE III-continued

| Yarn No. | Spun Den. | Spun DPF | EVA/ DPF | Spin Spd mpm | Block (C) | Q.Air mpm | D.S. (%) | V.C. (%) | Ten. (g/d) | Eb (%) | Tb (g/d) | Sm (%) | Drawn DPF |
|---|---|---|---|---|---|---|---|---|---|---|---|---|---|
| 9-4 | 118.0 | 1.18 | 0.16 | 2400 | 291 | 26 | 1.07 | 24.8 | 2.51 | 115.9 | 5.42 | 66.8 | 0.71 |
| 25-4 | 118.0 | 1.18 | 0.16 | 2400 | 294 | 12 | 1.67 | 15.4 | 2.59 | 128.9 | 5.93 | 64.8 | 0.67 |
| 26-4 | 118.0 | 1.18 | 0.16 | 2400 | 294 | 19 | 1.26 | 22.3 | 2.57 | 126.4 | 5.82 | 65.2 | 0.68 |
| 27-4 | 118.0 | 1.18 | 0.16 | 2400 | 294 | 26 | 1.54 | 22.2 | 2.81 | 125.8 | 6.35 | 65.3 | 0.68 |
| 28-4 | 99.5 | 1.00 | 0.18 | 2400 | 291 | 19 | 1.56 | 18.5 | 2.82 | 120.1 | 6.21 | 66.1 | 0.59 |
| 29-4 | 90.5 | 0.91 | 0.20 | 2400 | 291 | 19 | 1.87 | 25.5 | 2.98 | 122.0 | 6.62 | 65.8 | 0.53 |
| 30-4 | 81.5 | 0.82 | 0.22 | 2400 | 291 | 19 | 1.29 | 22.9 | 2.46 | 95.8 | 4.82 | 69.9 | 0.54 |
| 31-4 | 72.5 | 0.73 | 0.25 | 2400 | 291 | 19 | 2.00 | 16.9 | 2.33 | 92.9 | 4.49 | 70.3 | 0.49 |
| 32-4 | 63.5 | 0.64 | 0.29 | 2400 | 291 | 19 | 2.66 | 15.8 | 2.49 | 91.4 | 4.76 | 70.6 | 0.43 |
| 33-4 | 54.5 | 0.55 | 0.34 | 2400 | 291 | 19 | 4.39 | 17.4 | 2.33 | 85.5 | 4.32 | 71.5 | 0.38 |

TABLE IV

| Yarn No. | Spun Den. | Spun DPF | EVA/ DPF | Spin Spd mpm | Block (C) | Q.Air mpm | D.S. (%) | V.C. (%) | Ten. (g/d) | Eb (%) | Tb (g/d) | Sm (%) | Drawn DPF |
|---|---|---|---|---|---|---|---|---|---|---|---|---|---|
| 36-5 | 140.0 | 1.40 | 0.13 | 2286 | 291 | 12 | 1.49 | 9.9 | 2.47 | 148.3 | 6.13 | 61.8 | 0.73 |
| 37-5 | 140.0 | 1.40 | 0.13 | 2286 | 291 | 12 | 1.90 | 7.6 | 2.43 | 156.4 | 6.23 | 60.5 | 0.71 |
| 35-5 | 140.0 | 1.40 | 0.13 | 2286 | 291 | 19 | 1.86 | 13.4 | 2.07 | 147.2 | 5.12 | 62.0 | 0.74 |
| 18-5 | 118.0 | 1.18 | 0.16 | 2172 | 288 | 12 | 1.47 | 14.0 | 2.83 | 140.5 | 6.80 | 63.0 | 0.64 |
| 17-5 | 118.0 | 1.18 | 0.16 | 2172 | 288 | 19 | 1.23 | 21.4 | 2.91 | 143.2 | 7.08 | 62.6 | 0.63 |
| 16-5 | 118.0 | 1.18 | 0.16 | 2172 | 288 | 26 | 0.90 | 16.3 | 2.21 | 35.0 | 2.98 | 79.2 | 1.14 |
| 6-5 | 118.0 | 1.18 | 0.16 | 2172 | 291 | 12 | 1.33 | 15.8 | 2.74 | 141.0 | 6.60 | 62.9 | 0.64 |
| 5-5 | 118.0 | 1.18 | 0.16 | 2172 | 291 | 19 | 1.35 | 15.0 | 2.83 | 145.4 | 6.94 | 62.2 | 0.63 |
| 4-5 | 118.0 | 1.18 | 0.16 | 2172 | 291 | 26 | 1.19 | 17.9 | 2.65 | 132.5 | 6.16 | 64.2 | 0.66 |
| 19-5 | 118.0 | 1.18 | 0.16 | 2172 | 294 | 12 | 1.51 | 17.2 | 2.85 | 153.2 | 7.22 | 61.0 | 0.61 |
| 20-5 | 118.0 | 1.18 | 0.16 | 2172 | 294 | 19 | 1.60 | 19.2 | 2.70 | 137.2 | 6.40 | 63.5 | 0.65 |
| 21-5 | 118.0 | 1.18 | 0.16 | 2172 | 294 | 26 | 1.33 | 14.9 | 2.63 | 133.9 | 6.15 | 64.0 | 0.66 |
| 13-5 | 118.0 | 1.18 | 0.16 | 2286 | 288 | 12 | 1.78 | 15.7 | 2.27 | 136.3 | 5.36 | 63.6 | 0.65 |
| 14-5 | 118.0 | 1.18 | 0.16 | 2286 | 288 | 19 | 1.36 | | 2.82 | 137.3 | 6.69 | 63.5 | 0.65 |
| 15-5 | 118.0 | 1.18 | 0.16 | 2286 | 288 | 26 | 1.37 | 14.6 | 2.75 | 134.4 | 6.45 | 63.9 | 0.65 |
| 1-5 | 118.0 | 1.18 | 0.16 | 2286 | 291 | 10 | 1.75 | 15.5 | 2.52 | 142.4 | 6.11 | 62.7 | 0.63 |
| 2-5 | 118.0 | 1.18 | 0.16 | 2286 | 291 | 19 | 1.10 | 15.5 | 2.83 | 125.4 | 6.38 | 65.3 | 0.68 |
| 3-5 | 118.0 | 1.18 | 0.16 | 2286 | 291 | 26 | 1.15 | 17.3 | 2.53 | 129.2 | 5.80 | 64.7 | 0.67 |
| 24-5 | 118.0 | 1.18 | 0.16 | 2286 | 294 | 12 | 2.00 | | 2.83 | 144.7 | 6.92 | 62.4 | 0.63 |
| 23-5 | 118.0 | 1.18 | 0.16 | 2286 | 294 | 19 | 1.14 | 17.1 | 2.72 | 130.4 | 6.27 | 64.6 | 0.67 |
| 22-5 | 118.0 | 1.18 | 0.16 | 2286 | 294 | 26 | 1.56 | 17.4 | 2.54 | 132.8 | 5.91 | 64.2 | 0.66 |
| 12-5 | 118.0 | 1.18 | 0.16 | 2400 | 288 | 12 | 1.43 | 16.9 | 2.81 | 135.0 | 6.60 | 63.8 | 0.65 |
| 11-5 | 118.0 | 1.18 | 0.16 | 2400 | 288 | 19 | 1.39 | 17.9 | 2.71 | 134.3 | 6.35 | 64.0 | 0.65 |
| 10-5 | 118.0 | 1.18 | 0.16 | 2400 | 288 | 26 | 1.35 | 26.3 | 2.56 | 131.7 | 5.93 | 64.4 | 0.66 |
| 7-5 | 118.0 | 1.18 | 0.16 | 2400 | 291 | 12 | 1.35 | 18.3 | 2.74 | 164.0 | 7.23 | 59.4 | 0.58 |
| 8-5 | 118.0 | 1.18 | 0.16 | 2400 | 291 | 19 | 1.54 | 20.2 | 2.82 | 136.9 | 6.68 | 63.6 | 0.65 |
| 9-5 | 118.0 | 1.18 | 0.16 | 2400 | 291 | 26 | 1.19 | 22.6 | 2.72 | 123.4 | 6.08 | 65.6 | 0.69 |
| 25-5 | 118.0 | 1.18 | 0.16 | 2400 | 294 | 12 | 2.01 | 16.3 | 2.63 | 139.9 | 6.31 | 63.1 | 0.64 |
| 26-5 | 118.0 | 1.18 | 0.16 | 2400 | 294 | 19 | 1.61 | 16.8 | 2.69 | 130.2 | 6.19 | 64.6 | 0.67 |
| 27-5 | 118.0 | 1.18 | 0.16 | 2400 | 294 | 26 | 1.64 | 20.4 | 2.34 | 131.2 | 5.41 | 64.4 | 0.66 |
| 28-5 | 99.5 | 1.00 | 0.18 | 2400 | 291 | 19 | 1.30 | 16.8 | 2.81 | 123.8 | 6.29 | 65.6 | 0.58 |
| 29-5 | 90.5 | 0.91 | 0.20 | 2400 | 291 | 19 | 1.02 | 17.7 | 2.82 | 119.5 | 6.19 | 66.2 | 0.54 |
| 30-5 | 81.5 | 0.82 | 0.22 | 2400 | 291 | 19 | 1.21 | 20.0 | 2.89 | 118.7 | 6.32 | 66.4 | 0.48 |
| 31-5 | 72.5 | 0.73 | 0.25 | 2400 | 291 | 19 | 0.99 | 13.9 | 2.83 | 113.0 | 6.03 | 67.2 | 0.44 |
| 32-5 | 63.5 | 0.64 | 0.29 | 2400 | 291 | 19 | 1.59 | 14.8 | 2.61 | 98.4 | 5.18 | 69.5 | 0.42 |
| 33-5 | 54.5 | 0.55 | 0.34 | 2400 | 291 | 19 | 1.65 | 12.7 | 2.75 | 103.6 | 5.60 | 68.7 | 0.35 |

TABLE V

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 304-3 | 120 | 1.20 | 0.08 | 2172 | 291 | 26 | 1.82 | 15.0 | 2.63 | 139.4 | 6.30 | 0.63 | 0.60 | 40.3 | 63.2 | 0.36 | 0.65 |
| 308-3 | 120 | 1.20 | 0.08 | 2400 | 291 | 19 | 1.71 | 16.3 | 2.70 | 136.2 | 6.38 | 0.62 | 0.60 | 34.6 | 63.7 | 0.46 | 0.66 |
| 309-3 | 120 | 1.20 | 0.08 | 2400 | 291 | 26 | 1.80 | 14.6 | 2.76 | 137.7 | 6.56 | 0.66 | 0.61 | 32.5 | 63.4 | 0.49 | 0.66 |
| 310-3 | 120 | 1.20 | 0.08 | 2400 | 288 | 26 | 1.63 | 21.0 | 2.71 | 132.0 | 6.29 | 0.65 | 0.63 | 24.7 | 64.3 | 0.62 | 0.67 |

TABLE V-continued

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 327-3 | 120 | 1.20 | 0.08 | 2400 | 294 | 26 | 1.69 | 19.1 | 2.68 | 138.7 | 6.40 | 0.62 | 0.58 | 32.5 | 63.3 | 0.49 | 0.65 |
| 337-3 | 120 | 1.20 | 0.08 | 2400 | 291 | 33 | 1.64 | 23.6 | 2.57 | 127.5 | 5.85 | 0.65 | 0.61 | 32.8 | 65.0 | 0.50 | 0.69 |
| 339-3 | 120 | 1.20 | 0.08 | 2515 | 291 | 26 | 1.56 | 18.8 | 2.64 | 129.5 | 6.06 | 0.66 | 0.62 | 25.8 | 64.7 | 0.60 | 0.68 |
| 329-3 | 100 | 1.00 | 0.10 | 2400 | 291 | 19 | 2.06 | 11.3 | 2.83 | 132.5 | 6.58 | 0.65 | 0.65 | 16.4 | 64.2 | 0.74 | 0.56 |
| 330-3 | 90 | 0.90 | 0.11 | 2400 | 291 | 19 | 1.71 | 11.8 | 2.96 | 129.4 | 6.79 | 0.69 | 0.69 | 14.2 | 64.7 | 0.78 | 0.51 |
| 331-3 | 80 | 0.80 | 0.12 | 2400 | 291 | 19 | 1.66 | 16.1 | 3.00 | 127.0 | 6.81 | 0.73 | 0.77 | 8.2 | 65.1 | 0.87 | 0.46 |
| 332-3 | 70 | 0.70 | 0.14 | 2400 | 291 | 19 | 1.40 | 19.0 | 2.92 | 113.9 | 6.25 | 0.77 | 0.87 | 5.3 | 67.1 | 0.92 | 0.43 |
| 333-3 | 60 | 0.60 | 0.17 | 2400 | 291 | 19 | 1.52 | 15.5 | 2.47 | 103.9 | 5.04 | 0.86 | 1.00 | 4.2 | 68.6 | 0.94 | 0.38 |

TABLE VI

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 304-5 | 120 | 1.20 | 0.08 | 2172 | 291 | 26 | 1.73 | 18.6 | 2.75 | 145.2 | 6.74 | 0.63 | 0.61 | 38.1 | 62.3 | .039 | 0.64 |
| 308-5 | 120 | 1.20 | 0.08 | 2400 | 291 | 19 | 1.63 | 13.6 | 2.60 | 130.5 | 5.99 | 0.63 | 0.62 | 29.0 | 64.5 | 0.55 | 0.68 |
| 309-5 | 120 | 1.20 | 0.08 | 2400 | 291 | 26 | 1.60 | 11.0 | 2.74 | 134.5 | 6.43 | 0.64 | 0.60 | 28.3 | 63.9 | 0.56 | 0.67 |
| 310-5 | 120 | 1.20 | 0.08 | 2400 | 288 | 26 | 1.91 | 21.6 | 2.78 | 136.6 | 6.58 | 0.65 | 0.64 | 24.8 | 63.6 | 0.61 | 0.66 |
| 327-5 | 120 | 1.20 | 0.08 | 2400 | 294 | 26 | 1.03 | 14.9 | 2.60 | 131.0 | 6.01 | 0.65 | 0.59 | 31.6 | 64.5 | 0.51 | 0.68 |
| 337-5 | 120 | 1.20 | 0.08 | 2400 | 291 | 33 | 1.03 | 23.7 | 2.76 | 138.6 | 6.59 | 0.65 | 0.61 | 28.6 | 63.3 | 0.55 | 0.65 |
| 339-5 | 120 | 1.20 | 0.08 | 2515 | 291 | 26 | 1.46 | 21.7 | 2.78 | 132.9 | 6.47 | 0.66 | 0.64 | 25.4 | 64.2 | 0.60 | 0.67 |
| 329-5 | 100 | 1.00 | 0.10 | 2400 | 291 | 19 | 1.56 | 14.9 | 2.84 | 125.6 | 6.41 | 0.67 | 0.65 | 14.7 | 65.3 | 0.77 | 0.58 |
| 330-5 | 90 | 0.90 | 0.11 | 2400 | 291 | 19 | 1.56 | 17.2 | 2.87 | 117.9 | 6.25 | 0.77 | 0.83 | 7.6 | 66.5 | 0.89 | 0.54 |
| 331-5 | 80 | 0.80 | 0.12 | 2400 | 291 | 19 | 1.09 | 20.0 | 2.96 | 126.0 | 6.69 | 0.73 | 0.78 | 7.5 | 65.2 | 0.89 | 0.46 |
| 332-5 | 70 | 0.70 | 0.14 | 2400 | 291 | 19 | 1.22 | 19.4 | 3.00 | 117.7 | 6.53 | 0.78 | 0.88 | 5.2 | 66.5 | 0.92 | 0.42 |
| 333-5 | 60 | 0.60 | 0.17 | 2400 | 291 | 19 | 1.52 | 19.4 | 2.54 | 110.1 | 5.34 | 0.90 | 1.05 | 4.0 | 67.7 | 0.94 | 0.37 |

TABLE VII

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 304-4 | 120 | 1.20 | 0.17 | 2172 | 291 | 26 | 1.86 | 17.9 | 2.68 | 135.9 | 6.32 | 0.66 | 0.61 | 34.8 | 63.7 | 0.45 | 0.66 |
| 308-4 | 120 | 1.20 | 0.17 | 2400 | 291 | 19 | 1.83 | 18.7 | 2.65 | 128.9 | 6.07 | 0.65 | 0.63 | 28.5 | 64.8 | 0.56 | 0.68 |
| 309-4 | 120 | 1.20 | 0.17 | 2400 | 291 | 26 | 1.62 | 18.9 | 2.70 | 128.7 | 6.17 | 0.67 | 0.67 | 23.3 | 64.8 | 0.64 | 0.68 |
| 310-4 | 120 | 1.20 | 0.17 | 2400 | 288 | 26 | 1.60 | 30.3 | 2.69 | 125.0 | 6.05 | 0.69 | 0.69 | 18.5 | 65.4 | 0.72 | 0.69 |
| 327-4 | 120 | 1.20 | 0.17 | 2400 | 294 | 26 | 1.70 | 22.3 | 2.52 | 120.7 | 5.56 | 0.66 | 0.65 | 26.0 | 66.0 | 0.61 | 0.71 |
| 337-4 | 120 | 1.20 | 0.17 | 2400 | 291 | 33 | 1.21 | 22.8 | 2.74 | 131.4 | 6.34 | 0.68 | 0.65 | 22.7 | 64.4 | 0.65 | 0.67 |
| 339-4 | 120 | 1.20 | 0.17 | 2515 | 291 | 26 | 2.07 | 23.9 | 2.75 | 128.8 | 6.29 | 0.69 | 0.67 | 22.8 | 64.8 | 0.65 | 0.68 |
| 329-4 | 100 | 1.00 | 0.20 | 2400 | 291 | 19 | 2.28 | 18.5 | 2.52 | 107.4 | 5.23 | 0.71 | 0.73 | 14.1 | 68.1 | 0.79 | 0.63 |
| 330-4 | 90 | 0.90 | 0.23 | 2400 | 291 | 19 | 1.95 | 19.3 | 2.75 | 110.8 | 5.80 | 0.74 | 0.79 | 9.0 | 67.6 | 0.87 | 0.56 |
| 331-4 | 80 | 0.80 | 0.25 | 2400 | 291 | 19 | 1.86 | 20.7 | 2.89 | 115.8 | 6.24 | 0.81 | 0.91 | 5.5 | 66.8 | 0.92 | 0.48 |
| 332-4 | 70 | 0.70 | 0.29 | 2400 | 291 | 19 | 1.72 | 15.8 | 2.83 | 111.3 | 5.98 | 0.89 | 1.03 | 4.0 | 67.5 | 0.94 | 0.43 |
| 333-4 | 60 | 0.60 | 0.34 | 2400 | 291 | 19 | 1.50 | 20.0 | 2.33 | 95.6 | 4.56 | 1.01 | 1.20 | 3.4 | 69.9 | 0.95 | 0.40 |

TABLE VIII

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 304-8 | 120 | 1.20 | 0.15 | 2172 | 291 | 26 | 2.06 | 13.2 | 2.61 | 132.2 | 6.06 | 0.64 | 0.61 | 34.9 | 64.3 | 0.46 | 0.67 |
| 308-8 | 120 | 1.20 | 0.15 | 2400 | 291 | 19 | 1.36 | 10.2 | 2.70 | 133.8 | 6.31 | 0.65 | 0.62 | 25.7 | 64.0 | 0.60 | 0.67 |
| 309-8 | 120 | 1.20 | 0.15 | 2400 | 291 | 26 | 1.33 | 11.3 | 2.80 | 133.9 | 6.55 | 0.66 | 0.63 | 23.4 | 64.0 | 0.63 | 0.67 |
| 310-8 | 120 | 1.20 | 0.15 | 2400 | 288 | 26 | 1.25 | 22.8 | 2.79 | 133.6 | 6.52 | 0.63 | 0.67 | 17.4 | 64.1 | 0.73 | 0.67 |
| 327-8 | 120 | 1.20 | 0.15 | 2400 | 294 | 26 | 1.35 | 13.0 | 2.54 | 126.5 | 5.75 | 0.58 | 0.63 | 28.0 | 65.2 | 0.57 | 0.69 |
| 337-8 | 120 | 1.20 | 0.15 | 2400 | 291 | 33 | 1.86 | 15.1 | 2.58 | 122.4 | 5.74 | 0.66 | 0.65 | 19.9 | 65.8 | 0.70 | 0.70 |
| 339-8 | 120 | 1.20 | 0.15 | 2515 | 291 | 26 | | 20.6 | 2.60 | 121.8 | 5.77 | 0.67 | 0.67 | 21.2 | 65.9 | 0.68 | 0.70 |
| 329-8 | 100 | 1.00 | 0.18 | 2400 | 291 | 19 | 1.60 | 18.3 | 2.87 | 126.4 | 6.50 | 0.68 | 0.70 | 12.6 | 65.2 | 0.81 | 0.57 |
| 330-8 | 90 | 0.90 | 0.20 | 2400 | 291 | 19 | 1.24 | 10.4 | 2.90 | 121.7 | 6.43 | 0.71 | 0.77 | 9.4 | 65.9 | 0.86 | 0.53 |
| 331-8 | 80 | 0.80 | 0.23 | 2400 | 291 | 19 | 1.12 | 12.9 | 2.78 | 109.4 | 5.82 | 0.78 | 0.87 | 5.5 | 67.8 | 0.92 | 0.50 |
| 332-8 | 70 | 0.70 | 0.26 | 2400 | 291 | 19 | 1.59 | 12.1 | 2.88 | 108.5 | 6.00 | 0.83 | 0.94 | 4.2 | 67.9 | 0.94 | 0.44 |
| 333-8 | 60 | 0.60 | 0.30 | 2400 | 291 | 19 | 1.27 | 12.6 | 2.47 | 102.0 | 4.99 | 0.96 | 1.14 | 3.6 | 68.9 | 0.95 | 0.39 |

TABLE IX

| Yarn No. | Spun Den. | Spun DPF | EVA/ DPF | Spin Spd DPF | Block (C) | Q.Air (MPM) | D.S. (%) | V.C. (%) | Ten. (g/d) | Eb (%) | Tb (g/d) | T7 (g/d) | T20 (g/d) | S1 (%) | Sm (%) | 1-S1/Sm | Drawn DPF |
|---|---|---|---|---|---|---|---|---|---|---|---|---|---|---|---|---|---|
| 304-A | 120 | 1.20 | 0.25 | 2172 | 291 | 26 | 1.81 | 10.7 | 2.59 | 139.4 | 6.20 | 0.63 | 0.60 | 39.6 | 63.2 | 0.37 | 0.65 |
| 308-A | 120 | 1.20 | 0.25 | 2400 | 291 | 19 | 1.81 | 15.4 | 2.75 | 130.6 | 6.34 | 0.66 | 0.66 | 21.4 | 64.5 | 0.67 | 0.68 |
| 309-A | 120 | 1.20 | 0.25 | 2400 | 291 | 26 | 1.40 | 18.0 | 2.56 | 116.7 | 5.55 | 0.69 | 0.70 | 18.5 | 66.7 | 0.72 | 0.72 |
| 310-A | 120 | 1.20 | 0.25 | 2400 | 288 | 26 | 1.61 | 28.3 | 2.74 | 125.9 | 6.19 | 0.71 | 0.74 | 13.2 | 65.2 | 0.80 | 0.69 |
| 327-A | 120 | 1.20 | 0.25 | 2400 | 294 | 26 | 1.67 | 20.0 | 2.54 | 119.5 | 5.58 | 0.67 | 0.67 | 23.1 | 66.2 | 0.65 | 0.71 |
| 337-A | 120 | 1.20 | 0.25 | 2400 | 291 | 33 | 2.00 | 22.9 | 2.82 | 130.5 | 6.50 | 0.70 | 0.71 | 16.4 | 64.5 | 0.75 | 0.68 |
| 339-A | 120 | 1.20 | 0.25 | 2515 | 291 | 26 | 1.75 | 20.8 | 2.68 | 117.1 | 5.82 | 0.71 | 0.73 | 13.4 | 66.6 | 0.80 | 0.72 |
| 329-A | 100 | 1.00 | 0.30 | 2400 | 291 | 19 | 1.93 | 14.9 | 2.78 | 118.5 | 6.07 | 0.71 | 0.73 | 13.4 | 66.4 | 0.80 | 0.59 |
| 330-A | 90 | 0.90 | 0.34 | 2400 | 291 | 19 | 1.68 | 15.2 | 2.90 | 121.6 | 6.43 | 0.73 | 0.79 | 9.3 | 65.9 | 0.86 | 0.53 |
| 331-A | 80 | 0.80 | 0.38 | 2400 | 291 | 19 | 1.63 | 19.0 | 2.93 | 116.2 | 6.34 | 0.81 | 0.92 | 5.0 | 66.7 | 0.93 | 0.48 |
| 332-A | 70 | 0.70 | 0.43 | 2400 | 291 | 19 | 1.67 | 17.7 | 2.94 | 112.5 | 6.25 | 0.89 | 1.03 | 3.8 | 67.3 | 0.94 | 0.43 |
| 333-A | 60 | 0.60 | 0.50 | 2400 | 291 | 19 | 2.59 | 18.0 | 2.84 | 103.5 | 5.78 | 1.01 | 1.20 | 3.4 | 68.7 | 0.95 | 0.38 |

TABLE X

| Yarn No. | SPUN DEN. | Feed Den. | Draw Ratio | Draw Temp (C.) | D/Y Ratio | Tex. Den. | Mod. (g/d) | T7 (g/d) | Ten. (g/d) | Eb (%) | S1 (%) | D.S. (%) |
|---|---|---|---|---|---|---|---|---|---|---|---|---|
| 327 | X68-5 | 120 | 1.506 | 160 | 1.707 | 81.4 | 46.0 | 1.93 | 3.44 | 27.4 | 4.2 | 1.42 |
| 327 | NE-A | 120 | 1.506 | 160 | 1.707 | 82.6 | 46.3 | 2.03 | 3.72 | 31.9 | 5.5 | 1.48 |
| 329 | X68-5 | 100 | 1.506 | 160 | 1.707 | 68.1 | 45.4 | 2.06 | 3.49 | 25.1 | 5.2 | 1.61 |
| 329 | NE-A | 100 | 1.506 | 160 | 1.707 | 69.4 | 49.2 | 2.23 | 3.41 | 20.8 | 6.0 | 2.08 |
| 330 | X68-5 | 90 | 1.506 | 160 | 1.707 | 61.7 | 50.9 | 2.39 | 3.77 | 24.6 | 5.2 | 1.66 |
| 330 | NE-A | 90 | 1.506 | 160 | 1.707 | 62.5 | 53.8 | 2.45 | 3.34 | 16.8 | 5.0 | 1.46 |
| 331 | X68-5 | 80 | 1.506 | 160 | 1.707 | 55.1 | 52.3 | 2.38 | 3.38 | 19.4 | 5.4 | 1.42 |
| 331 | NE-A | 80 | 1.506 | 160 | 1.707 | 55.7 | 56.6 | 2.65 | 3.75 | 21.9 | 5.8 | 1.63 |
| 332 | X68-5 | 70 | 1.450 | 160 | 1.707 | 49.8 | 55.2 | 2.41 | 3.20 | 17.9 | 4.4 | 1.63 |
| 332 | NE-A | 70 | 1.450 | 160 | 1.707 | 50.5 | 65.1 | 2.61 | 3.13 | 13.5 | 4.4 | 1.92 |

We claim:

1. A spin-orientation process for preparing a yarn bundle of fine polyester continuous filaments that are hollow, having one or more longitudinal voids, and being of void content (VC) at least about 10%; wherein said hollow filaments are formed by a melt-spinning process comprising the steps of: i) melting polyester polymer of about 13 to about 23 LRV and with a zero-shear melting point ($T_M$°) of about 240 to about 265 C., and a glass transition temperature ($T_g$) of about 40 C. to about 80 C.; (ii) extruding the resulting melted polyester polymer through a plurality of segmented capillaries arranged so as to provide an extrusion void area (EVA) of about 0.025 $mm^2$ to about 0.45 $mm^2$, and so that the ratio of EVA to total extrusion area (EA) is about 0.4 to about 0.8, and such that the ratio of EVA to spun filament denier $(dpf)_s$ is about 0.05 to about 0.55; post-coalescing the resulting plurality of polyester melt streams to form uniform hollow filaments; (iii) quenching the hollow filaments using a protective delay shroud of length ($L_{DQ}$) about 2 cm to about 12 $(dpf)^{1/2}$ cm; (iv) converging the quenched hollow filaments into a multi-filament bundle at a distance ($L_C$) of about 50 cm to about $[50+90(dpf)^{1/2}]$ cm while applying spin finish; and (v) withdrawing the multi-filament bundle at a withdrawal speed ($V_s$) in a range of about 2 to about 5 Km/min; such process conditions being selected to provide an as-spun yarn bundle having: a residual elongation of about 40% to about 160%, tenacity-at-7% elongation ($T_7$) of about 0.5 to about 1.75 g/d, a (1−S/Sm) ratio of at least 0.1 and differential shrinkage (DHS-S) less than about +2%, where S is the boil-off shrinkage, $S_m$ is the maximum shrinkage potential and DHS is the dry heat shrinkage (measured at 180 C.), and a maximum shrinkage tension ($ST_{max}$) of less than 0.2 g/d at a peak shrinkage tension temperature $T(ST_{max})$ of about 5 to about 30 C. greater than about the polymer glass transition temperature ($T_g$).

2. A process according to claim 1, wherein filament dpf, polymer LRV, polymer zero-shear melting point ($T_M$°), polymer spin temperature ($T_P$), capillary EVA, and withdrawal speed ($V_s$) parameters are selected to provide as-spun yarn having a residual elongation of about 90% to about 120%, a tenacity-at-7% elongation ($T_7$) of about 0.5 to about 1 g/d, such that the tenacity-at-20% elongation ($T_{20}$) is at least as high as the $T_7$, a break tenacity ($T_B$), normalized to 20.8 LRV, of at least 5 g/d, and a $(1-S/S_m)$ ratio of at least about 0.25.

3. A process according to claim 1, wherein the filament dpf, polymer LRV, polymer zero-shear melting point ($T_M$°), polymer spin temperature ($T_P$), capillary EVA, and withdrawal speed ($V_s$) parameters are selected to provide an as-spun yarn having a residual elongation of about 40% to about 90%, a tenacity-at-7% elongation ($T_7$) of about 1 to about 1.75 g/d, and a $(1-S/S_m)$ ratio of at least about 0.85.

4. A process according to claim 3, wherein the break tenacity ($T_B$), normalized to 20.8 LRV, is at least 5 g/d.

5. A process according to claim 2, 3, or 4, wherein the parameters are selected so said as-spun yarn (UD) is characterized by having the capability of being drawn to drawn (D) filaments of finer denier having a $(VC)_D/(VC)_{UD}$ ratio (drawn/undrawn void content ratio) of at least about 1.

6. A process according to any one of claims 1 to 4, wherein filament dpf, polymer LRV, polymer zero-shear melting point ($T_M$°), polymer spin temperature ($T_P$), capillary EVA, and withdrawal speed ($V_s$) parameters are selected to provide a value of the following expression for the apparent extensional work, $(W_{ext})_a$, $\{k[LRV(T_M°/T_P)^6][V_s^2dPf][(EVA)^{1/2}\}^n$ of at least about 10, where k has a value of about $10^{-7}$, and the exponent n is defined as the product of ratios [(S/T)(H/W)] where S and T are the inbound and out bound capillary entrance angles, respectively; and H and W are the depth and width, respectively, of the orifice capillary, and wherein the filament void content ($V_C$) from said process is at least about 10% and at least about:

$$Kp\ \mathrm{Log}_{10}\{k[LRV(T_M°/T_P)^6][V_s^2 dpf][(EVA)^{1/2}\}^n,$$

where Kp is a characteristic material constant for the selected polyester having a value of about 10 for poly(ethylene terephthalate) based polymers.

7. A process according to claim 1 or 2, wherein the resulting as-spun yarn is drawn and heat set to provide a uniform drawn yarn having a residual elongation of about 15% to about 40%, a tenacity-at-7% elongation ($T_7$) at least about 1 g/d, and a ($1-S/S_m$) value at least about 0.85.

8. A process according to claim 3 or 4, wherein one or more uniform drawn polyester continuous hollow filament yarns of residual elongation about 15% to about 55%, of tenacity-at-7% elongation ($T_7$) at least about 1 g/d, and of ($1-S/S_m$) value at least about 0.85, are prepared by cold or hot-drawing said as-spun yarns, with or without post heat treatment, under conditions selected whereby there is essentially no loss in filament void content (VC) during said drawing.

9. A process according to claim 1 or 2, wherein the resulting as-spun yarn is drawn at a temperature between the glass-transition temperature ($T_g$) and the temperature of onset of crystallization of the polymer ($T_c°$), without heat setting, to provide a uniform drawn yarn having a residual elongation ($E_B$) of about 15% to about 40%, a tenacity-at-7% elongation ($T_7$) at least about 1 g/d, and a ($1-S/S_M$) value of about 0.5 to about 0.85.

10. A process according to claim 1 wherein the process conditions are selected to provide an interlaced mixed-filament yarn of as-spun filaments of two or more different types, whereby at least one such filament type has a shrinkage S such that the ($1-S/S_m$) value is greater than 0.85 and at least another such filament type has a shrinkage S such that the ($1-S/S_m$) value is in the range 0.5 to 0.85.

11. A process according to claim 10, wherein the resulting as-spun mixed-filament yarn is drawn to a residual elongation ($E_B$) of about 15% to about 40% at a draw temperature ($T_D$) between the glass transition temperature of the polymer ($T_g$) and the temperature of onset of major crystallization of the polymer ($T_c°$), without heat setting, to provide a mixed shrinkage drawn yarn comprised of two or more different types of filaments wherein at least one such filament type has a high shrinkage S such that the ($1-S/S_m$) value is at least about 0.85 and at least another such filament type has a low shrinkage S such that the ($1-S/S_m$) value is in the range 0.5 to 0.85 and such that the shrinkages of such filament types differ by at least about 5% and said drawn yarn has a maximum shrinkage tension ($ST_{max}$) such that the product of the difference in shrinkages of the high and low shrinkage filament types and of the yarn maximum shrinkage tension ($ST_{max}$) is at least about 1.5 (g/d)%, and wherein said drawn yarn has a tenacity-at-break ($T_B$) of at least 5 g/d and a tenacity-at-7% elongation ($T_7$) of at least about 1 g/d.

12. A process according to claim 10 or 11, wherein the resulting mixed shrinkage yarn is heat-relaxed to provide a bulky yarn.

13. A process according to claim 7, wherein the as-spun yarn is drawn by a drawing process that incorporates air-Jet texturing to provide a bulky drawn yarn.

14. A process according to claim 8, wherein the as-spun yarn is drawn by a drawing process that incorporates air-jet texturing to provide a bulky drawn yarn.

15. A process according to claim 7, wherein the as-spun yarn is drawn by a drawing process that incorporates false-twist texturing at a draw temperature between the temperature of maximum rate of crystallization of the polymer ($T_{c,max}$) and 20° C. less than the temperature of onset of melting ($T_m'$), where $T_{c,max}$ is defined by [0.75 ($T_m°$+273)−273] and $T_m'$ is measured by conventional DSC at a heating rate of 20° C. per minute, wherein filament voids partially or completely collapse during said texturing to produce filament cross-sections of different shape.

16. A process according to claim 8, wherein the as-spun yarn is drawn by a drawing process that incorporates false-twist texturing at a draw temperature between the temperature of maximum rate of crystallization of the polymer ($T_{c,max}$) and 20° C. less than the temperature of onset of melting ($T_m'$), where $T_{c,max}$ is defined by [0.75 ($T_m°$+273)−273] and $T_m'$ is measured by conventional DSC at a heating rate of 20° C. per minute, wherein filament voids partially or completely collapse during said texturing to produce filament cross-sections of different shape.

17. A process according to claim 10 or 11, comprising the step of air Jet texturing, without post heat treatment, to provide a bulky yarn.

18. A process according to claim 9, wherein the drawing step incorporates air-jet texturing to provide a bulky yarn of high shrinkage hollow filaments.

* * * * *